US008890856B2

(12) United States Patent
Sasaki et al.

(10) Patent No.: US 8,890,856 B2
(45) Date of Patent: Nov. 18, 2014

(54) DISPLAY DRIVING CIRCUIT, DISPLAY DEVICE AND DISPLAY DRIVING METHOD

(75) Inventors: Yasushi Sasaki, Osaka (JP); Yuhichiroh Murakami, Osaka (JP); Shige Furuta, Osaka (JP); Makoto Yokoyama, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 330 days.

(21) Appl. No.: 13/375,311

(22) PCT Filed: Feb. 24, 2010

(86) PCT No.: PCT/JP2010/001255

§ 371 (c)(1),
(2), (4) Date: Nov. 30, 2011

(87) PCT Pub. No.: WO2010/146742

PCT Pub. Date: Dec. 23, 2010

(65) Prior Publication Data

US 2012/0086686 A1 Apr. 12, 2012

(30) Foreign Application Priority Data

Jun. 17, 2009 (JP) ..... 2009-144750

(51) Int. Cl.
*G09G 5/00* (2006.01)
*G09G 3/36* (2006.01)

(52) U.S. Cl.
CPC ..... *G09G 3/3677* (2013.01); *G09G 2300/0852* (2013.01); *G09G 2300/0876* (2013.01); *G09G 3/3614* (2013.01); *G09G 3/3655* (2013.01); *G09G 2310/0286* (2013.01)
USPC ..... 345/208; 345/90; 345/205

(58) Field of Classification Search
CPC .. G09G 3/3655; G09G 3/3674; G09G 3/3677
USPC ..... 345/84–98, 204–212
See application file for complete search history.

(56) References Cited

U.S. PATENT DOCUMENTS

| | | | | |
|---|---|---|---|---|
| 2005/0036078 | A1 | 2/2005 | Tsunashima et al. | |
| 2005/0110734 | A1 * | 5/2005 | Hirosawa | 345/87 |
| 2007/0188431 | A1 * | 8/2007 | Sato et al. | 345/90 |
| 2008/0218466 | A1 | 9/2008 | Koyama et al. | |
| 2010/0128009 | A1 * | 5/2010 | Okada et al. | 345/205 |

FOREIGN PATENT DOCUMENTS

| | | | |
|---|---|---|---|
| EP | 1 662 473 | | 5/2006 |
| JP | 4-145490 | A | 5/1992 |
| JP | 2001-083943 | A | 3/2001 |
| JP | 2005-049849 | A | 2/2005 |
| JP | 2008-129284 | A | 6/2008 |
| WO | WO-2009/050926 | A1 | 4/2009 |

OTHER PUBLICATIONS

International Search Report and Written Opinion of the International Searching Authority.

* cited by examiner

*Primary Examiner* — Alexander Eisen
*Assistant Examiner* — Amit Chatly
(74) *Attorney, Agent, or Firm* — Harness, Dickey & Pierce, P.L.C.

(57) ABSTRACT

A display driving circuit that carries out CC driving is configured such that retaining circuits are provided in such a way as to correspond one-by-one to their respective stages of a shift register, that a polarity signal CMI is inputted to each of the latch circuits, that when an internal signal Mn generated by a shift register at the nth stage becomes active, a latch circuit corresponding to the nth stage loads and retains the polarity signal CMI, that an output signal SRBOn from the shift register at the nth stage is supplied as a scanning signal to a gate line connected to pixels corresponding to the (n+1)th stage, and that an output from latch circuit corresponding to the nth stage is supplied as CSOUTn to a CS bus line forming capacitors with pixel electrodes of pixels corresponding to the nth stage.

16 Claims, 30 Drawing Sheets

Background Art

Background Art

Background Art

Background Art

Background Art

Background Art

| SB | RB | Q |
|---|---|---|
| L | L | L |
| L | H | H |
| H | L | L |
| H | H | RETAINED |

DISPLAY DRIVING CIRCUIT, DISPLAY DEVICE AND DISPLAY DRIVING METHOD

TECHNICAL FIELD

The present invention relates to driving of display devices such as liquid crystal display devices having active-matrix liquid crystal display panels and, in particular, to a display driving circuit and a display driving method for driving a display panel in a display device employing a drive system referred to as CC (charge coupling) driving.

BACKGROUND ART

A conventional CC driving system that is employed in an active-matrix liquid crystal display device is disclosed, for example, in Patent Literature 1. CC driving is explained by taking as an example the content of disclosure in Patent Literature 1.

FIG. 20 shows a configuration of a device that realizes CC driving. FIG. 21 shows operating waveforms of various signals in CC driving of the device of FIG. 20.

As shown in FIG. 20, the liquid crystal display device that carries out CC driving includes an image display section 110, a source line driving circuit 111, a gate line driving circuit 112, and a CS bus line driving circuit 113.

The image display section 110 includes a plurality of source lines (signal lines) 101, a plurality of gate lines (scanning lines) 102, switching elements 103; pixel electrodes 104; a plurality of CS (capacity storage) bus lines (common electrode lines) 105, retention capacitors 106, liquid crystals 107, and a counter electrode 109. The switching elements 103 are disposed near points of intersection between the plurality of source lines 101 and the plurality of gate lines 102, respectively. The pixel electrodes 104 are connected to the switching elements 103, respectively.

The CS bus lines 105 are paired with the gate lines 102, respectively, and arrange in parallel with one another. Each of the retention capacitor 106 has one end connected to a pixel electrode 104 and the other end connected to a CS bus line 105. The counter electrode 109 is provided in such a way as to face the pixel electrodes 104 with the liquid crystals 107 sandwiched therebetween.

The source line driving circuit 111 is provided so as to drive the source lines 101, and the gate line driving circuit 112 is provided so as to drive the gate lines 102. Further, the CS bus line driving circuit 113 is provided so as to drive the CS bus lines 105.

Each of the switching elements 103 is formed by amorphous silicon (a-Si), polycrystalline silicon (p-Si), monocrystalline silicon (c-Si), and the like. Because of such a structure, a capacitor 108 is formed between the gate and the drain of the switching element 103. This capacitor 108 causes a phenomenon in which a gate pulse signal from a gate line 102 shifts the potential of a pixel electrode 104 toward a negative side.

As shown in FIG. 21, the potential Vg of a gate line 102 in the liquid crystal display device is Von only during an H period (horizontal scanning period) in which the gate line 102 is selected, and retained at Voff during the other periods. The potential Vs of a source line 101 varies in amplitude depending on an video signal to be displayed, but takes a waveform that inverts its polarity every H period centered on the counter electrode potential Vcom and reverses its polarity in an adjacent H period concerning the same gate line 102 (line inversion driving). Since it is assumed in FIG. 21 that a uniform video signal is being inputted, the potential Vs changes with constant amplitude.

The potential Vd of the pixel electrode 104 is equal to the potential Vs of the source line 101 because the switching element 103 conducts during a period in which the potential Vg is Von and, at the moment the potential Vg becomes Voff, the potential Vd shifts slightly toward a negative side through the gate-drain capacitor 108.

The potential Vc of a CS bus line 105 is Ve+ during an H period in which the corresponding gate line 102 is selected and the next H period. Further, the potential Vc switches to Ve− during the H period after the next, and then retained at Ve− until the next field. This switching causes the potential Vd to be shifted toward a negative side through the retention capacitor 106.

In the result, the potential Vd changes with larger amplitude than the potential Vs; therefore, the amplitude of change in the potential Vs can be made smaller. This allows achieving a simplification of circuitry and a reduction of power consumption in the source line driving circuit 111.

CITATION LIST

Patent Literature 1

Japanese Patent Application Publication, Tokukai, No. 2001-83943 A (Publication Date: Mar. 30, 2001)

Patent Literature 2

International Publication No. WO 2009/050926 A1 (Publication Date: Apr. 23, 2009)

SUMMARY OF INVENTION

Technical Problem

The liquid crystal display device employing line inversion driving and CC driving has such a problem that in the first frame after the start of a display, there appear alternate bright and dark transverse stripes every single row (every single horizontal line of the liquid crystal display device).

FIG. 22 is a timing chart showing operation of the liquid crystal display device for explaining the cause of the problem.

In FIG. 22, GSP is a gate start pulse signal that defines a timing of vertical scanning, and GCK1 (CK) and GCK2 (CKB) are gate clock signals that are outputted from the control circuit to define a timing of operation of the shift register. A period from a falling edge to the next falling edge in GSP corresponds to a single vertical scanning period (1V period). A period from a rising edge in GCK1 to a rising edge in GCK2 and a period from a rising edge GCK2 to a rising edge in GCK1 each correspond to a single horizontal scanning period (1H period). CMI is a polarity signal that reverses its polarity every single horizontal scanning period.

Further, FIG. 22 shows the following signals in the order named: a source signal S (video signal), which is supplied from the source line driving circuit 111 to a source line 101 (source line 101 provided in the xth column); a gate signal G1, which is supplied from the gate line driving circuit 112 to a gate line 102 provided in the first row; a CS signal CS1, which is supplied from the CS bus line driving circuit 113 to a CS bus line 105 provided in the first row; and a potential Vpix1 of a pixel electrode provided in the first row and the xth column. Similarly, FIG. 3 shows the following signals in the order named: a gate signal G2, which is supplied to a gate line 102 provided in the second row; a CS signal CS2, which is supplied to a CS bus line 105 provided in the second row; and a potential Vpix2 of a pixel electrode provided in the second row and the xth column. Furthermore, FIG. 3 shows the following signals in the order named: a gate signal G3, which is supplied to a gate line 102 provided in the third row; a CS signal CS3, which is supplied to a CS bus line 105 provided in the third row; and a potential Vpix3 of a pixel electrode provided in the third row and the xth column.

It should be noted that the dotted lines in the potentials Vpix1, Vpix2, and Vpix3 indicate the potential of the counter electrode 109.

In the following, it is assumed that the start frame of a display picture is a first frame and that the first frame is preceded by an initial state. In the initial state, the source line driving circuit 111, the gate line driving circuit 112, and the CS bus line driving circuit 113 are all in the preparatory stages or in a resting state before entering into normal operation. Therefore, the gate signals G1, G2, and G3 are fixed at a gate-off potential (potential at which the gate of a switching element 103 is turned off), and the CS signals CS1, CS2, and CS3 are fixed at one potential (e.g., at a low level).

In the first frame after the initial state, the source line driving circuit 111, the gate line driving circuit 112, and the CS bus line driving circuit 113 are all in normal operation. This causes the source signal S to be a signal which has amplitude corresponding to a gray scale represented by a video signal and which reverses its polarity every 1H period.

It should be noted that since it is assumed in FIG. 22 that a uniform picture is displayed, the amplitude of the source signal S is constant. Meanwhile, the gate signals G1, G2, and G3 serve as gate-on potentials (at which the gates of the switching elements 103 are turned on) during the first, second, and third 1H periods, respectively, in an active period (effective scanning period) of each frame, and serve as gate-off potentials during the other periods.

Then, the CS signals CS1, CS2, and CS3 are reversed after their corresponding gate signals G1, G2, and G3 fall, and take such waveforms that they are opposite in direction of reversal to one another. Specifically, in an odd-numbered frame, the CS signal CS2 rises after its corresponding gate signal G2 falls, and the CS signals CS1 and CS3 fall after their corresponding gate signals G1 and G3 fall. Further, in an even-numbered frame, the CS signal CS2 falls after its corresponding gate signal G2 falls, and the CS signals CS1 and CS3 rise after their corresponding gate signals G1 and G3 fall.

It should be noted that the relationship between rising and falling edges in the CS signals CS1, CS2, and CS3 in the odd-numbered and even-numbered frames may be opposite of the relationship stated above. Further, the timing of inversion of the CS signals CS1, CS2, and CS3 may be the falling edges in the gate signals G1, G2, and G3 or later, i.e., the corresponding horizontal scanning periods or later. For example, the CS signals CS1, CS2, and CS3 may be inverted in synchronization with rising edges in gate signals in the next row.

However, since, in the first frame, the CS signals CS1, CS2, and CS3 are all fixed at one potential (in FIG. 22, at a low level) in the initial state, the potentials Vpix1 and Vpix3 are placed in an irregular state. Specifically, the CS signal CS2 behaves in the same way as in the other odd-numbered frames (third, fifth frame, . . . ) in that it rises after the corresponding gate signal G2 falls, but the CS signals CS1 and CS3 behave differently from the other odd-numbered frames (third, fifth frame, . . . ) in that they are retained at the same potential (in FIG. 22, at a low level) after the corresponding gate signals G1 and G3 fall.

For this reason, in the first frame, there occurs a change in potential of the CS signal CS2 as usual in the pixel electrodes 104 in the second row. Therefore, while the potential Vpix2 is subjected to a potential shift caused by a change in potential of the CS signal CS2, there occur no changes in potential of the CS signals CS1 and CS3 in the pixel electrodes 104 in the first and third rows. Accordingly, the potentials Vpix1 and Vpix3 are not subjected to a potential shift (as indicated by shaded areas in FIG. 22). In the result, despite inputting of source signals S of the same gray scale, there occurs a difference in luminance between the first and third rows and the second row due to a difference between the potentials Vpix1 and Vpix3 and the potential Vpix2. This difference in luminance appears as a difference in luminance between an odd-numbered row and an even-numbered row in the image display section as a whole. Therefore, there appear alternate bright and dark transverse stripes every single row in a picture in the first frame.

A technology capable of suppressing the appearance of such transverse stripes is disclosed in Patent Literature 2. The technology of Patent Literature 2 is described below with reference to FIGS. 24 through 26. FIG. 24 is a block diagram showing a configuration of driving circuits (a gate line driving circuit 30 and a CS bus line driving circuit 40) shown in Patent Literature 2. FIG. 25 is a timing chart showing waveforms of various signals of a liquid crystal display device. FIG. 26 is a timing chart showing waveforms of various signals that are inputted to and outputted from the CS bus line driving circuit.

As shown in FIG. 24, the CS bus line driving circuit 40 has a plurality of logic circuits 41, 42, 43, . . . , 4*n* corresponding to their respective rows. The logic circuits 41, 42, 43, . . . , 4*n* includes D latch circuits 41*a*, 42*a*, 43*a*, . . . , 4*na* and OR circuits 41*b*, 42*b*, 43*b*, . . . , 4*nb*, respectively. In the following, the logic circuits 41 and 42, which correspond to the first and second rows respectively, are taken as an example.

Input signals to the logic circuit 41 are the gate signals G1 and G2, a polarity signal POL, and a rest signal RESET, and input signals to the logic circuits 42 are the gate signals G2 and G3, the polarity signal POL, and the reset signal REST. The polarity signal POL and the reset signal RESET are inputted from the control circuit (not illustrated).

The OR circuit 41*b* receives the gate signal G1 from the corresponding gate line 12 and the gate signal G2 from the gate line 12 of the next row (the second row) and thereby outputs a signal g1 shown in FIG. 26. Further, the OR circuit 42*b* receives the gate signal G2 from the corresponding gate line 12 and the gate signal G3 from the gate line 12 in the next row (the second row) and thereby outputs a signal g2 shown in FIG. 26.

The D latch circuit 41*a* receives the reset signal RESET via its terminal CL, receives the polarity signal POL via its terminal D, and receives the output g1 via its terminal G from the OR circuit 41*b*. In accordance with a change in potential level of the signal g1 (from a low level to a high level or from a high level to a low level) that the D latch circuit 41*a* receives via its terminal G, the D latch circuit 41*a* outputs, as a CS signal CS1, an input state of the polarity signal POL that it receives via its terminal D, and the CS signal CS1 indicates the change in potential level. Specifically, when the potential level of the signal g1 that the D latch circuit 41*a* receives via its terminal G is a high level, the latch circuit 41*a* outputs an input state (low level or high level) of the polarity signal POL that it receives via its terminal D. When the potential level of the signal g1 that the latch circuit 41*a* receives via its terminal G has changed from a high level to a low level, the latch circuit 41*a* latches the input state (low level or high level) of the polarity signal POL that it received via its terminal D at the time of change, and keeps the latched state until the next time when the potential level of the signal g1 that the latch circuit 41*a* receives via its terminal G is raised to a high level. Then, the D latch circuit 41*a* outputs the latched state as the CS signal CS1, shown in FIG. 26, which indicates the change in potential level, via its terminal Q.

Further, similarly, the D latch circuit 42*a* receives the reset signal RESET via its terminal CL, receives the polarity signal POL via its terminal D, and receives the output g2 via its terminal G from the OR circuit 42*b*. This allows the D latch circuit 42*a* to output a CS signal CS2, shown in FIG. 26, which indicates a change in potential level, via its terminal Q.

The foregoing configuration causes the CS signals CS1 and CS2 to be different in potential from each other at points in time where the gate signals in the first and second fall. Therefore, as shown in FIG. 25, the potential Vpix1 is subjected to a potential shift caused by a change in potential of the CS signal CS1, and the potential Vpix2 is subjected to a potential shift caused by a change in potential of the CS signal CS2. This allows eliminating such alternate bright and dark transverse stripes every single row as those shown in FIG. 22.

However, the technology of Patent Literature 2 needs to load a gate signal from the current row and a gate signal from the next row to generate a CS signal shown in FIG. 25, thus causing such a problem that the circuit area increases. To put it in the example described above, the CS signal CS2 from the logic circuit 42 is generated by using the gate signal g2 from the gate line in the second row and a gate signal g3 from the gate line in the third row. This makes it necessary to provide a wire through which the gate signal g3 from the gate line in the third row is loaded and a circuit (OR circuit) that takes the logic of the gate signals g2 and g3, thus causing an increase in circuit area. Such a driving circuit makes it difficult to provide a liquid crystal display panel with a narrow frame.

The present invention has been made in view of the foregoing problems, and it is an object of the present invention to provide a display driving circuit and a display driving method which, without causing an increase in circuit area, make it possible to improve the quality of a display by eliminating the appearance of transverse stripes.

Solution to Problem

A display driving circuit according to the present invention is a display driving circuit for use in a display device in which by supplying retention capacitor wire signals to retention capacitor wires forming capacitors with pixel electrodes included in pixels, signal potentials written into the pixel electrodes are changed in a direction corresponding to polarities of the signal potentials, the display driving circuit including a shift register including a plurality of stages provided in such a way as to correspond to a plurality of scanning signal lines, respectively, the display driving circuit having retaining circuits provided in such a way as to correspond one-by-one to the stages of the shift register, a retention target signal being inputted to each of the retaining circuits, when a control signal generated by a current stage of the shift register becomes active, a retaining circuit corresponding to the current stage loading and retaining the retention target signal, an output signal from the current stage of the shift register being supplied as a scanning signal to a scanning signal line connected to pixels corresponding to the current stage, an output from a retaining circuit corresponding to the current stage being supplied as the retention capacitor wire signal to a retention capacitor wire forming capacitors with pixel electrodes of pixels corresponding to a previous stage preceding the current stage.

A display panel that is driven by the display driving circuit is configured as described above, and a typical arrangement thereof is for example is such that a large number of pixel electrodes are arranged in rows and columns, that a scanning signal line, a switching element, and a retention capacitor wire are arranged along each row, and that a data signal line is arranged along each column. Although, in this typical arrangement, the terms "rows" and "columns", or the terms "horizontal" and "vertical", often refer to arrangements along the transverse and longitudinal directions of the display panel, respectively, it does not need to be that way; the horizontal and vertical relationship may be reversed. As such, the terms the terms "rows" and "columns", or the terms "horizontal" and "vertical", are not to define any directions in particular.

The display driving circuit that drives this display panel uses retention capacitor wire signals to cause signal potentials written into the pixel electrodes to change in a direction corresponding to polarities of the signal potentials, whereby CC driving is achieved.

It should be noted here that a retention capacitor wire signal, as described above, takes such a waveform as to reverse its potential after the nth row gate signal falls (goes off). Conventionally, such a waveform of a retention capacitor wire signal is generated by employing a configuration using the nth row gate signal and the (n+1)th row gate signal (see FIG. 24). Such a configuration makes it necessary to provide wires through which the nth and (n+1)th row shift register outputs (gate signals) are loaded and a logic circuit (OR circuit), thus causing an increase in circuit area.

In this respect, the display driving circuit is configured such that a retention capacitor wire signal is generated by inputting a control signal (internal signal or output signal) generated by a current stage of the shift register to a retention circuit of the current stage and the retention capacitor wire signal is supplied to a retention capacitor wire corresponding to a previous stage. This allows elimination of such irregular waveforms that cause transverse stripes in the first vertical scanning period, thus bringing about an effect of improving the quality of a display by preventing the appearance of transverse stripes in the first vertical scanning period. Further, because it is not necessary to provide a separate element for generating a proper retention capacitor wire signal, it is possible to make the circuit area smaller than in the conventional configuration. This allows achieving a small-sized liquid crystal display device and a liquid crystal display panel with a narrow frame, both with high display quality.

A display driving method according to the present invention is a display driving method for driving a display device which includes a shift register including a plurality of stages provided in such a way as to correspond to a plurality of scanning signal lines, respectively, and in which by supplying retention capacitor wire signals to retention capacitor wires forming capacitors with pixel electrodes included in pixels, signal potentials written into the pixel electrodes are changed in a direction corresponding to polarities of the signal potentials, the display driving method including the steps of: inputting a retention target signal to retaining circuits provided in such a way as to correspond to the stages of the shift register, respectively, and when a control signal generated by a current stage of the shift register becomes active, causing a retaining circuit corresponding to the current stage to load and retain the retention target signal; and supplying an output signal from the current stage of the shift register as a scanning signal to a scanning signal line connected to pixels corresponding to the current stage and supplying an output from a retaining circuit corresponding to the current stage as the retention capacitor wire signal to a retention capacitor wire forming capacitors with pixel electrodes of pixels corresponding to a previous stage preceding the current stage.

As with the effect mentioned above in relation to the display driving circuit, the method brings about an effect of, without causing an increase in circuit area, improving the quality of a display by eliminating the appearance of transverse stripes in the first vertical scanning period.

Advantageous Effects of Invention

As described above, a display driving circuit and a display driving method according to the present invention are such that: retaining circuits are provided in such a way as to correspond one-by-one to the stages of the shift register; a retention target signal is inputted to each of the retaining circuits; when a control signal generated by a current stage of the shift register becomes active, a retaining circuit corresponding to the current stage loads and retains the retention target signal; an output signal from the current stage of the shift register is supplied as a scanning signal to a scanning signal line connected to pixels corresponding to the current stage; and an output from a retaining circuit corresponding to the current stage is supplied as the retention capacitor wire signal to a retention capacitor wire forming capacitors with pixel electrodes of pixels corresponding to a previous stage preceding the current stage.

The configuration and method can bring about an effect of, without causing an increase in circuit area, improving display quality by eliminating the problem of appearance of alternate bright and dart transverse stripes every single low (single line) in the first vertical scanning period (first frame) in which to start to output a data signal corresponding to a picture to be displayed.

DESCRIPTION OF EMBODIMENTS

An embodiment of the present invention is described below with reference to the drawings.

Figure 1:
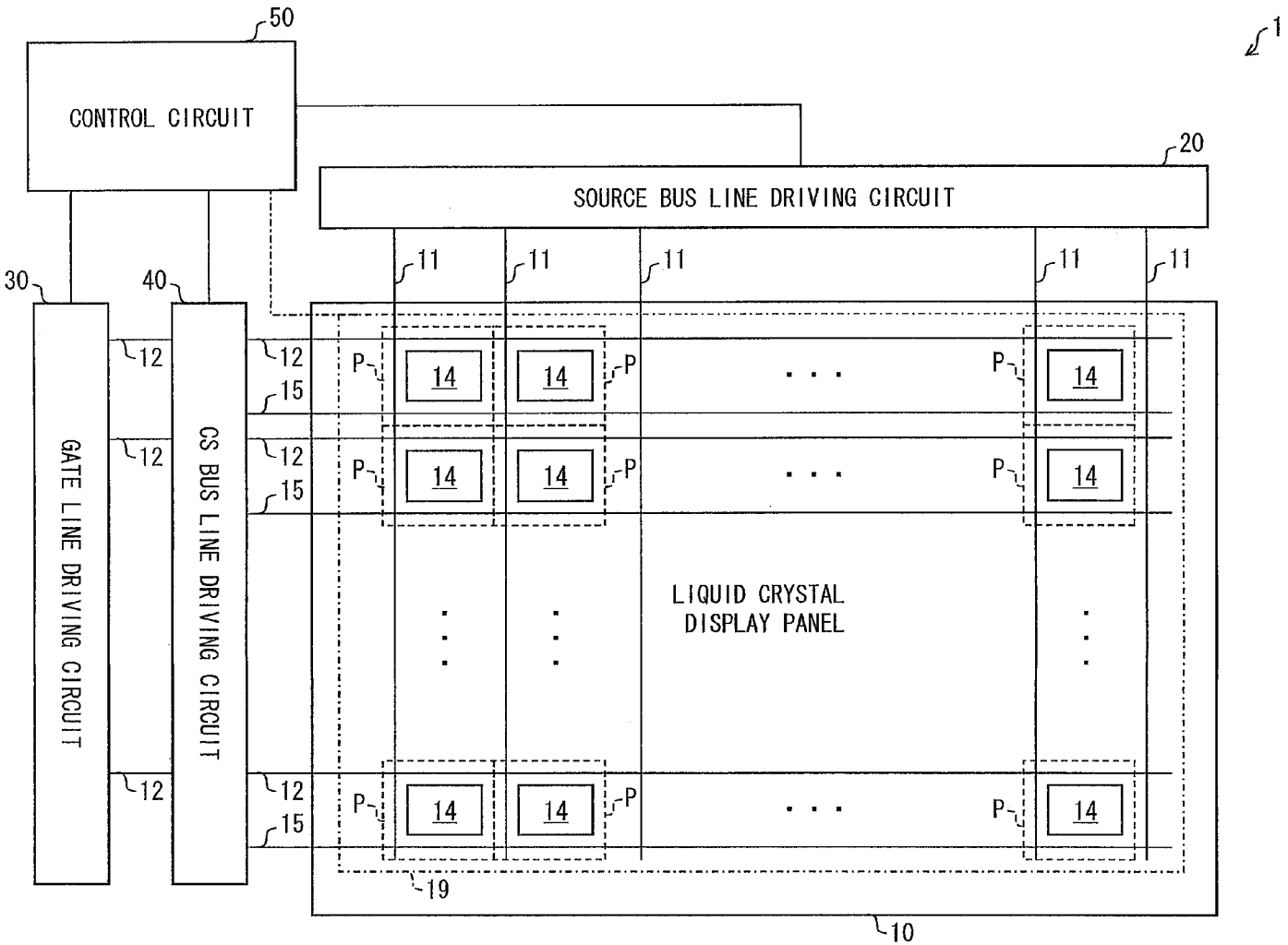
FIG. 1 is a block diagram showing a configuration of a liquid crystal display device according to an embodiment of the present invention.
Figure 2:
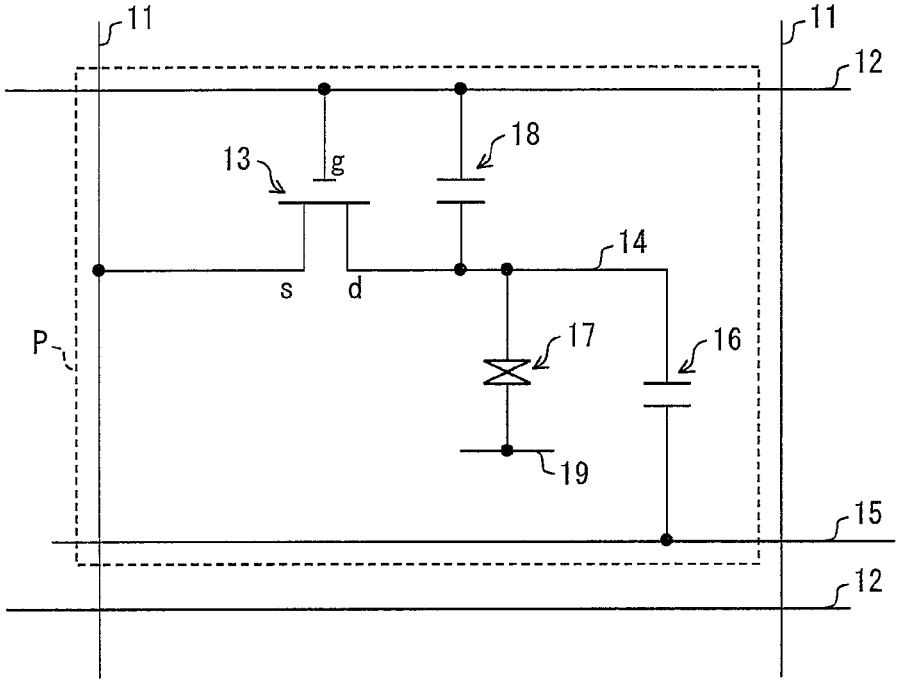
FIG. 2 is an equivalent circuit diagram showing an electrical configuration of each pixel in the liquid crystal display device of FIG. 1.

First, a configuration of a liquid crystal display device 1 corresponding to a display device of the present invention is described with reference to FIGS. 1 and 2. FIG. 1 is a block diagram showing an overall configuration of the liquid crystal display device 1, and FIG. 2 is an equivalent circuit diagram showing an electrical configuration of each pixel of the liquid crystal display device 1.

The liquid crystal display device 1 includes: an active-matrix liquid crystal display panel 10, which corresponds to a display panel of the present invention; a source bus line driving circuit 20, which corresponds to a data signal line driving circuit of the present invention; a gate line driving circuit 30, which corresponds to a scanning signal line driving circuit of the present invention; a CS bus line driving circuit 40, which corresponds to a retention capacitor wire driving circuit of the present invention; and a control circuit 50, which corresponds to a control circuit of the present invention.

The liquid crystal display panel 10, constituted by sandwiching liquid crystals between an active matrix substrate and a counter substrate (not illustrated), has a large number of pixels P arranged in rows and columns.

Moreover, the liquid crystal display panel 10 includes: source bus lines 11, provided on the active matrix substrate, which correspond to data signal lines of the present invention; gate lines 12, provided on the active matrix substrate, which correspond to scanning signal lines of the present invention; thin-film transistors (hereinafter referred to as "TFTs") 13, provided on the active matrix substrate, which correspond to switching element of the present invention; pixel electrodes 14, provided on the active matrix substrate, which correspond to pixel electrodes of the present invention; CS bus lines 15, provided on the active matrix substrate, which correspond to retention capacitor wires of the present invention; and a counter electrode 19 provided on the counter substrate. It should be noted that each of the TFTs 13, omitted from FIG. 1, is shown in FIG. 2 alone.

The source bus lines 11 are arranged one by one in columns in parallel with one another along a column-wise direction (longitudinal direction), and the gate lines 12 are arranged one by one in rows in parallel with one another along a row-wise direction (transverse direction). The TFTs are each provided in correspondence with a point of intersection between a source bus line 11 and a gate line 12, so are the pixel electrodes 14. Each of the TFTs 13 has its source electrode s connected to the source bus line 11, its gate electrode g connected to the gate line 12, and its drain electrode d connected to a pixel electrode 14. Further, each of the pixel electrode 14 forms a liquid crystal capacitor 17 with the counter electrode 19 with liquid crystals sandwiched between the pixel electrode 14 and the counter electrode 19.

With this, when a gate signal (scanning signal) supplied to the gate line 12 causes the gate of the TFT 13 to be on and a source signal (data signal) from the source bus line 11 is written into the pixel electrode 14, the pixel electrode 14 is given a potential corresponding to the source signal. In the result, the potential corresponding to the source signal is applied to the liquid crystals sandwiched between the pixel electrode 14 and the counter electrode 19. This allows realization of a gray-scale display corresponding to the source signal.

The CS bus lines 15 are arranged one by one in rows in parallel with one another along a row-wise direction (transverse direction), in such a way as to be paired with the gate lines 12, respectively. The CS bus lines 15 each form a retention capacitor 16 (referred to also as "auxiliary capacitor") with each one of the pixel electrodes 14 arranged in each row, thereby being capacitively coupled to the pixel electrodes 14.

It should be noted that since, because of its structure, the TFT 13 has a pull-in capacitor 18 formed between the gate electrode g and the drain electrode d, the potential of the pixel electrode 14 is affected (pulled in) by a change in potential of the gate line 12. However, for simplification of explanation, such an effect is not taken into consideration here.

The liquid crystal display panel 10 thus configured is driven by the source bus line driving circuit 20, the gate line driving circuit 30, and the CS bus line driving circuit 40. Further, the control circuit 50 supplies the source bus line driving circuit 20, the gate line driving circuit 30, and the CS bus line driving circuit 40 with various signals that are necessary for driving the liquid crystal display panel 10.

In the present embodiment, during an active period (effective scanning period) in a vertical scanning period that is periodically repeated, each row is allotted a horizontal scanning period in sequence and scanned in sequence. For that purpose, in synchronization with a horizontal scanning period in each row, the gate line driving circuit 30 sequentially outputs a gate signal for turning on the TFTs 13 to the gate line 12 in that row. The gate line driving circuit 30 will be described in detail later.

The source bus line driving circuit 20 outputs a source signal to each source bus line 11. This source signal is obtained by the source bus line driving circuit 20 receiving a video signal from an outside of the liquid crystal display device 1 via the control circuit 50, allotting the video signal to each column, and giving the video signal a boost or the like.

Figure 3:
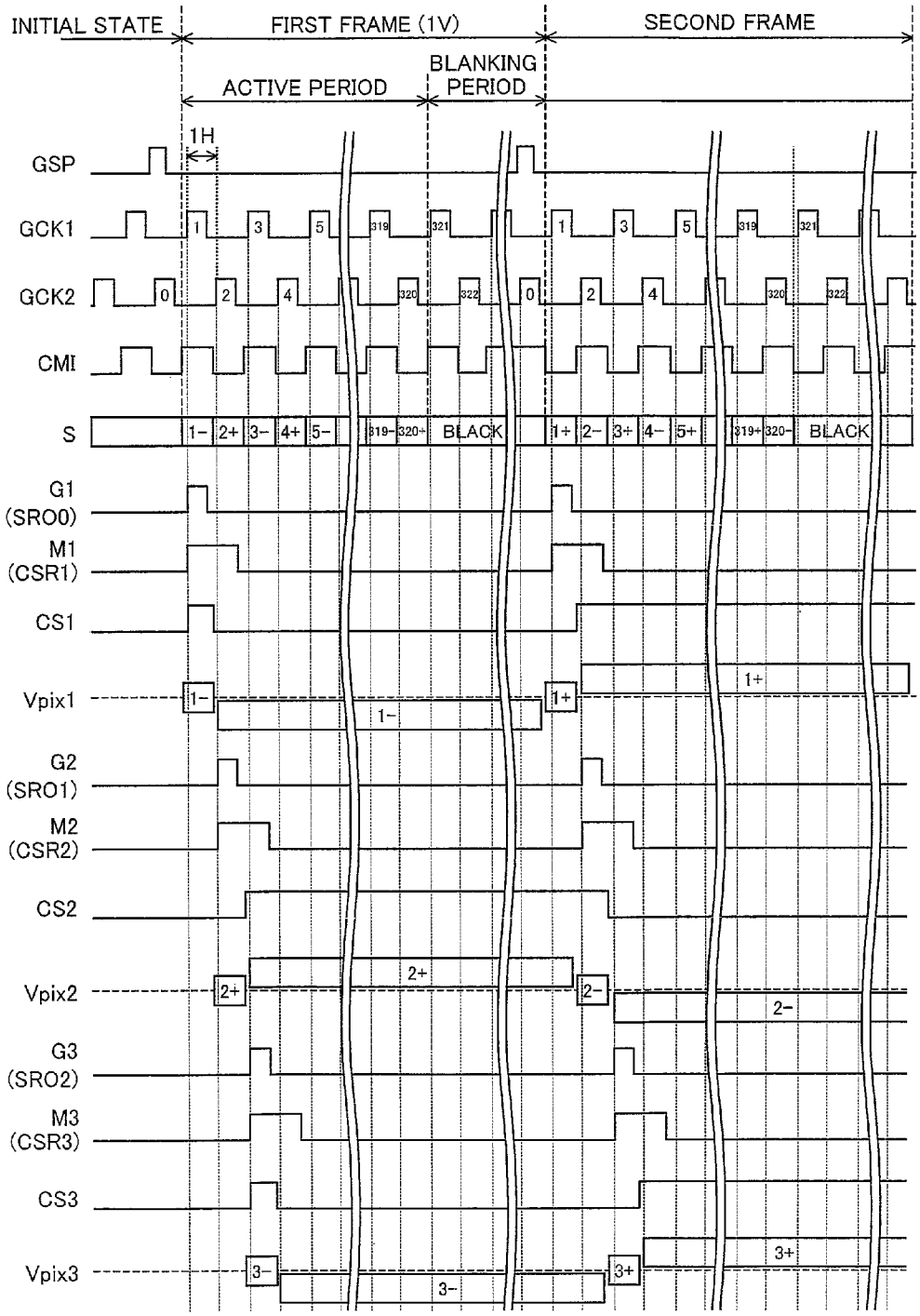
FIG. 3 is a timing chart showing waveforms of various signals of the liquid crystal display device in Embodiment 1.

Further, for example, in order to carry out n-line (nH) inversion driving, the source bus line driving circuit 20 is configured such that the polarity of the source signal it outputs is identical for all pixels in an identical row and reversed every adjacent n rows. For example, as shown in FIG. 3, which shows 1-line (1H) inversion driving, the horizontal scanning period in the first row and the horizontal scanning period in the second row are different in polarity of the source signal S from each other. It should be noted that although the source signal S reverses its polarity every single frame in FIG. 3 (1-frame inversion), this does not imply any limitation. The source signal S may reverse its polarity every m frames (m-frame inversion).

The CS bus line driving circuit 40 outputs a CS signal corresponding to a retention capacitor wire signal of the present invention to each CS bus line 15. This CS signal is a signal whose potential switches (rises or falls) between two values (high and low potentials), and is controlled such that the potential at a point in time where the TFTs 13 in the corresponding row are switched from on to off (i.e., at a point in time where the gate signal falls) varies every n adjacent rows. The CS bus line driving circuit 40 will be described in detail later.

The control circuit 50 controls the gate line driving circuit 30, the source bus line driving circuit 20, and the CS bus line driving circuit 40, thereby causing each of them to output signals as shown in FIG. 3.

In the present embodiment, attention should be paid to the features of the gate line driving circuit 30 and the CS bus line driving circuit 40 among those members which constitute the liquid crystal display device 1. In the following, the gate line driving circuit 30 and the CS bus line driving circuit 40 are described in detail (Embodiments 1 to 3).

Embodiment 1

FIG. 3 is a timing chart showing waveforms of various signals in a liquid crystal display device 1 of Embodiment 1. In Embodiment 1, 1-line (1H) inversion driving is carried out, and the source signal S reverses its polarity every single frame (one frame inversion). In FIG. 3, as in FIG. 22, GSP is a gate start pulse signal that defines a timing of vertical scanning, and GCK1 (CK) and GCK2 (CKB) are gate clock signals that are outputted from the control circuit 50 to define a timing of operation of the shift register. A period from a falling edge to the next falling edge in GSP corresponds to a single vertical scanning period (1V period). A period from a rising edge in GCK1 to a rising edge in GCK2 and a period from a rising edge GCK2 to a rising edge in GCK1 each correspond to a single horizontal scanning period (1H period). CMI (retention target signal) is a polarity signal that reverses its polarity every single horizontal scanning period.

Further, FIG. 3 shows the following signals: a source signal S (video signal), which is supplied from the source bus line driving circuit 20 to a source bus line 11 (source bus line 11 provided in the xth column); a gate signal G1, which is supplied from the gate line driving circuit 30 to a gate line 12 provided in the first row; a CS signal CS1 (CSOUT1), which is supplied from the CS bus line driving circuit 40 to a CS bus line 15 provided in the first row; and a potential waveform Vpix1 of a pixel electrode 14 provided in the first row and the xth column. Further, FIG. 3 shows the following signals: a gate signal G2, which is supplied to a gate line 12 provided in the second row; a CS signal CS2 (CSOUT2), which is supplied to a CS bus line 15 provided in the second row; and a potential waveform Vpix2 of a pixel electrode 14 provided in the second row and the xth column. Furthermore, FIG. 3 shows the following signals: a gate signal G3, which is supplied to a gate line 12 provided in the third row; a CS signal CS3 (CSOUT3), which is supplied to a CS bus line 15 provided in the third row; and a potential waveform Vpix3 of a pixel electrode 14 provided in the third row and the xth column. As will described later (with reference to FIG. 4), the signals M1 (CSR1), M2 (CSR2), and M3 (CSR3), generated by the shift register circuits SR1 to SR3 in the first to third rows, are signals that are inputted to the logic circuits (latch circuits, retaining circuits) CSL1 to CSL3 in the first to third rows, respectively.

It should be noted that the dotted lines in the potentials Vpix1, Vpix2, and Vpix3 indicate the potential of the counter electrode 19.

In the following, it is assumed that the start frame of a display picture is a first frame and that the first frame is preceded by an initial state. In Embodiment 1, as shown in FIG. 3, during an initial state, the CS signals CS1, CS2, and CS3 are all fixed at one potential (in FIG. 3, at a low level). In the first frame, the CS signal CS1 in the first row and the CS signal CS3 in the third row switch from a low level to a high level in synchronization with rising edges in their corresponding gate signals G1 and G3, respectively, and are at a high level at points in time where the gate signals G1 and G3 fall. Therefore, the potential of a CS signal in each row at a point in time where its corresponding gate signal falls is different from the potential of a CS signal in an adjacent row at a point in time where its corresponding gate signal falls. For example, the CS signal CS1 is at a high level at a point in time where its corresponding gate signal G1 falls, and the CS signal CS2 is at a low level at a point in time where its corresponding gate signal G2 falls, and the CS signal CS3 is at a high level at a point in time where its corresponding gate signal G3 falls.

It should be noted that the source signal S is a signal which has amplitude corresponding to a gray scale represented by a video signal and which reverses its polarity every 1H period. Further, since it is assumed in FIG. 3 that a uniform picture is displayed, the amplitude of the source signal S is constant. Meanwhile, the gate signals G1, G2, and G3 serve as gate-on potentials during the first, second, and third 1H periods, respectively, in an active period (effective scanning period) of each frame, and serve as gate-off potentials during the other periods.

Then, the CS signals CS1, CS2, and CS3 are reversed after their corresponding gate signals G1, G2, and G3 fall, and take such waveforms that adjacent rows are opposite in direction of reversal to each other. Specifically, in an odd-numbered frame (first frame, third frame, . . . ), the CS signals CS1 and CS3 fall after their corresponding gate signals G1 and G3 fall, and the CS signal CS2 rises after its corresponding gate signal G2 falls. Further, in an even-numbered frame (second frame, fourth frame, . . . ), the CS signals CS1 and CS3 rise after their corresponding gate signals G1 and G3 fall, and the CS signal CS2 falls after its corresponding gate signal G2 falls.

It should be noted that the relationship between rising and falling edges in the CS signals CS1, CS2, and CS3 in the odd-numbered and even-numbered frames may be opposite of the relationship stated above.

Since, in FIG. 3, adjacent rows are different from each other in terms of the potentials of the CS signals at points in time where the gate signals fall in the first frame, the CS signals CS1, CS2, and CS3 in the first frame takes the same waveforms as in a normal odd-numbered frame (e.g., the third frame). Therefore, since the potentials Vpix1, Vpix2, and Vpix3 of the pixel electrodes 14 are all properly shifted by the CS signals CS1, CS2, and CS3, respectively, inputting of source signals S of the same gray scale causes the positive and negative potential differences between the potential of the counter electrode and the shifted potential of each of the pixel electrodes 14 to be equal to each other. That is, in the first frame, in which a source signal of a negative polarity is written into the odd-numbered pixels in the same column of pixels and a source signal of a positive polarity is written into the even-numbered pixels in the same column of pixels, the potentials of the CS signals corresponding to the odd-numbered pixels are not polarity-reversed during the writing into the odd-numbered pixels, are polarity-reversed in a negative direction after the writing, and are not polarity-reversed until the next writing, and the potentials of the CS signals corresponding to the even-numbered pixels are not polarity-reversed during the writing into the even-numbered pixels, are polarity-reversed in a positive direction after the writing, and are not polarity-reversed until the next writing. This results in elimination of appearance of transverse stripes in the first frame, thus allowing an improvement in display quality.

Figure 4:
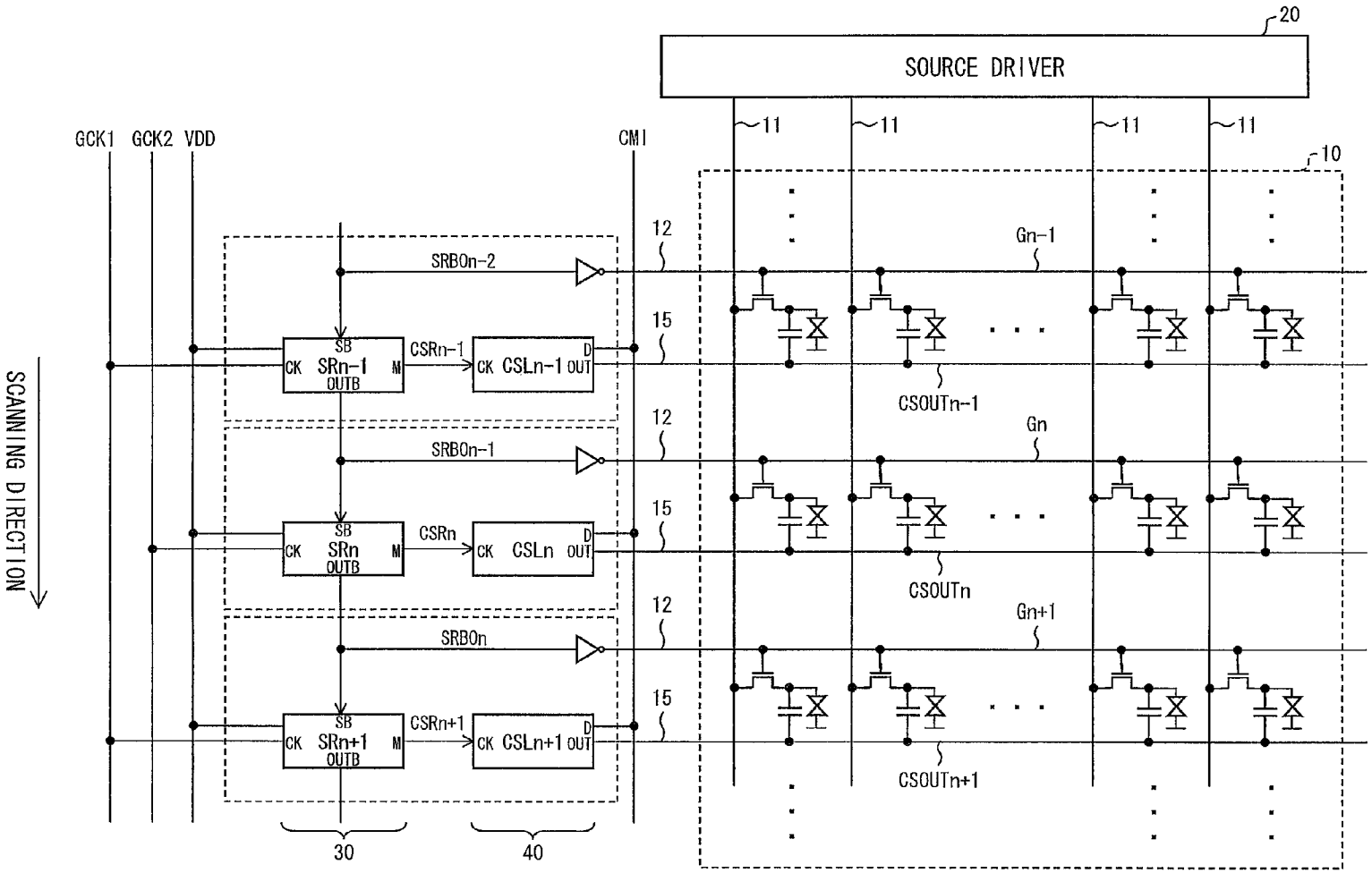
FIG. 4 is a block diagram showing a configuration of a gate line driving circuit and a CS bus line driving circuit in Embodiment 1.

A specific configuration of the gate line driving circuit 30 and the CS bus line driving circuit 40 for achieving the aforementioned control is described here. FIG. 4 shows a configuration of the gate line driving circuit 30 and the CS bus line driving circuit 40. In the following, for convenience of explanation, the row (line) (next row) following the nth row in a scanning direction (indicated by an arrow in FIG. 4) is represented as the (n+1)th row, and the row (previous row) immediately preceding the nth row in the scanning direction is represented as the (n−1)th row.

As shown in FIG. 4, the gate line driving circuit 30 has a plurality of shift register circuits SR (stages of a shift register) corresponding to their respective rows, and the CS bus line driving circuit 40 has a plurality of latch circuits (retaining circuits) CSL corresponding to their respective rows. For convenience of explanation, the shift register circuits SRn−1, SRn, and SRn+1 and the latch circuits CSLn−1, CSLn, and CSLn+1, which correspond to the (n−1)th, nth, and (n+1)th rows respectively, are taken as an example here.

The shift register circuit SRn−1 in the (n−1)th row receives the gate clock signal GCK1 via its clock terminal CK from the control circuit 50 (see FIG. 1), and receives a shift register output SRBOn−2 from the previous row (the (n−2)th row) via its set terminal SB as a set signal for the shift register circuit SRn−1. The shift register circuit SRn−1 has its output terminal OUTB connected to the set terminal SB of the shift register circuit SRn of the next row (the nth row). This allows the shift register circuit SRn−1 to output a shift register output SRBOn−1 via its output terminal OUTB to the shift register circuit SRn. The shift register circuit SRn−1 has its output terminal M, connected to the clock terminal CK of the latch circuit CSLn−1 of the current row (the (n−1)th row), via which a signal M generated inside of the shift register circuit SRn−1 is outputted. This allows the shift register circuit SRn−1 to input its internal signal Mn−1 (signal CSRn−1) (control signal) to the latch circuit CSLn−1.

Further, the shift register output SRBOn−2 from the previous row (the (n−2)th row) is both inputted to the shift register circuit SRn−1 and outputted as a gate signal Gn−1 (SROn−2: inversion signal of SRBOn−2) to the gate line 12 of the current row (the (n−1)th row) via a buffer. Further, the shift register circuit SRn−1 is supplied with a power supply (VDD).

The latch circuit CSLn−1 in the (n−1)th row, constituted as a D latch circuit, receives the polarity signal CMI from the control circuit 50 (see FIG. 1) and the internal signal Mn−1 (signal CSRn−1) from the shift register circuit SRn−1. The latch circuit CSLn−1 has its output terminal OUT connected to the CS bus line 15 of the current row (the (n−1)th row). This allows the latch circuit CSLn−1 to output a CS signal CSOUTn−1 via its output terminal OUT to the CS bus line 15 of the current row (the (n−1)th row).

The shift register circuit SRn in the nth receives the gate clock signal GCK2 row via its clock terminal CK from the control circuit 50 (see FIG. 1), and receives a shift register output SRBOn−1 from the previous row (the (n−1)th row) via its set terminal SB as a set signal for the shift register circuit SRn. The shift register circuit SRn has its output terminal OUTB connected to the set terminal SB of the shift register circuit SRn+1 of the next row (the (n+1)th row). This allows the shift register circuit SRn to output a shift register output SRBOn via its output terminal OUTB to the shift register circuit SRn+1. The shift register circuit SRn has its output terminal M connected to the clock terminal CK of the latch circuit CSLn of the current row (the nth row). This allows the shift register circuit SRn to input its internal signal Mn (signal CSRn) to the latch circuit CSLn.

Further, the shift register output SRBOn−1 from the previous row (the (n−1)th row) is both inputted to the shift register circuit SRn and outputted as a gate signal Gn (SROn−1: inversion signal of SRBOn−1) to the gate line 12 of the current row (the nth row) via a buffer. Further, the shift register circuit SRn is supplied with the power supply (VDD).

The latch circuit CSLn in the nth row, constituted as a D latch circuit, receives the polarity signal CMI from the control circuit 50 (see FIG. 1) and the internal signal Mn (signal CSRn) generated inside of the shift register circuit SRn. The latch circuit CSLn has its output terminal OUT connected to the CS bus line 15 of the current row (the nth row). This allows the latch circuit CSLn to output a CS signal CSOUTn via its output terminal OUT to the CS bus line 15 of the current row.

The shift register circuit SRn+1 in the (n+1)th row receives the gate clock signal GCK1 via its clock terminal CK from the control circuit 50 (see FIG. 1), and receives a shift register output SRBOn from the previous row (the nth row) via its set terminal SB as a set signal for the shift register circuit SRn+1. The shift register circuit SRn+1 has its output terminal OUTB connected to the set terminal SB of the shift register circuit SRn+2 of the next row (the (n+2)th row). This allows the shift register circuit SRn+1 to output a shift register output SRBOn+1 via its output terminal OUTB to the shift register circuit SRn+2. The shift register circuit SRn+1 has its output terminal M connected to the clock terminal CK of the latch circuit CSLn+1 of the current row (the (n+1)th row). This allows the shift register circuit SRn+1 to input its internal signal Mn+1 (signal CSRn+1) to the latch circuit CSLn+1.

Further, the shift register output SRBOn from the previous row (the nth row) is both inputted to the shift register circuit SRn+1 and outputted as a gate signal Gn+1 (SROn: inversion signal of SRBOn) to the gate line 12 of the current row (the (n+1)th row) via a buffer. Further, the shift register circuit SRn+1 is supplied with the power supply (VDD).

The latch circuit CSLn+1 in the (n+1)th row, constituted as a D latch circuit, receives the polarity signal CMI from the control circuit 50 (see FIG. 1) and the internal signal Mn+1 (signal CSRn+1) generated inside of the shift register circuit SRn+1. The latch circuit CSLn+1 has its output terminal OUT connected to the CS bus line 15 of the current row (the (n+1)th row). This allows the latch circuit CSLn+1 to output a CS signal CSOUTn+1 via its output terminal OUT to the CS bus line 15 of the current row.

Figure 5:
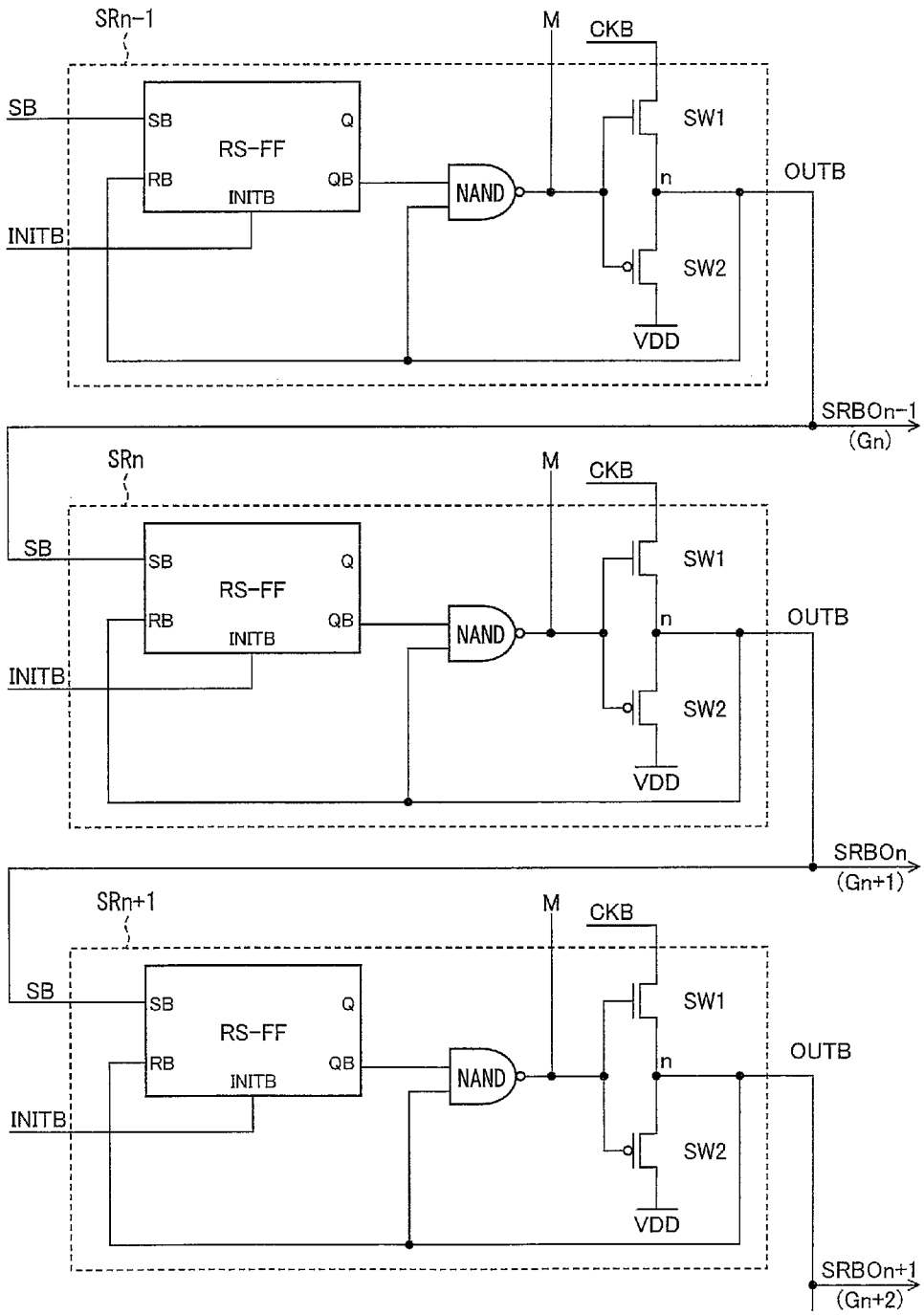
FIG. 5 shows a configuration of a shift register circuit in Embodiment 1.

The following explains operation of each shift register circuit SR. FIG. 5 shows the shift register circuits SRn−1, SRn, and SR+1 in the (n−1)th, nth, and (n+1)th rows in detail. It should be noted that the shift register circuit SR in each row is identical in configuration to the shift register circuits SRn−1, SRn, and SR+1. The following explanation is centered on the shift register circuit SRn in the nth row.

As shown in FIG. 5, the shift register circuit SRn includes an RS type flip-flop circuit RS-FF, a NAND circuit, and analog switching circuits SW1 and SW2. The flip-flop circuit RS-FF receives the shift register output SRBOn−1 (OUTB) via its set terminal SB from the previous row (the (n−1)th row) as a set signal as described above. The NAND circuit has its first input terminal connected to an output terminal QB of the flip-flop circuit RS-FF and its second input terminal connected to the output terminal OUTB of the shift register circuit SRn. The NAND circuit has its output terminal M connected to control electrodes of the analog switching circuits SW1 and SW2 and connected to the clock terminal CK (see FIG. 4) of the latch circuit CSLn of the current row (the nth row). The analog switching circuits SW1 and SW2 receive, from the NAND circuit, an internal signal Mn (which corresponds to a signal CSRn) that controls each of the analog switching circuits SW1 and SW2 so that it switches between ON and OFF. The analog switching circuit SW1 has a first conductive electrode to which the gate clock signal CKB (GCK2) is inputted and a second conductive electrode connected to a first conductive electrode of the analog switching circuit SW2, and the analog switching circuit SW2 has a second conductive electrode that is supplied with the power supply (VDD). The analog switching circuits SW1 and SW2 are connected to each other at a connection point n connected to the output terminal OUTB of the shift register circuit SRn, the first input terminal of the NAND circuit, and the reset terminal RB of the flip-flop circuit RS-FF of the current row (the nth row). The shift register circuit SRn has it output terminal OUTB connected to the set terminal SB of the next row (the (n+1)th row). This allows the shift register output SRBOn (OUTB) of the current row (the nth row) to be inputted as a set signal for the shift register circuit SRn+1 of the next row (the (n+1)th row).

In the foregoing configuration, the output OUTB of the shift register circuit SRn is inputted as a reset signal to the reset terminal RB of the flip-flop circuit RS-FF; therefore, the shift register circuit SRn functions as a self-resetting flip-flop. A specific operation of the shift register circuit SRn is described below.

Figure 6:
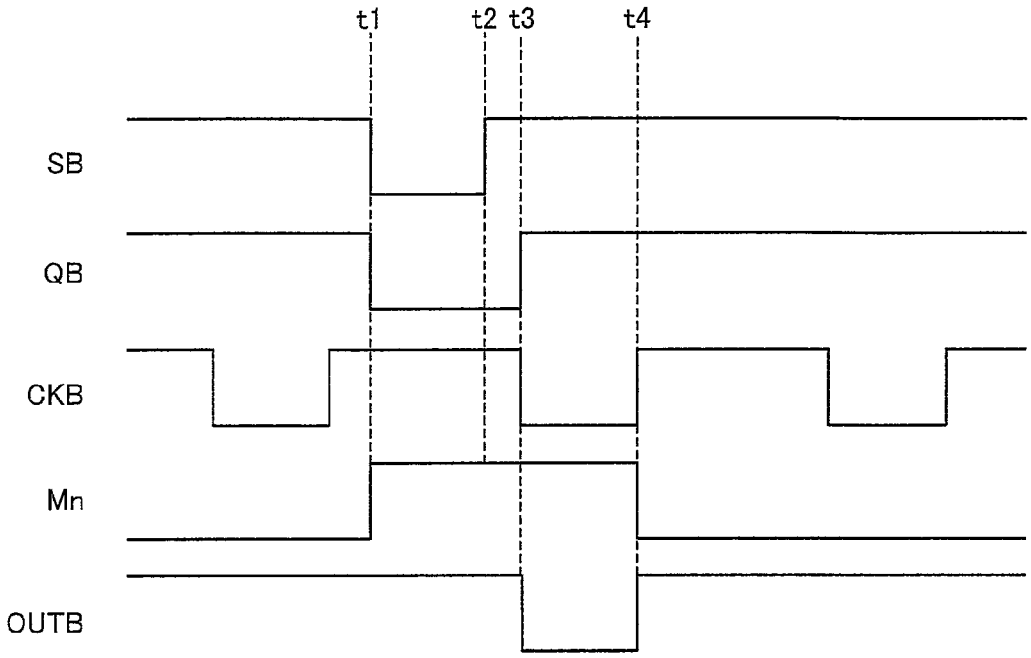
FIG. 6 is a timing chart showing waveforms of various signals that are inputted to and outputted from the shift register circuit shown in FIG. 5.

FIG. 6 is a timing chart showing waveforms of various signals that are inputted to and outputted from the shift register circuit SRn.

First, when the set signal SB (SRBOn−1) inputted to the shift register circuit SRn changes from a high level to a low level (becomes active), the output QB of the flip-flop circuit RS-FF changes from a high level to a low level, and the internal signal Mn, which is an output from the NAND circuit, changes from a low level to a high level (t1). When the internal signal Mn has been raised to a high level, the analog switching circuit SW1 is turned on, whereby the clock signal CKB is outputted to OUTB. This raises the output signal OUTB to a high level. During a period of time in which the output QB at a low level and the output OUTB at a high level are being inputted to the NAND circuit (t1 to t2), the NAND circuit outputs the internal signal Mn at a high level, whereby the output signal OUTB is raised to a high level. When the set signal SB has been raised to a high level (t2), the clock signal CKB is still at a high level at this point in time. Therefore, the flip-flop circuit RS-FF is not reset, whereby the output QB is maintained at a low level and the internal signal Mn and the output signal OUTB are maintained at a high level (t2 to t3).

Then, when the clock signal CKB has been dropped to a low level (t3), the output signal OUTB is dropped to a low level, and the flip-flop circuit RS-FF is reset, whereby the output signal QB changes from a low level to a high level. Since the output signal QB at a high level and the output signal OUTB at a low level are inputted to the NAND circuit, the internal signal Mn is maintained at a high level and the output signal OUTB is maintained at a low level (t3 to t4). When the clock signal CKB changes from a low level to a high level (t4), the output signal OUTB is raised to a high level, and the output signal QB at a high level and the output signal OUTB at a high level are inputted to the NAND circuit, so that the internal signal Mn changes from a high level to a low level.

The output OUTB thus generated allows the shift register circuit SRn+1 in the next row (the (n+1) row) to start an operation and the shift register circuit SRn in the current row (the nth row) to carry out a reset operation.

It should be noted here that the internal signal Mn, which is generated inside of the shift register circuit SRn, becomes active in a period of time from a point in time where the set signal SB has become active to a point in time where the reset signal RB (CKB) becomes active. Moreover, the internal signal Mn is inputted to the clock terminal CK of the latch circuit CSLn in the current row (nth row) (signal CSRn of FIG. 4).

Figure 7:
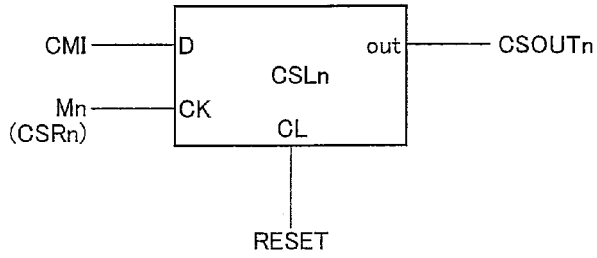
FIG. 7 shows a configuration of a logic circuit (D latch circuit) in Embodiment 1.

The following explains operation of each latch circuit CSL. FIG. 7 shows the latch circuit CSLn in the nth row in detail. It should be noted that the latch circuit CSL in each row is identical in configuration to the latch circuit CSLn. The following explanation refers to the latch circuit CSL in each row as the D latch circuit CSLn.

The D latch circuit CSLn receives the internal signal Mn (signal CSRn) via its clock terminal CK from the shift register circuit SRn as described above. The D latch circuit CSLn receives the polarity signal CMI via its input terminal D from the control circuit 50 (see FIG. 1). This allows the D latch circuit CSLn to output an input state of the polarity signal CMI as a CS signal CSOUTn in accordance with a change in potential level of the internal signal Mn (from a low level to a high level or from a high level to a low level), and the CS signal CSOUTn indicates the change in potential level. Specifically, when the potential level of the internal signal Mn that the D latch circuit CSLn receives via its clock terminal CK is a high level, the D latch circuit CSLn outputs an input state (low level or high level) of the polarity signal CMI that it receives via its input terminal D. When the potential level of the internal signal Mn that the D latch circuit CSLn receives via its clock terminal CK has changed from a high level to a low level, the D latch circuit CSLn latches the input state (low level or high level) of the polarity signal CMI that it received via its input terminal D at the time of change, and keeps the latched state until the next time when the potential level of the internal signal Mn that the D latch circuit CSLn receives via its clock terminal CK is raised to a high level. Then, the D latch circuit CSLn outputs the latched state as the CS signal CSOUTn, which indicates the change in potential level, via its output terminal out.

Figure 8:
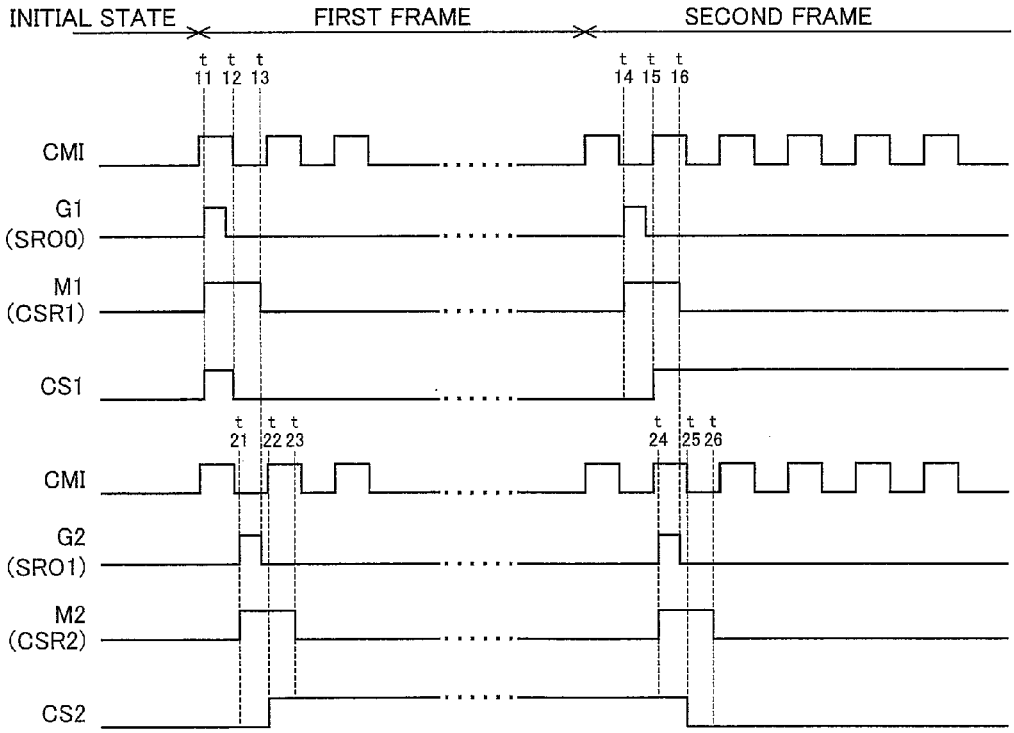
FIG. 8 is a timing chart showing waveforms of various signals that are inputted to and outputted from the D latch circuit shown in FIG. 7.

FIG. 8 is a timing chart showing waveforms of various signals that are inputted to and outputted from the D latch circuit CSLn. FIG. 8 shows, as an example, a timing chart in the D latch circuit CSL1 in the first row and the D latch circuit CSL2 in the second row.

First, changes in waveform of various signals in the first row are described.

In the initial state, the D latch circuit CSL1 receives a reset signal RESET via its terminal CL (see FIG. 7). By this reset signal RESET, the potential of the CS signal CS1 that the D latch circuit CSL1 outputs via its output terminal OUT is retained at a low level.

When, in the first frame, the gate line driving circuit 30 supplies a gate signal G1 (which corresponds to an output SRO0 from the shift register circuit SR0) to the gate line 12 in the first row, the D latch circuit CSL1 receives via its clock terminal CK an internal signal M1 (signal CSR1) generated by the shift register circuit SR1. Upon receiving a change in potential of the internal signal M1 (from low to high; t11), the D latch circuit CSL1 transfers an input state of the polarity signal CMI that it received via its input terminal D at the point in time, i.e., transfers a high level, and outputs the change in potential of the polarity signal CMI until the next time when there is a change in potential of the internal signal M1 (from high to low; t13) that the D latch circuit CSL1 receives via its clock terminal CK (i.e., during a period of time in which the internal signal M1 is at a high level; t11 to t13). When the polarity signal CMI changes from a high level to a low level during the period of time in which the internal signal M1 is at a high level (t12), the D latch circuit CSL1 switches its output CS1 from a high level to a low level. Next, upon receiving a change in potential of the internal signal M1 (from high to low; t13) via its clock terminal CK, the D latch circuit CSL1 latches an input state of the polarity signal CMI that it received at the point in time, i.e., latches a low level. After that, the D latch circuit CSL1 retains its output CS1 at a low level until there is a change in potential of the internal signal M1 in the second frame (from low to high; t14).

When, in the second frame, the gate line driving circuit 30 similarly supplies a gate signal G1 to the gate line 12 in the first row, the D latch circuit CSL1 receives via its clock terminal CK an internal signal M1 (signal CSR1) generated by the shift register circuit SR1. When the internal signal M1 changes from a low level to a high level (t14), the D latch circuit CSL1 transfers an input state of the polarity signal CMI that it received via its input terminal D at the point in time, i.e., transfers a low level. The D latch circuit CSL1 outputs the change in potential of the polarity signal CMI during a period of time in which the internal signal M1 is at a high level (t14 to t16). Therefore, when the polarity signal CMI changes from a low level to a high level (t15), the D latch circuit CSL1 switches its output CS1 from a low level to a high level. Next, upon receiving a change in potential of the internal signal M1 (from high to low; t16) via its clock terminal CK, the D latch circuit CSL1 latches an input state of the polarity signal CMI that it received at the point in time, i.e., latches a high level. After that, the D latch circuit CSL1 retains its output CS1 at a high level until there is a change in potential of the internal signal M1 in the third frame.

The CS signal CS1 thus generated is supplied to the CS bus line 15 of the first row. It should be noted that the output in the third frame takes a waveform obtained by reversing the potential level of the output waveform in the second frame, and in the fourth frame and later, signals identical in output waveform to those in the second and third frames are alternately outputted.

Next, changes in waveform of various signals in the second row are described.

In the initial state, the D latch circuit CSL2 receives the reset signal RESET via its terminal CL (see FIG. 7). By this reset signal RESET, the potential of the CS signal CS2 that the latch circuit CSL2 outputs via its output terminal OUT is retained at a low level.

When, in the first frame, the gate line driving circuit 30 supplies a gate signal G2 (which corresponds to an output SRO1 from the shift register circuit SR1) to the gate line 12 in the second row, the D latch circuit CSL2 receives via its clock terminal CK an internal signal M2 (signal CSR2) generated by the shift register circuit SR2. Upon receiving a change in potential of the internal signal M2 (from low to high; t21), the D latch circuit CSL2 transfers an input state of the polarity signal CMI that it received via its input terminal D at the point in time, i.e., transfers a low level, and outputs the change in potential of the polarity signal CMI until the next time when there is a change in potential of the internal signal M2 (from high to low; t23) that the D latch circuit CSL2 receives via its clock terminal CK (i.e., during a period of time in which the internal signal M2 is at a high level; t21 to t23). When the polarity signal CMI changes from a low level to a high level during the period of time in which the internal signal M2 is at a high level (t22), the D latch circuit CSL2 switches its output CS2 from a low level to a high level. Next, upon receiving a change in potential of the internal signal M2 (from high to low; t23) via its clock terminal CK, the D latch circuit CSL2 latches an input state of the polarity signal CMI that it received at the point in time, i.e., latches a high level. After that, the D latch circuit CSL2 retains its output CS2 at a high level until there is a change in potential of the internal signal M2 in the second frame (from low to high; t24).

When, in the second frame, the gate line driving circuit 30 similarly supplies a gate signal G2 to the gate line 12 in the second row, the D latch circuit CSL2 receives via its clock terminal CK an internal signal M2 (signal CSR2) generated by the shift register circuit SR2. When the internal signal M2 changes from a low level to a high level (t24), the D latch circuit CSL2 transfers an input state of the polarity signal CMI that it received via its input terminal D at the point in time, i.e., transfers a high level. The D latch circuit CSL2 outputs the change in potential of the polarity signal CMI during a period of time in which the internal signal M2 is at a high level (t24 to t26). Therefore, when the polarity signal CMI changes from a high level to a low level (t25), the D latch circuit CSL2 switches its output CS2 from a high level to a low level. Next, upon receiving a change in potential of the internal signal M2 (from high to low; t26) via its clock terminal CK, the D latch circuit CSL2 latches an input state of the polarity signal CMI that it received at the point in time, i.e., latches a low level. After that, the D latch circuit CSL2 retains its output CS2 at a low level until there is a change in potential of the internal signal M2 in the third frame.

The CS signal CS2 thus generated is supplied to the CS bus line 15 of the second row. It should be noted that in the third frame and later, signals identical in output waveform to those in the first and second frames are alternately outputted.

Moreover, the operations in the first and second rows correspond to operations of the D latch circuits in each odd-numbered row and each even-numbered row.

Thus, the D latch circuits CSL1, CSL2, CSL3, . . . , which correspond to their respective rows, output CS signals so that in all the frames that include the first frame, the potentials of the CS signals at points in time where the gate signals in their corresponding rows fall (at points in time where the TFTs 13 are switched from on to off) differ from one row to an adjacent row. This makes it possible to properly operate the CS bus line driving circuit 40 also in the first frame. This allows elimination of such irregular waveforms that cause transverse stripes in the first frame, thus bringing about an effect of improving the quality of a display by preventing the appearance of transverse stripes in the first frame.

Further, the effect is brought about without causing an increase in circuit area as compared with a conventional liquid crystal display device. FIG. 23 is a block diagram showing an example of a configuration of a gate line driving circuit and a CS bus line driving circuit in the conventional liquid crystal display device for achieving the driving of FIG. 22. As shown in FIG. 23, the latch circuit in the nth row (D latch circuit CSLn) receives an output SRBOn+1 from the shift register circuit SRn+1 in the next row (the (n+1)th row). This causes the CS signal CSn in the nth row to change in potential in synchronization with a rising edge in the gate signal Gn+1 in the (n+1)th row (see FIG. 22). In this configuration, it is necessary to load the shift register output SRBOn+1 from the next row (the (n+1)th row) into the latch circuit CSLn in the current row (the nth row). This causes an increase in circuit area due to wiring and the like.

Figure 24:
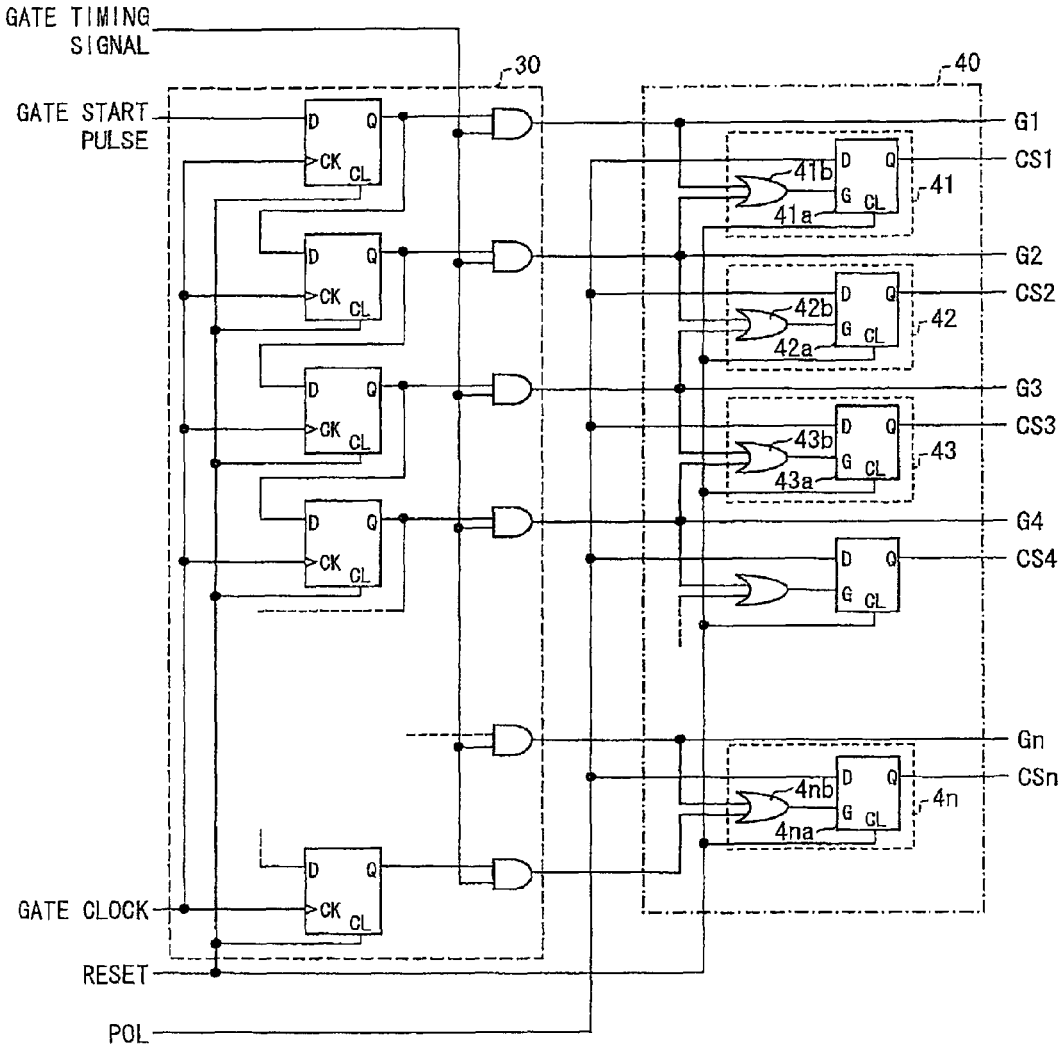
FIG. 24 is a block diagram showing a configuration of conventional driving circuits (a gate line driving circuit and a CS bus line driving circuit).
Figure 25:
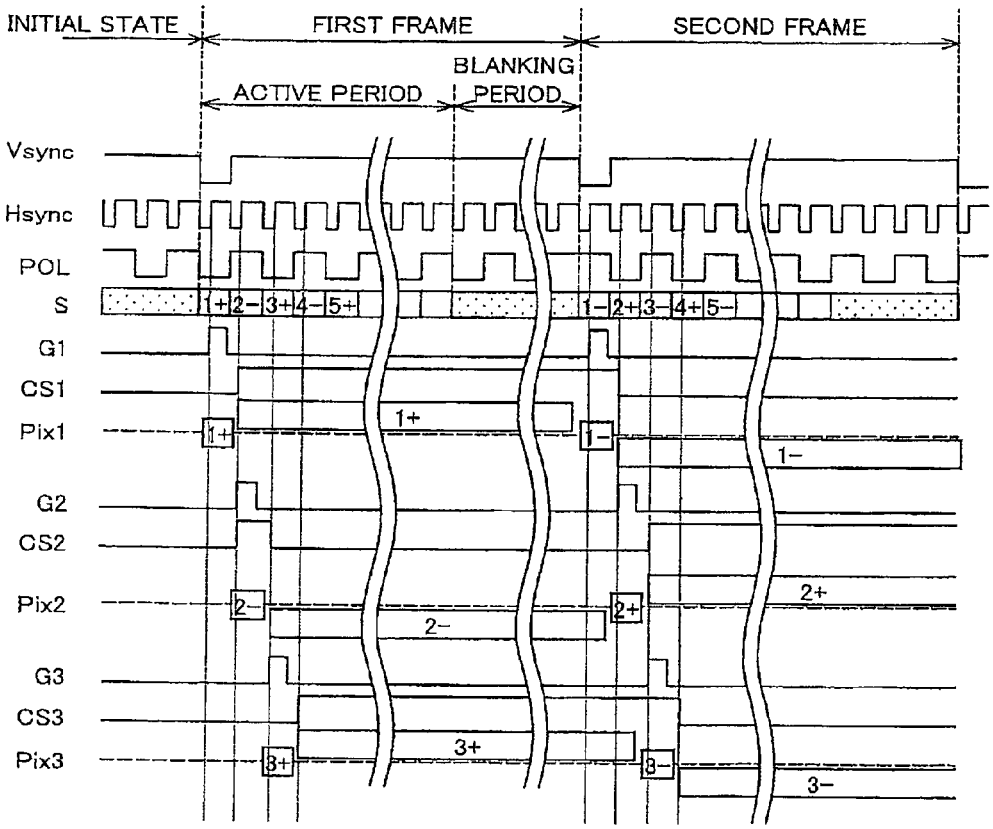
FIG. 25 is a timing chart showing waveforms of various signals of a liquid crystal display device including the driving circuits of FIG. 24.
Figure 26:
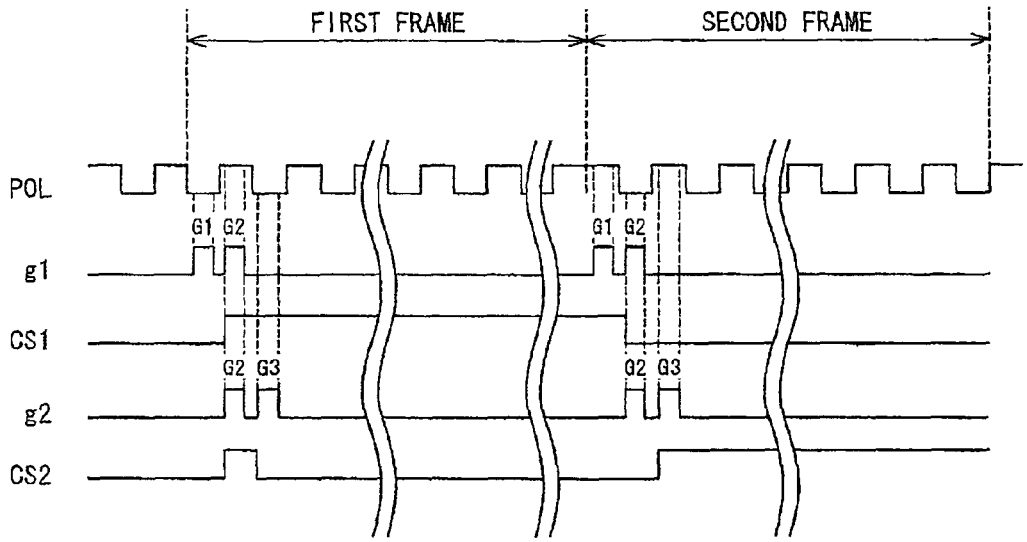
FIG. 26 is a timing chart showing waveforms of various signals that are inputted to and outputted from the CS bus line driving circuit shown in FIG. 24.

Further, as shown in FIG. 24, the conventional display driving circuit capable of eliminating the appearance of such transverse stripes requires wires through which the gate signal g2 from the current row (the nth row) and the gate signal g3 from the next row (the (n+1)th row) are loaded and a circuit (OR circuit) that takes the logic of the gate signals g2 and g3, thus causing an increase in circuit area.

In this respect, the configuration of Embodiment 1 causes a signal (internal signal M) generated inside of the shift register circuit SRn to be inputted directly to the latch circuit CSLn of the same row (the nth row), whereby a proper CS signal CSn is generated which allows eliminating the appearance of such transverse stripes. Therefore, as compared with the conventional display driving circuit (gate driver, CS driver), it is possible to dispense with a wire extending from the shift register in the next row, nor is it necessary to provide a separate element for generating a proper CS signal CSn. This allows the display driving circuit capable of eliminating the appearance of such transverse stripes to be smaller in circuit area than the conventional configuration, thus allowing achieving a small-sized liquid crystal display device with high display quality and a liquid crystal display panel with a narrow frame.

Figure 27:
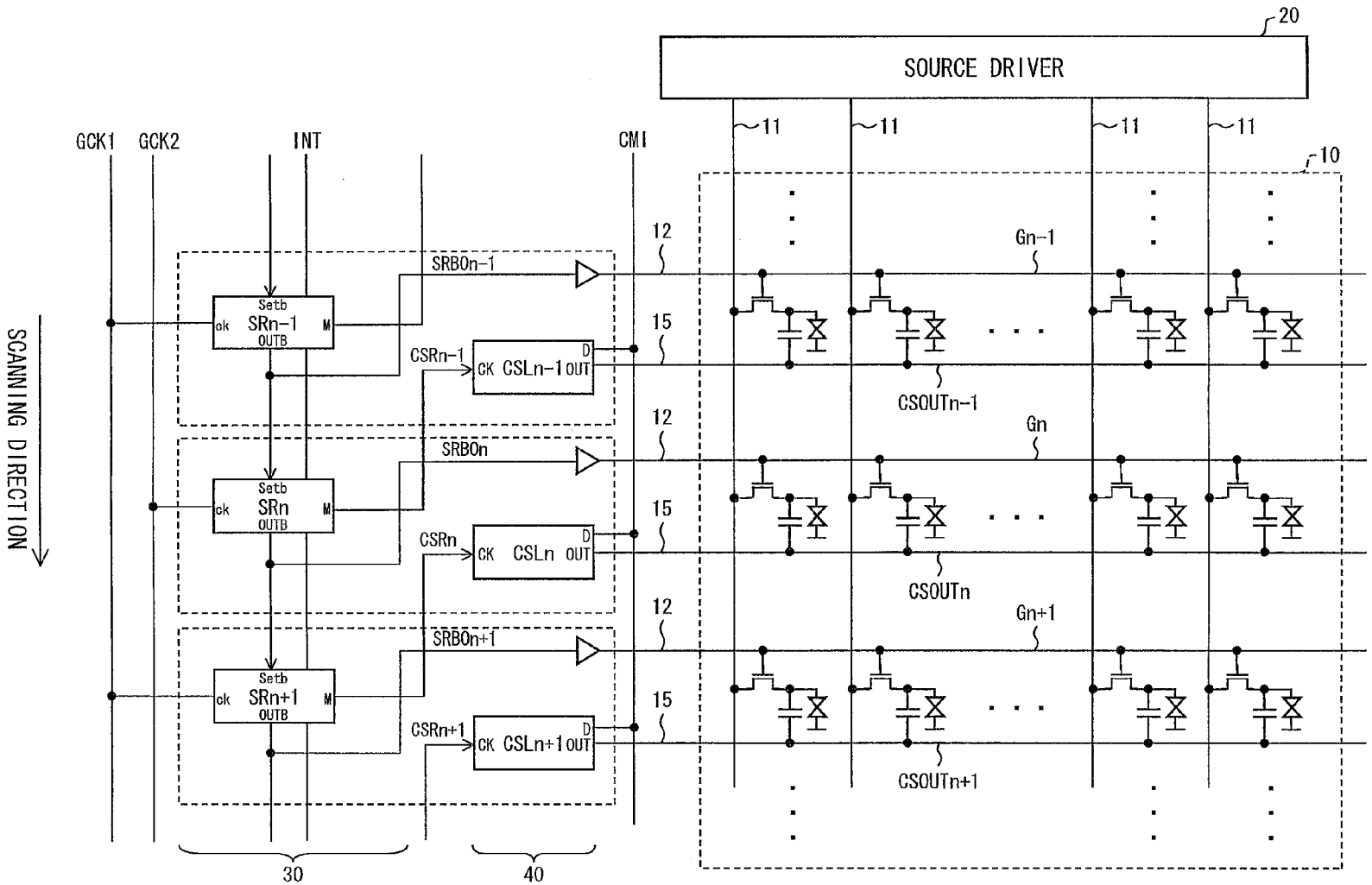
FIG. 27 is a block diagram showing another configuration of a gate line driving circuit and a CS bus line driving circuit in Embodiment 1.

In FIG. 4, the output SRBOn−1 from the shift register circuit SRn−1 in the (n−1)th row corresponds to the gate signal Gn of the nth row and is supplied to the gate line of the nth line, and the internal signal Mn (CSRn) from the shift register circuit SRn in the nth row is inputted to the latch circuit CSLn of the nth row, and the CS signal CSOUTn is supplied to the CS bus line of the nth row. However, a configuration shown in FIG. 27 is also possible. In FIG. 27, the output SRBOn from the shift register circuit SRn in the nth row corresponds to the gate signal Gn of the nth row and is supplied to the gate line of the nth line, and the internal signal Mn+1 (CSRn+1) from the shift register circuit SRn+1 in the (n+1)th row is inputted to the latch circuit CSLn of the nth row, and the CS signal CSOUTn is supplied to the CS bus line of the nth row.

Figure 28:
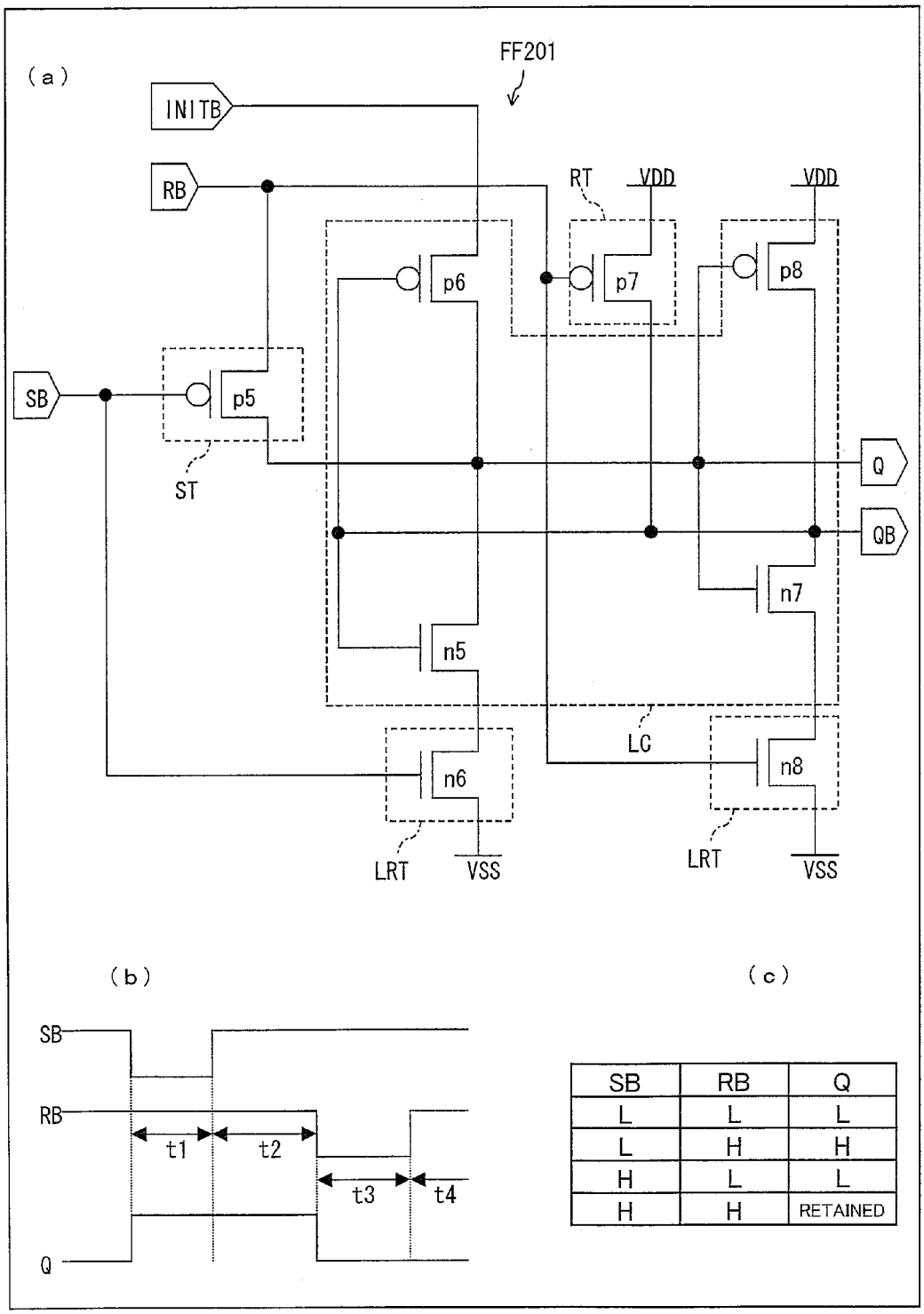
FIG. 28 shows (a) a circuit diagram showing a configuration of a flip-flop according to Embodiment 1, (b) a timing chart showing operation of the flip-flop (when the INITB signal is non-active), and (c) a truth table of the flip-flop (when the INITB signal is non-active).

A flip-flop circuit according to Embodiment 1 is described here in detail. (a) of FIG. 28 is a circuit diagram showing a configuration of a flip-flop according to Embodiment 1. As shown in (a) of FIG. 28, the flip-flop circuit (FF201) includes: a P-channel transistor p6 and an N-channel transistor n5, which constitute a CMOS circuit; a P-channel transistor p8 and an N-channel transistor n7, which constitute a CMOS circuit; P-channel transistors p5 and p7; N-channel transistors n6 and n8; an SB terminal; an RB terminal; an INITB terminal; and Q and QB terminals. The flip-flop circuit (FF201) is configured such that the gate of p6, the gate of n5, the drain of p7, the drain of p8, the drain of n7, and the QB terminal are connected to one another, that the drain of p6, the drain of n5, the drain of p5, the gate of p8, the gate of n7, and the Q terminals are connected to one another, that the source of n5 and the drain of n6 are connected to each other, that the source of n7 and the drain of n8 are connected to each other, that the SB terminal is connected to the gate of p5 and to the gate of n6, that the RB terminal is connected to the source of p5, to the gate of p7, and to the gate of n8, that the INITB terminal is connected to the source of p6, that the sources of p7 and p8 are connected to VDD, and that the sources of n6 and n8 are connected to VSS. It should be noted here that p6, n5, p8, and n7 constitute a latch circuit LC, that p5 functions as a set transistor ST, that p7 functions a reset transistor RT, and that n6 and n8 each function as a latch release transistor LRT.

(b) of FIG. 28 is a timing chart showing operation of FF201 (when the INITB signal is non-active), and (c) of FIG. 28 is a truth table of FF201 (when the INITB signal is non-active). As shown in (b) and (c) of FIG. 28, the Q signal from FF201 is Low (non-active) during a period of time in which the SB signal is Low (active) and the RB signal is Low (active), is High (active) during a period of time in which the SB signal is Low (active) and the RB signal is High (non-active), is Low (non-active) during a period of time in which the SB signal is High (non-active) and the RB signal is Low (active), and is retained during a period of time in which the SB signal is High (non-active) and the RB signal is High (non-active).

For example, at t1 in (b) of FIG. 28, Vdd from the RB terminal is outputted to the Q terminal, whereby n7 is turned ON so that Vss (Low) is outputted to the QB terminal. At t2, the SB signal is raised to High so that p5 is turned OFF and n6 is turned ON, whereby the state at t1 is maintained. At t3, the RB signal is dropped to Low, whereby p7 is turned ON so that Vdd (High) is outputted to the QB terminal and, furthermore, n5 is turned ON so that Vss is outputted to the Q terminal. It should be noted that when both the SB signal and the RB signal have become Low (active), p7 is turned ON so that Vdd (High) is outputted to the QB terminal and Vss+Vth (threshold voltage of p5) is outputted to the Q terminal via p5.

Furthermore, when the SB signal and the RB signal have become non-active during a period of time in which the INITB signal is active, the Q and QB signals from FF201 become non-active.

For example, let it be assumed that during a period of time in which the INITB signal is Low (active), there is a change from a state in which the SB signal and the RB signal are both Low (active) (state A) to a state in which the SB signal and the RB signal are both High (non-active) (state X). In state A, p7 is ON and p6 is OFF, and Vdd (High) is outputted to the QB terminal and Vss is outputted to the Q terminal. In state X, p6 remains OFF; therefore, the outputs to the Q and QB terminals are the same as those in state A. Further, let it be assumed that during a period of time in which the INITB signal is Low (active), there is a change from a state in which both the SB signal is High (non-active) and the RB signal is Low (active) (state B) to a state in the SB signal and the RB signal are both High (non-active) (state X). In state B, p7 and n5 are turned ON, and Vdd (High) is outputted to the QB terminal and Vss (Low) is outputted to the Q terminal. In state X, p6 remains OFF; therefore, the outputs to the Q and QB terminals are the same as those in state B. Furthermore, let it be assumed that during a period of time in which the INITB signal is Low (active), there is a change from a state in which both the SB signal is Low (active) and the RB signal is High (non-active) (state C) to a state in the SB signal and the RB signal are both High (non-active) (state X). In state C, the outputs to the Q and QB terminals becomes indefinite. In state X, p6 is turned ON; therefore, Vss+Vth (threshold voltage of p5) is outputted to the Q terminal and Vdd (High) is outputted to the QB terminal.

Thus, in FF201, p6, n5, p8, and n7 (two CMOSs) constitute a latch circuit, and the RB terminal is connected to the gate of p7, which functions as the reset transistor RT, and to the source of p5, which functions as the set transistor ST, and the source of p6 is connected to the INITB terminal, whereby the order of priority of set, latch, reset, SB, and RB signals when they become active at the same time is determined and initialization operations are achieved. In FF201, as described above, when the SB signal and the RB signal become active at the same time, the RB signal (reset) is given priority and the output QB becomes non-active.

Embodiment 2

Another embodiment of the present invention is described below with reference to FIGS. 9 through 13. For convenience of explanation, those members which have the same functions as those described above in Embodiment 1 are given the same reference numerals and are not described below. Further, those terms defined in Embodiment 1 are defined in the same way in the present embodiment unless otherwise noted.

Figure 9:
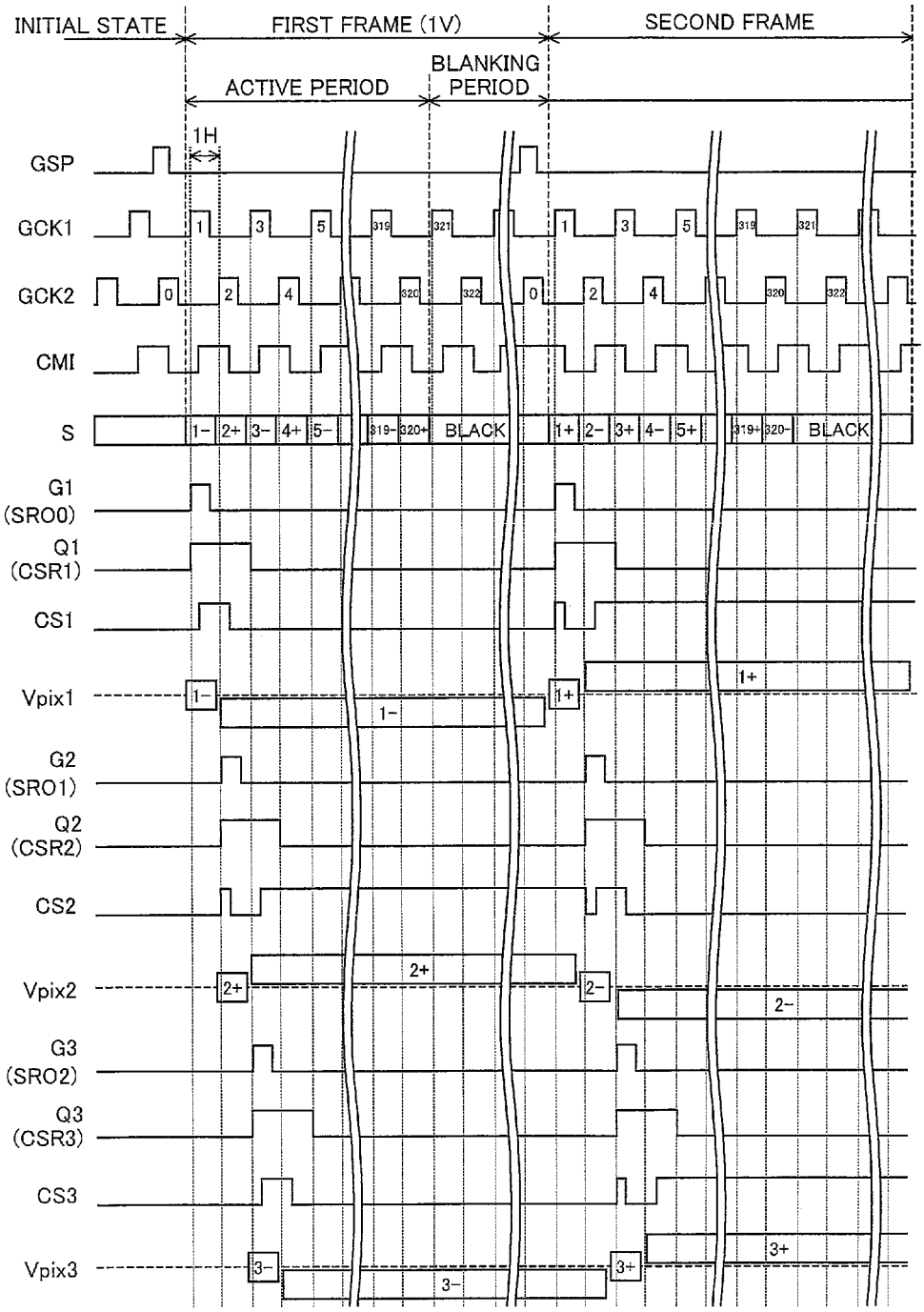
FIG. 9 is a timing chart showing waveforms of various signals of a liquid crystal display device in Embodiment 2.

FIG. 9 is a timing chart showing waveforms of various signals in a liquid crystal display device 1 of Embodiment 2. The various signals shown in FIG. 9 are the same as those shown in FIG. 3, GSP being a gate start pulse signal, GCK1 (CK) and GCK2 (CKB) being gate clock signals, CMI being a polarity signal. The illustrated timing chart in the liquid crystal display device 1 of Embodiment 2 is different from that of Embodiment 1 in terms of the timing of changes in potential of the polarity signal CMI and the output waveforms of the CS signals and identical to that of Embodiment 1 in other respects.

Figure 22:
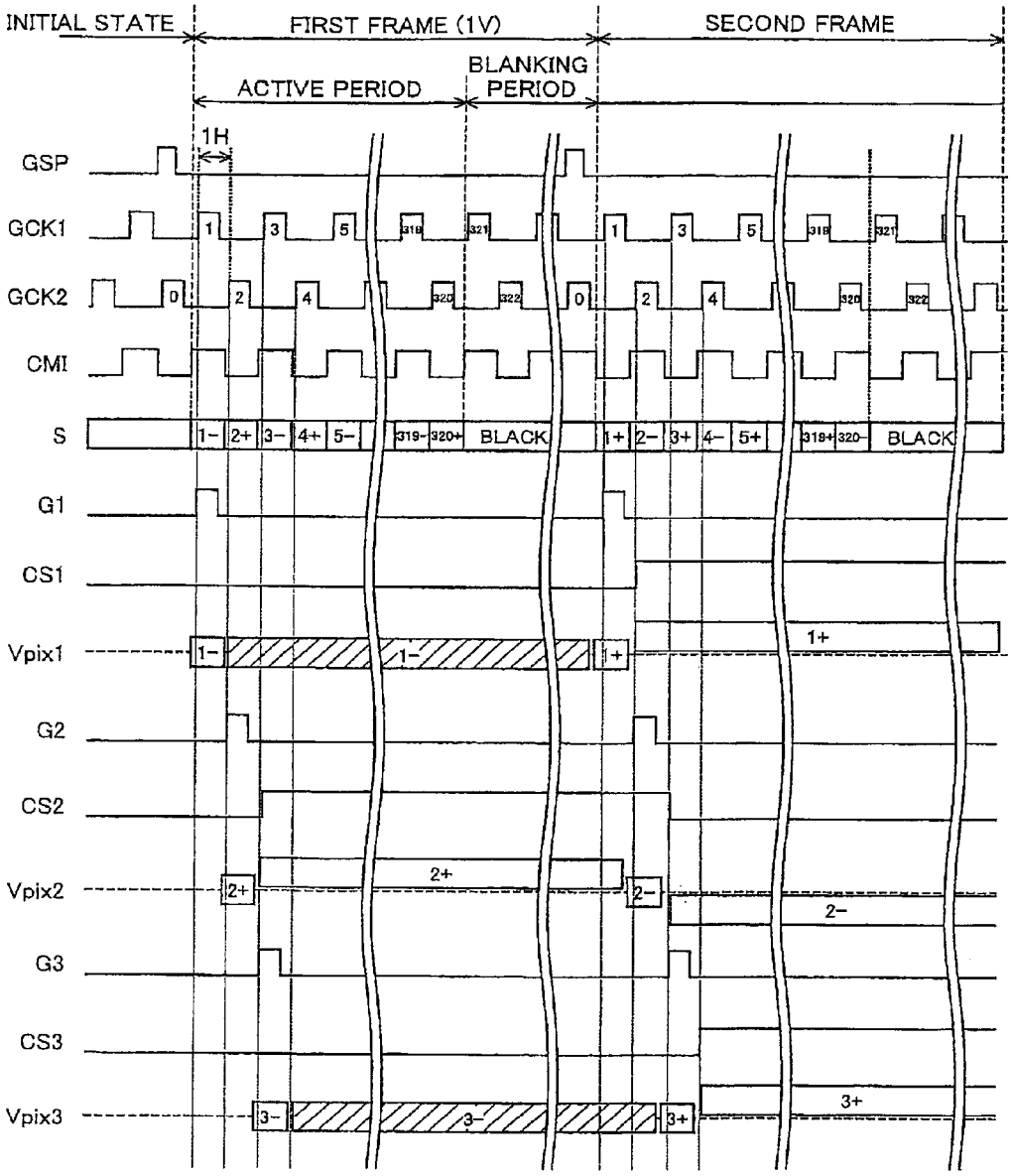
FIG. 22 is a timing chart showing comparative examples of waveforms of various signals in the conventional liquid crystal display device.
Figure 23:
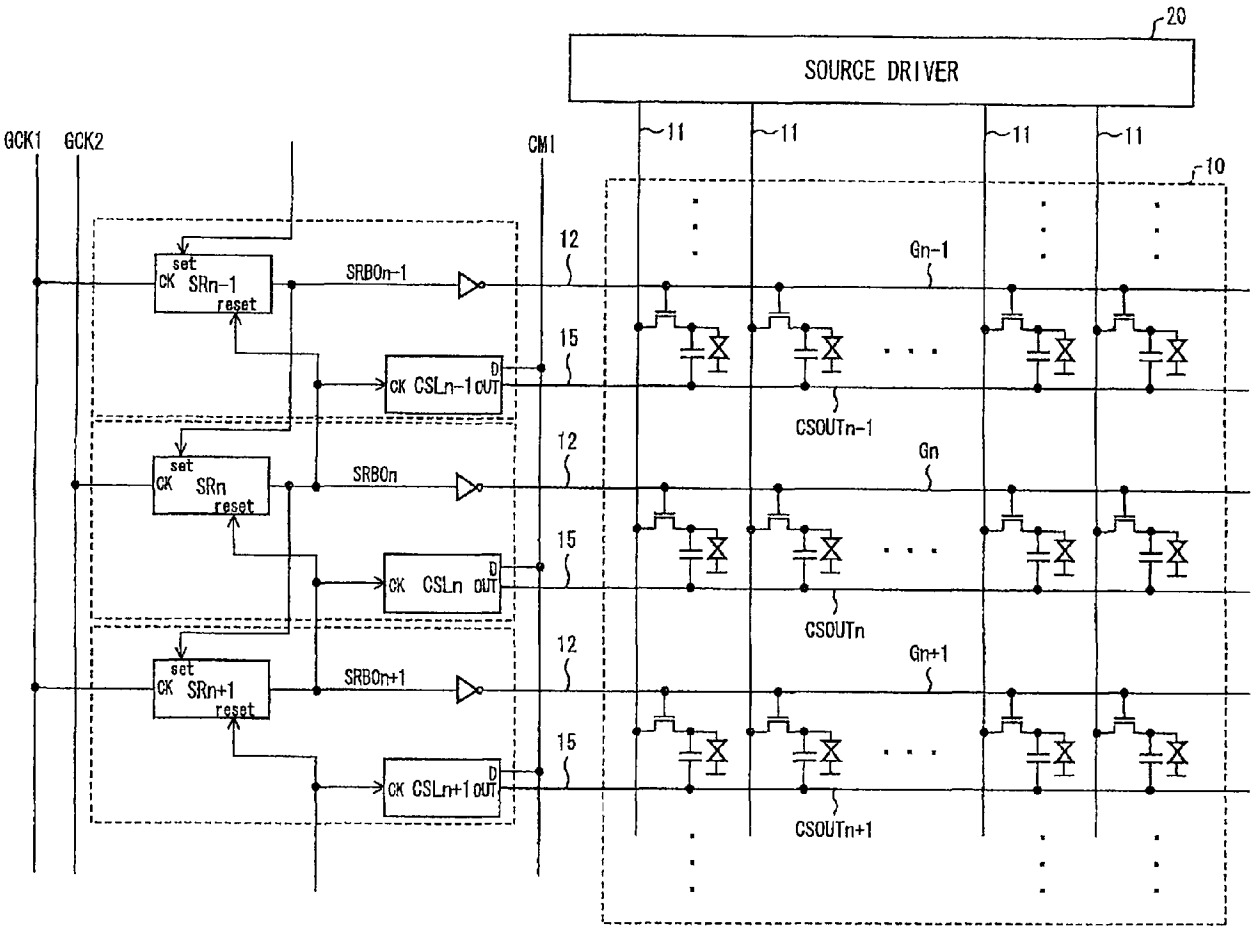
FIG. 23 is a block diagram showing another configuration of a gate line driving circuit and a CS bus line driving circuit in the conventional liquid crystal display device.

In Embodiment 2, as shown in FIG. 9, during an initial state, as in the case shown in FIG. 22, the CS signals CS1, CS2, and CS3 are all fixed at one potential (in FIG. 9, at a low level). The CS signal CS1 in the first row and the CS signal CS3 in the third row switch from a low level to a high level after rising edges in their corresponding gate signals G1 and G3, respectively, and are at a high level at points in time where the gate signals G1 and G3 fall. Therefore, the potential of a CS signal in each row at a point in time where its corresponding gate signal falls is different from the potential of a CS signal in an adjacent row at a point in time where its corresponding gate signal falls. For example, the CS signal CS1 is at a high level at a point in time where its corresponding gate signal G1 falls, and the CS signal CS2 is at a low level at a point in time where its corresponding gate signal G2 falls, and the CS signal CS3 is at a high level at a point in time where its corresponding gate signal G3 falls.

Thus, as in Embodiment 1, adjacent rows are different from each other in terms of the potentials of the CS signals at points in time where the gate signals fall in the first frame, the CS signals CS1, CS2, and CS3 in the first frame takes the same waveforms as in a normal odd-numbered frame (e.g., the third frame). Therefore, since the potentials Vpix1, Vpix2, and Vpix3 of the pixel electrodes 14 are all properly shifted by the CS signals CS1, CS2, and CS3, respectively, inputting of source signals S of the same gray scale causes the positive and negative potential differences between the potential of the counter electrode and the shifted potential of each of the pixel electrodes 14 to be equal to each other. This results in elimination of appearance of transverse stripes in the first frame, thus allowing an improvement in display quality.

Figure 10:
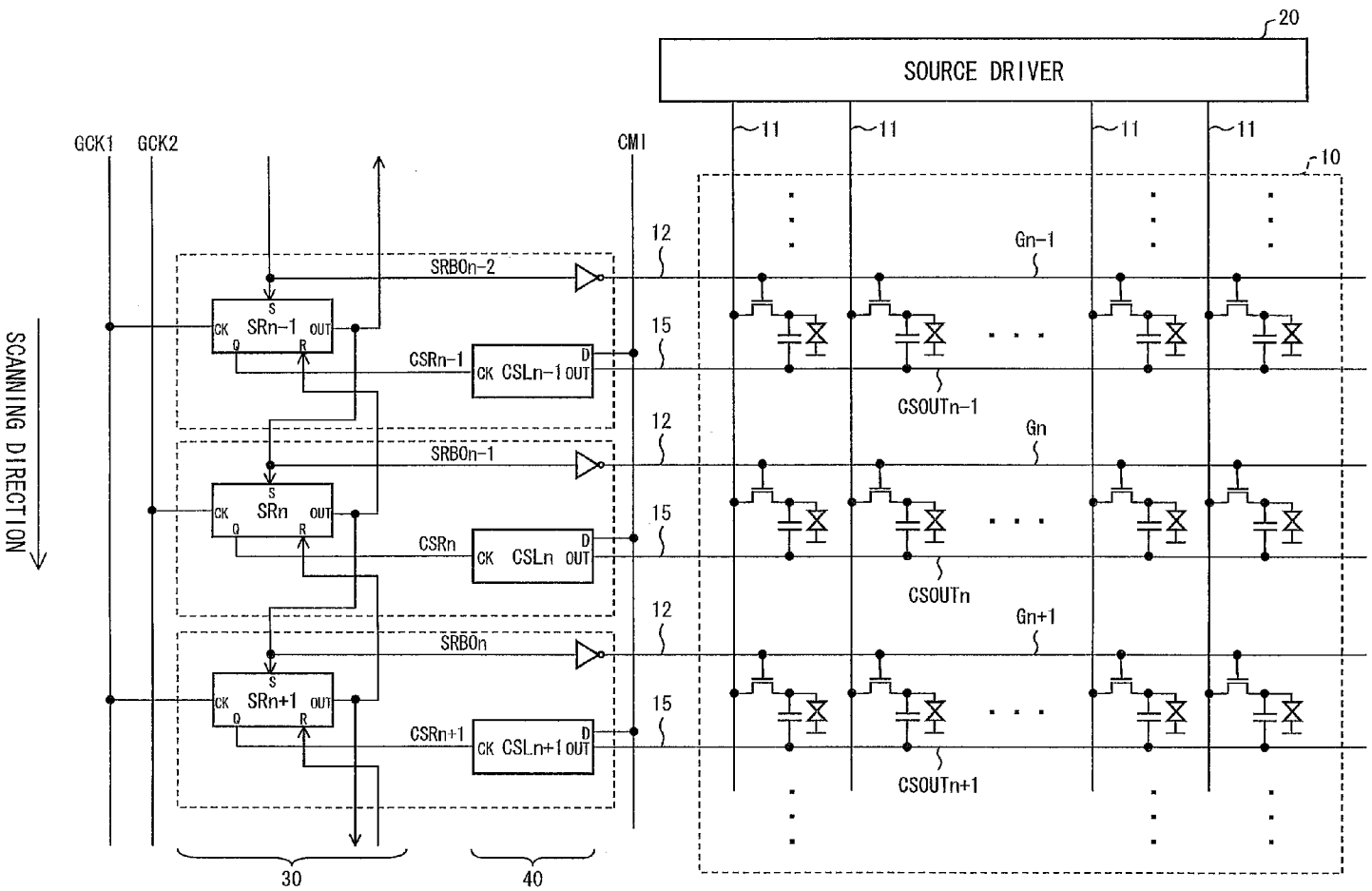
FIG. 10 is a block diagram showing a configuration of a gate line driving circuit and a CS bus line driving circuit in Embodiment 2.

A specific configuration of the gate line driving circuit 30 and the CS bus line driving circuit 40 for achieving the aforementioned control is described here. FIG. 10 shows a configuration of the gate line driving circuit 30 and the CS bus line driving circuit 40. As in FIG. 4, the row (line) (next row) following the nth row in a scanning direction (indicated by an arrow in FIG. 10) is represented as the (n+1)th row, and the row (previous row) immediately preceding the nth row in the scanning direction is represented as the (n−1)th row.

As shown in FIG. 10, the gate line driving circuit 30 has a plurality of shift register circuits SR corresponding to their respective rows, and the CS bus line driving circuit 40 has a plurality of latch circuits CSL corresponding to their respective rows. In the following, the shift register circuits SRn−1, SRn, and SRn+1 and the latch circuits CSLn−1, CSLn, and CSLn+1, which correspond to the (n−1)th, nth, and (n+1)th rows respectively, are taken as an example.

The shift register circuit SRn−1 in the (n−1)th row receives the gate clock signal GCK1 via its clock terminal CK from the control circuit 50 (see FIG. 1), and receives a shift register output SRBOn−2 from the previous row (the (n−2)th row) via its set terminal S as a set signal for the shift register circuit SRn−1. The shift register circuit SRn−1 has its output terminal OUTB connected to the reset terminal R of the shift register circuit SRn−2 of the previous row (the (n−2)th row) and the set terminal S of the shift register circuit SRn of the next row (the nth row). This allows the shift register circuit SRn−1 to output a shift register output SRBOn−1 via its output terminal OUT as a reset signal to the shift register circuit SRn−2 of the previous row and as a set signal to the shift register circuit SRn of the next row. The shift register circuit SRn−1 has its output terminal Q connected to the clock terminal CK of the latch circuit CSLn−1 of the current row (the (n−1)th row). This allows the shift register circuit SRn−1 to input an internal signal Qn−1 (signal CSRn−1) that it generates to the latch circuit CSLn−1.

Further, the shift register output SRBOn−2 from the previous row (the (n−2)th row) is both inputted to the shift register circuit SRn−1 and outputted as a gate signal Gn−1 to the gate line 12 of the current row (the (n−1)th row) via a buffer.

The latch circuit CSLn−1 in the (n−1)th row, constituted as a D latch circuit, receives the polarity signal CMI from the control circuit 50 (see FIG. 1) and the internal signal Qn−1 (signal CSRn−1) from the shift register circuit SRn−1. The latch circuit CSLn−1 has its output terminal OUT connected to the CS bus line 15 of the current row (the (n−1)th row). This allows the latch circuit CSLn−1 to output a CS signal CSOUTn−1 via its output terminal OUT to the CS bus line 15 of the current row.

The shift register circuit SRn in the nth row receives the gate clock signal GCK2 via its clock terminal CK from the control circuit 50 (see FIG. 1), and receives a shift register output SRBOn−1 from the previous row (the (n−1)th row) via its set terminal S as a set signal for the shift register circuit SRn. The shift register circuit SRn has its output terminal OUT connected to the reset terminal R of the shift register circuit SRn−1 of the previous row (the (n−1)th row) and the set terminal S of the shift register circuit SRn+1 of the next row (the (n+1)th row). This allows the shift register circuit SRn to output a shift register output SRBOn via its output terminal OUT as a reset signal to the shift register circuit SRn−1 of the previous row and as a set signal to the shift register circuit SRn+1 of the next row. The shift register circuit SRn has its output terminal Q connected to the clock terminal CK of the latch circuit CSLn of the current row (the nth row). This allows the shift register circuit SRn to input an internal signal Qn (signal CSRn) generated inside thereof to the latch circuit CSLn.

Further, the shift register output SRBOn−1 from the previous row (the (n−1)th row) is both inputted to the shift register circuit SRn and outputted as a gate signal Gn to the gate line 12 of the current row (the nth row) via a buffer.

The latch circuit CSLn in the nth row, constituted as a D latch circuit, receives the polarity signal CMI from the control circuit 50 (see FIG. 1) and the internal signal Qn (signal CSRn) from the shift register circuit SRn. The latch circuit CSLn has its output terminal OUT connected to the CS bus line 15 of the current row (the nth row). This allows the latch circuit CSLn to output a CS signal CSOUTn via its output terminal OUT to the CS bus line 15 of the current row.

The shift register circuit SRn+1 in the (n+1)th row receives the gate clock signal GCK1 via its clock terminal CK from the control circuit 50 (see FIG. 1), and receives a shift register output SRBOn from the previous row (the nth row) via its set terminal S as a set signal for the shift register circuit SRn+1. The shift register circuit SRn+1 has its output terminal OUT connected to the reset terminal R of the shift register circuit SRn of the previous row (the nth row) and the set terminal S of the shift register circuit SRn+2 of the next row (the (n+2)th row). This allows the shift register circuit SRn+1 to output a shift register output SRBOn+1 via its output terminal OUT as a reset signal to the shift register circuit SRn of the previous row and as a set signal to the shift register circuit SRn+2 of the next row. The shift register circuit SRn+1 has its output terminal Q connected to the clock terminal CK of the latch circuit CSLn+1 of the current row (the (n+1)th row). This allows the shift register circuit SRn+1 to input an internal signal Qn+1 (signal CSRn+1) generated inside thereof to the latch circuit CSLn+1.

Further, the shift register output SRBOn from the previous row (the nth row) is both inputted to the shift register circuit SRn+1 and outputted as a gate signal Gn+1 to the gate line 12 of the current row (the (n+1)th row) via a buffer.

The latch circuit CSLn+1 in the (n+1)th row, constituted as a D latch circuit, receives the polarity signal CMI from the control circuit 50 (see FIG. 1) and the internal signal Qn+1 (signal CSRn+1) from the shift register circuit SRn+1. The latch circuit CSLn+1 has its output terminal OUT connected to the CS bus line 15 of the current row (the (n+1)th row). This allows the latch circuit CSLn+1 to output a CS signal CSOUTn+1 via its output terminal OUT to the CS bus line 15 of the current row.

Figure 11:
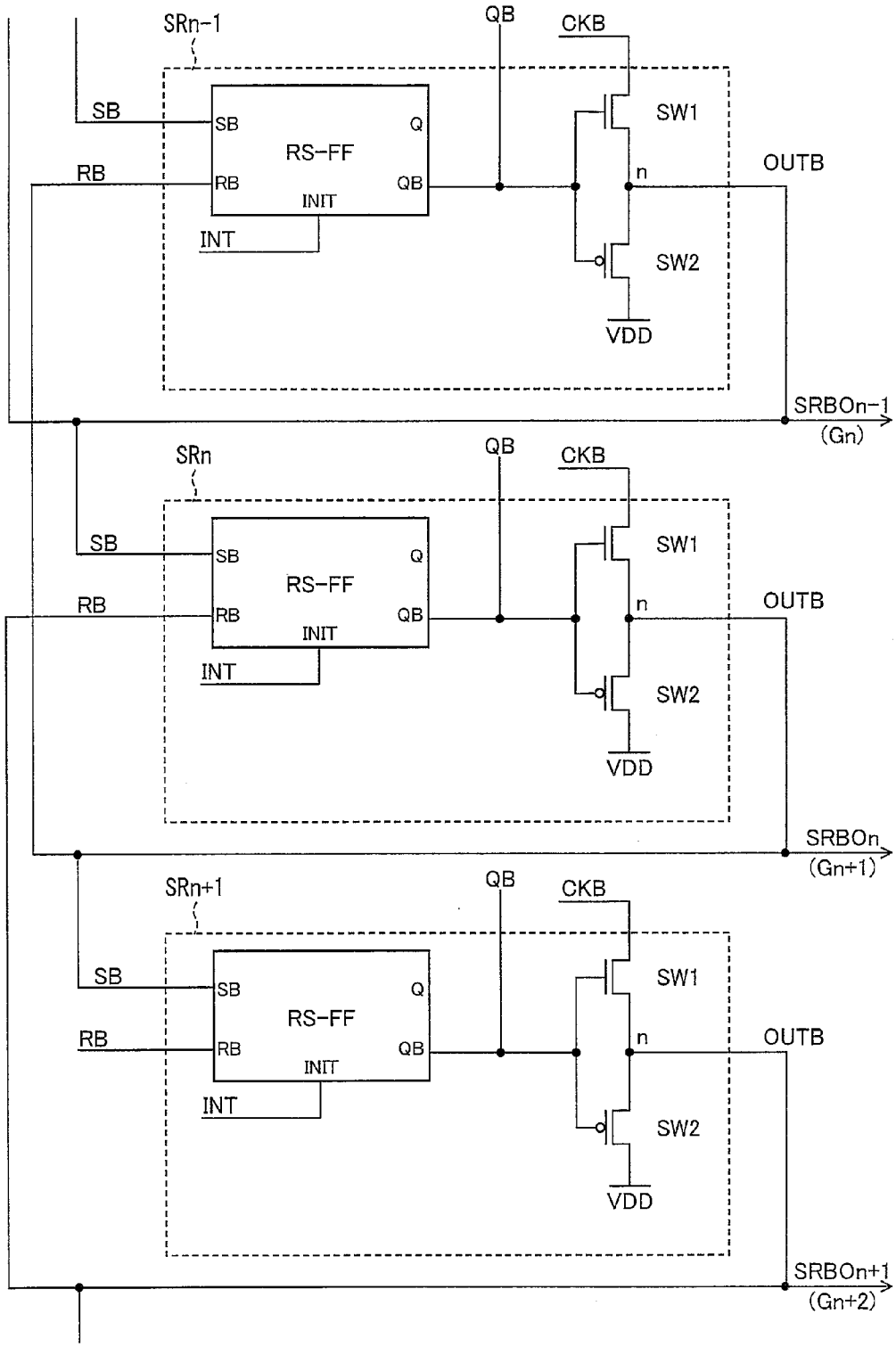
FIG. 11 shows a configuration of shift register circuits in Embodiment 2.

The following explains operation of each shift register circuit SR. FIG. 11 shows the shift register circuits SRn−1, SRn, and SR+1 in the (n−1)th, nth, and (n+1)th rows in detail. It should be noted that the shift register circuit SR in each row is identical in configuration to the shift register circuits SRn−1, SRn, and SR+1. The following explanation is centered on the shift register circuit SRn in the nth row.

As shown in FIG. 11, the shift register circuit SRn includes an RS type flip-flop circuit RS-FF and analog switching circuits SW1 and SW2. The flip-flop circuit RS-FF receives the shift register output SRBOn−1 (OUTB) via its set terminal SB from the previous row (the (n−1)th row) as a set signal and the shift register output SRBOn+1 (OUTB) via its reset terminal RB from the next row (the (n+1)th row) as a rest signal as described above. The flip-flop circuit RS-FF has its output terminal QB connected to control electrodes of the analog switching circuits SW1 and SW2 and connected to the clock terminal CK (see FIG. 10) of the latch circuit CSLn of the current row (the nth row). The analog switching circuits SW1 and SW2 receive, from the flip-flop circuit RS-FF, an internal signal QBn (signal CSRn) that controls each of the analog switching circuits SW1 and SW2 so that it switches between ON and OFF. The analog switching circuit SW1 has a first conductive electrode to which the gate clock signal CKB (GCK2) is inputted and a second conductive electrode connected to a first conductive electrode of the analog switching circuit SW2, and the analog switching circuit SW2 has a second conductive electrode that is supplied with the power supply (VDD). The analog switching circuits SW1 and SW2 are connected to each other at a connection point n connected to the output OUTB of the shift register circuit SRn. The shift register circuit SRn has it output terminal OUTB connected to the set terminal SB of the next row (the (n+1)th row). This allows the shift register output SRBOn (OUTB) of the current row (the nth row) to be inputted as a set signal for the shift register circuit SRn+1 of the next row (the (n+1)th row). Further, the shift register circuit SRn has it output terminal OUTB connected to the reset terminal RB of the previous row (the (n−1)th row). This allows the shift register output SRBOn (OUTB) of the current row (the nth row) to be inputted as a reset signal for the shift register circuit SRn−1 of the previous row (the (n−1)th row).

Figure 12:
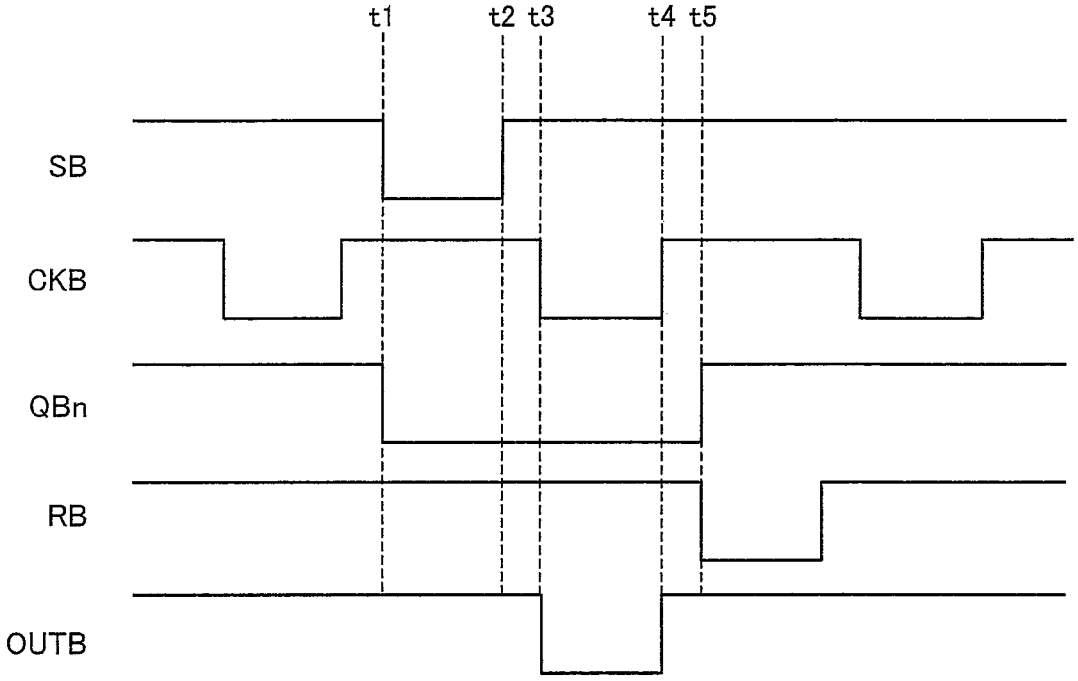
FIG. 12 is a timing chart showing waveforms of various signals that are inputted to and outputted from the shift register circuits shown in FIG. 11.

Operation of the shift register circuit SRn is described below. FIG. 12 is a timing chart showing waveforms of various signals that are inputted to and outputted from the shift register circuit SRn.

First, when the set signal (SRBOn−1) inputted to the shift register circuit SRn changes from a high level to a low level (becomes active), the output QB (internal signal QBn) from the flip-flop circuit RS-FF changes from a high level to a low level (t1). When the internal signal QBn has been dropped to a low level, the analog switching circuit SW1 is turned on, whereby the clock signal CKB (at a high level) is outputted to OUTB. This causes the output signal OUTB to be at a high level during the period from t1 to t2. When the set signal SB has been raised to a high level (t2), the reset signal RB is still at a high level (non-active) at this point in time. Therefore, the flip-flop circuit RS-FF is not reset, whereby the internal signal QBn is maintained at a low level and the output signal OUTB is maintained at a high level (t2 to t3). When the clock signal CKB has been dropped to a low level (t3), the analog switching circuit SW1 is in an on state. Therefore, the output signal OUTB is dropped to a low level, and this state is maintained during the period from t3 to t4.

Then, the reset signal RB, outputted from the shift register circuit SRn+1 in the next row (the (n+1)th row), which is inputted to the shift register circuit SRn in the current row (the nth row) is dropped to a low level (active) (t5), the flip-flop circuit RS-FF is reset, so that the internal signal QBn changes from a low level to a high level. When the internal signal QBn is raised to a high level (t5). the analog switching circuit SW1 is turned off and the switching circuit SW2 is turned on. This causes VDD (high level) to be outputted to OUTB and the output signal OUTB to be raised to a high level.

The output OUTB thus generated allows the shift register circuit SRn+1 in the next row (the (n+1) row) to start an operation and the shift register circuit SRn in the previous row (the (n−1)th row) to carry out a reset operation.

It should be noted here that the internal signal QBn, which is generated inside of the shift register circuit SRn, becomes active in a period of time (2H) from a point in time where the set signal SB has become active to a point in time where the reset signal RB becomes active. Moreover, an inversion signal Qn of the internal signal QBn is inputted to the clock terminal CK of the latch circuit CSLn in the current row (nth row) (signal CSRn of FIG. 10).

Figure 13:
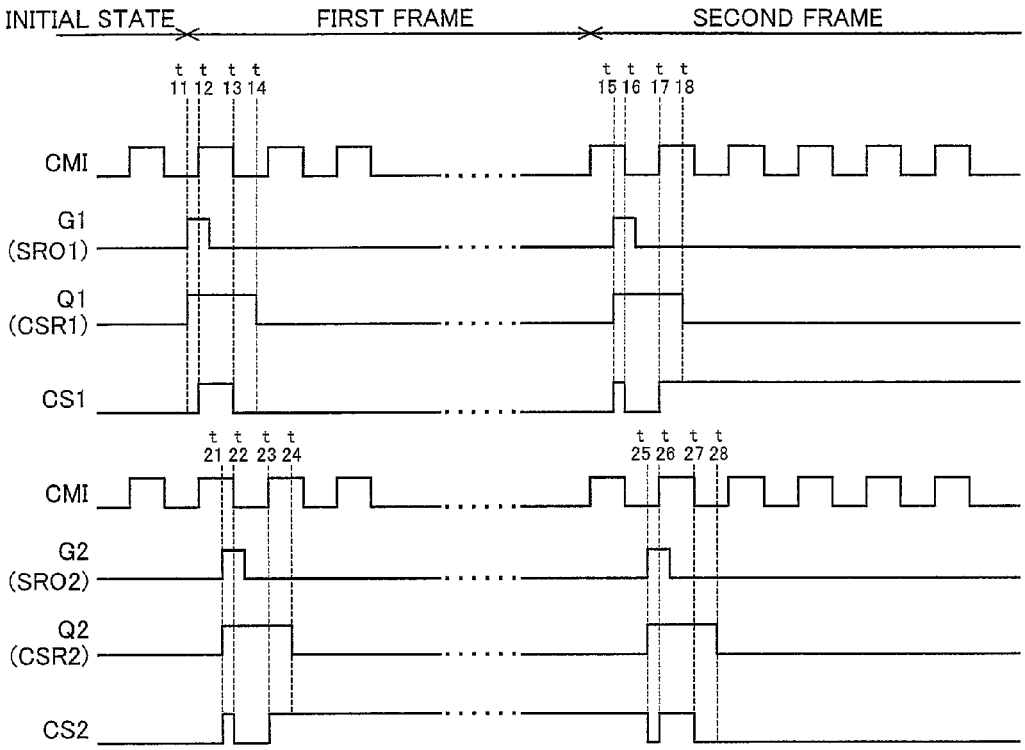
FIG. 13 is a timing chart showing waveforms of various signals that are inputted to and outputted from D latch circuits in Embodiment 2.

The following explains operation of each latch circuit CSL. The latch circuit CSL in each row is identical in configuration to that shown in FIG. 7. The following explanation refers to the latch circuit CSL as the D latch circuit CSL. FIG. 13 is a timing chart showing waveforms of various signals that are inputted to and outputted from the D latch circuit CSLn. FIG. 13 shows, as an example, a timing chart in the D latch circuit CSL1 in the first row and the D latch circuit CSL2 in the second row. It should be noted here that for the sake of convenience, the internal signal QB shown in FIG. 11 is expressed as internal signal Q (logical inversion of QB).

First, changes in waveform of various signals in the first row are described.

In the initial state, the D latch circuit CSL1 receives a reset signal RESET via its terminal CL (see FIG. 7). By this reset signal RESET, the potential of the CS signal CS1 that the D latch circuit CSL1 outputs via its output terminal OUT is retained at a low level.

When, in the first frame, the gate line driving circuit 30 supplies a gate signal G1 to the gate line 12 in the first row, the D latch circuit CSL1 receives via its clock terminal CK (see FIG. 7) an internal signal Q1 (signal CSR1) outputted from the shift register circuit SR1. Upon receiving a change in potential of the internal signal Q1 (from low to high; t11), the D latch circuit CSL1 transfers an input state of the polarity signal CMI that it received via its input terminal D (see FIG. 7) at the point in time, i.e., transfers a low level, and outputs the change in potential of the polarity signal CMI until the next time when there is a change in potential of the internal signal Q1 (from high to low; t14) that the D latch circuit CSL1 receives via its clock terminal CK (i.e., during a period of time in which the internal signal Q1 is at a high level). When the polarity signal CMI changes from a low level to a high level during the period of time in which the internal signal Q1 is at a high level (t12), the D latch circuit CSL1 switches its output CS1 from a low level to a high level. After that, when the polarity signal CMI change from a high level to a low level (t13), the D latch circuit CSL1 switches its output CS1 from a high level to a low level. Next, upon receiving a change in potential of the internal signal Q1 (from high to low) via its clock terminal CK (t14), the D latch circuit CSL1 latches an input state of the polarity signal CMI that it received at the point in time, i.e., latches a low level. After that, the D latch circuit CSL1 retains its output CS1 at a low level until there is a change in potential of the internal signal Q1 in the second frame (from low to high; t15).

When, in the second frame, the gate line driving circuit 30 similarly supplies a gate signal G1 to the gate line 12 in the first row, the D latch circuit CS1 receives via its clock terminal CK an internal signal Q1 (signal CSR1) outputted from the shift register circuit SR1. When the internal signal Q1 changes from a low level to a high level (t15), the D latch circuit CSL1 transfers an input state of the polarity signal CMI that it received via its input terminal D at the point in time, i.e., transfers a high level. The D latch circuit CSL1 outputs the change in potential of the polarity signal CMI during a period of time in which the internal signal Q1 is at a high level (t15 to t18). Therefore, when the polarity signal CMI changes from a high level to a low level (t16), the D latch circuit CSL1 switches its output CS1 from a high level to a low level. After that, when the polarity signal CMI changes from a low level to a high level (t17), the D latch circuit CSL1 switches its output CS1 from a low level to a high level. Next, upon receiving a change in potential of the internal signal Q1 (from high to low; t18) via its clock terminal CK, the D latch circuit CSL1 latches an input state of the polarity signal CMI that it received at the point in time, i.e., latches a high level. After that, the D latch circuit CSL1 retains its output CS1 at a high level until there is a change in potential of the internal signal Q1 in the third frame.

The CS signal CS1 thus generated is supplied to the CS bus line 15 of the first row. It should be noted that the output in the third frame takes a waveform obtained by reversing the potential level of the output waveform in the second frame, and in the fourth frame and later, signals identical in output waveform to those in the second and third frames are alternately outputted.

Next, changes in waveform of various signals in the second row are described.

In the initial state, the D latch circuit CSL2 receives the reset signal RESET via its terminal CL (see FIG. 7). By this reset signal RESET, the potential of the CS signal CS2 that the D latch circuit CS2 outputs via its output terminal OUT is retained at a low level.

When, in the first frame, the gate line driving circuit 30 supplies a gate signal G2 to the gate line 12 in the second row, the D latch circuit CSL2 receives via its clock terminal CK an internal signal Q2 (signal CSR2) outputted from the shift register circuit SR2. Upon receiving a change in potential of the internal signal Q2 (from low to high; t21), the D latch circuit CSL2 transfers an input state of the polarity signal CMI that it received via its input terminal D at the point in time, i.e., transfers a high level, and outputs the change in potential of the polarity signal CMI until the next time when there is a change in potential of the internal signal Q2 (from high to low; t24) that the D latch circuit CSL2 receives via its clock terminal CK (i.e., during a period of time in which the internal signal Q2 is at a high level; t21 to t24). When the polarity signal CMI changes from a high level to a low level during the period of time in which the internal signal Q2 is at a high level (t22), the D latch circuit CSL2 switches its output CS2 from a high level to a low level. After that, when the polarity signal CMI changes from a low level to a high level (t23), the D latch circuit CSL2 switches its output CS2 from a low level to a high level. Next, upon receiving a change in potential of the internal signal Q2 (from high to low; t24) via its clock terminal CK, the D latch circuit CSL2 latches an input state of the polarity signal CMI that it received at the point in time, i.e., latches a high level. After that, the D latch circuit CSL2 retains its output CS2 at a high level until there is a change in potential of the internal signal Q2 in the second frame.

When, in the second frame, the gate line driving circuit 30 similarly supplies a gate signal G2 to the gate line 12 in the second row, the D latch circuit CSL2 receives via its clock terminal CK an internal signal Q2 (signal CSR2) outputted from the shift register circuit SR2. When the internal signal Q2 changes from a low level to a high level (t25), the D latch circuit CSL2 transfers an input state of the polarity signal CMI that it received via its input terminal D at the point in time, i.e., transfers a low level. The D latch circuit CSL2 outputs the change in potential of the polarity signal CMI during a period of time in which the internal signal Q2 is at a high level (t25 to t28). Therefore, when the polarity signal CMI changes from a low level to a high level (t26), the D latch circuit CSL2 switches its output CS2 from a low level to a high level. After that, when the polarity signal CMI changes from a high level to a low level (t27), the D latch circuit CSL2 switches its output CS2 from a high level to a low level. Next, upon receiving a change in potential of the internal signal Q2 (from high to low; t28) via its clock terminal CK, the D latch circuit CSL2 latches an input state of the polarity signal CMI that it received at the point in time, i.e., latches a low level. After that, the D latch circuit CSL2 retains its output CS2 at a low level until there is a change in potential of the internal signal Q2 in the third frame.

The CS signal CS2 thus generated is supplied to the CS bus line 15 of the second row. It should be noted that in the third frame and later, signals identical in output waveform to those in the first and second frames are alternately outputted.

Moreover, the operations in the first and second rows correspond to operations of the D latch circuits in each odd-numbered row and each even-numbered row.

Thus, the D latch circuits CSL1, CSL2, CSL3, . . . , which correspond to their respective rows, output CS signals so that in all the frames that include the first frame, the potentials of the CS signals at points in time where the gate signals in their corresponding rows fall (at points in time where the TFTs 13 are switched from on to off) differ from one row to an adjacent row. This brings about the same effects as those brought about by Embodiment 1.

As in Embodiment 1, the configuration of Embodiment 2 causes a signal (internal signal Q) generated inside of the shift register circuit SRn to be inputted directly to the D latch circuit CSLn of the same row (the nth row), whereby a proper CS signal CSn is generated which allows eliminating the appearance of such transverse stripes. This allows a reduction in circuit area as compared with the conventional configuration, thus allowing achieving a small-sized liquid crystal display device and a liquid crystal display panel with a narrow frame, both with high display quality.

Embodiment 3

Another embodiment of the present invention is described below with reference to FIGS. 14 through 18. As in Embodiment 2, those members which have the same functions as those described above in Embodiment 1 are given the same reference numerals and are not described below. Further, those terms defined in Embodiment 1 are defined in the same way in the present embodiment unless otherwise noted.

Figure 14:
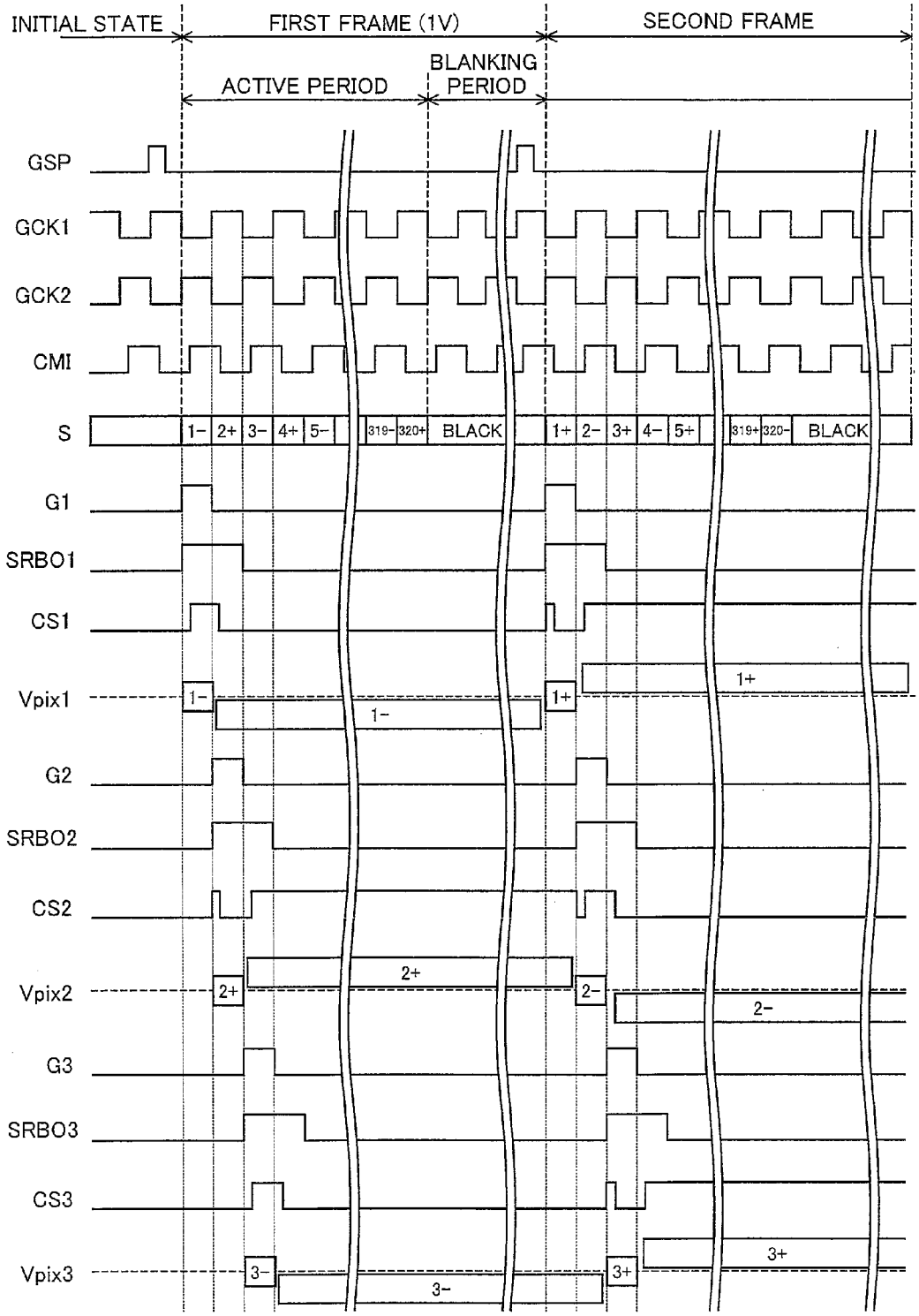
FIG. 14 is a timing chart showing waveforms of various signals of a liquid crystal display device in Embodiment 3.

FIG. 14 is a timing chart showing waveforms of various signals in a liquid crystal display device 1 of Embodiment 3. The various signals shown in FIG. 14 are the same as those shown in FIG. 3, GSP being a gate start pulse signal, GCK1 (CK) and GCK2 (CKB) being gate clock signals, CMI being a polarity signal. The illustrated timing chart in the liquid crystal display device 1 of Embodiment 3 is different from that of Embodiment 1 in terms of the timing of changes in potential of GCK1, GCK2, and the polarity signal CMI and the output waveforms of the CS signals and identical to that of Embodiment 1 in other respects.

In Embodiment 3, too, as shown in FIG. 14, during an initial state, as in the case shown in FIG. 22, the CS signals CS1, CS2, and CS3 are all fixed at one potential (in FIG. 14, at a low level). The CS signal CS1 in the first row and the CS signal CS3 in the third row switch from a low level to a high level after rising edges in their corresponding gate signals G1 and G3, respectively, and are at a high level at points in time where the gate signals G1 and G3 fall. Therefore, the potential of a CS signal in each row at a point in time where its corresponding gate signal falls is different from the potential of a CS signal in an adjacent row at a point in time where its corresponding gate signal falls. For example, the CS signal CS1 is at a high level at a point in time where its corresponding gate signal G1 falls, and the CS signal CS2 is at a low level at a point in time where its corresponding gate signal G2 falls, and the CS signal CS3 is at a high level at a point in time where its corresponding gate signal G3 falls.

Thus, as in Embodiment 1, adjacent rows are different from each other in terms of the potentials of the CS signals at points in time where the gate signals fall in the first frame, the CS signals CS1, CS2, and CS3 in the first frame takes the same waveforms as in a normal odd-numbered frame (e.g., the third frame). Therefore, since the potentials Vpix1, Vpix2, and Vpix3 of the pixel electrodes 14 are all properly shifted by the CS signals CS1, CS2, and CS3, respectively, inputting of source signals S of the same gray scale causes the positive and negative potential differences between the potential of the counter electrode and the shifted potential of each of the pixel electrodes 14 to be equal to each other. This results in elimination of appearance of transverse stripes in the first frame, thus allowing an improvement in display quality.

Figure 15:
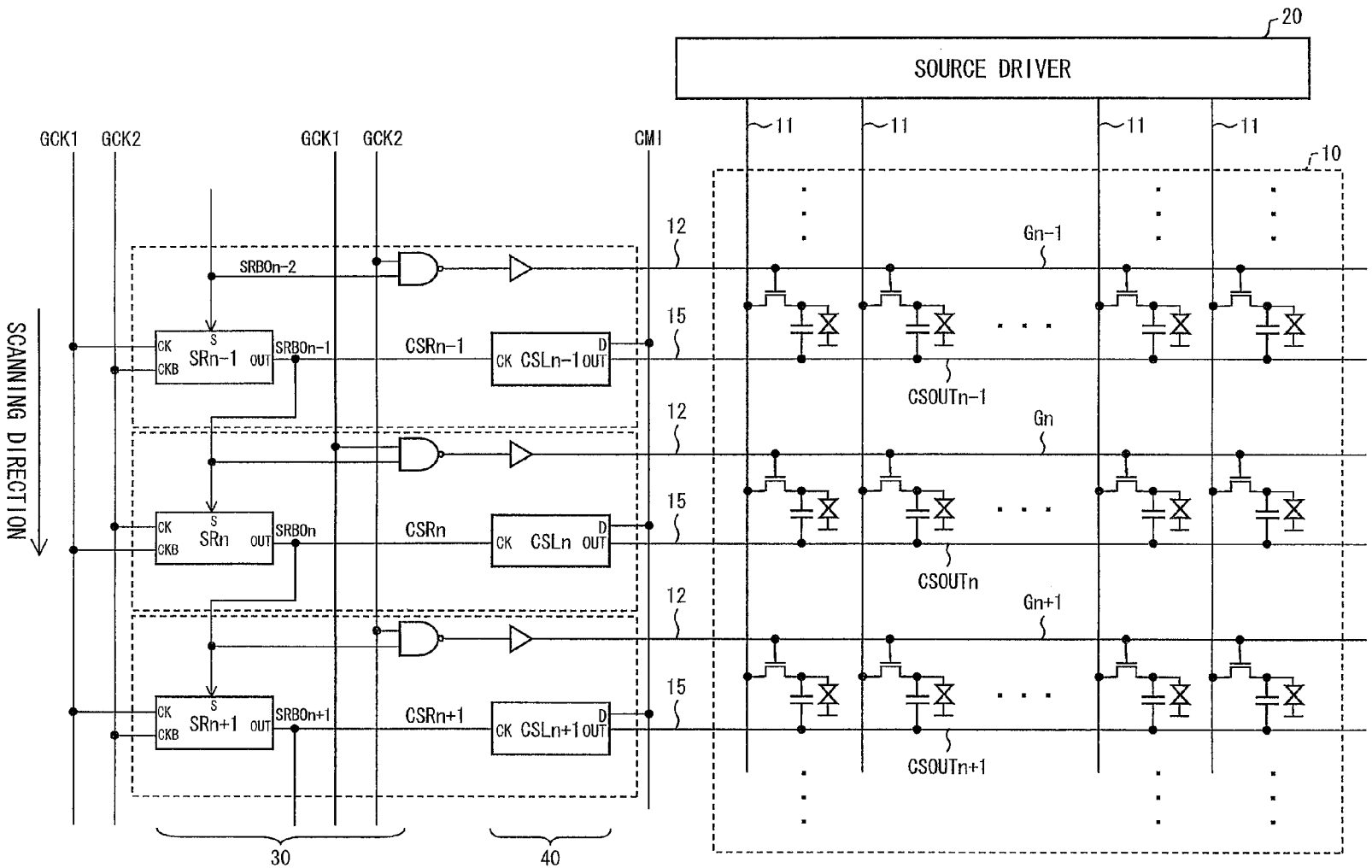
FIG. 15 is a block diagram showing a configuration of a gate line driving circuit and a CS bus line driving circuit in Embodiment 3.

A specific configuration of the gate line driving circuit 30 and the CS bus line driving circuit 40 for achieving the aforementioned control is described here. FIG. 15 shows a configuration of the gate line driving circuit 30 and the CS bus line driving circuit 40. As in FIG. 4, the row (line) (next row) following the nth row in a scanning direction (indicated by an arrow in FIG. 15) is represented as the (n+1)th row, and the row (previous row) immediately preceding the nth row in the scanning direction is represented as the (n−1)th row.

As shown in FIG. 15, the gate line driving circuit 30 has a plurality of shift register circuits SR corresponding to their respective rows, and the CS bus line driving circuit 40 has a plurality of latch circuits CSL corresponding to their respective rows. The shift register circuits SR and the latch circuits CSL are all constituted as D latch circuits. In the following, the shift register circuits SRn−1, SRn, and SRn+1 and the latch circuits CSLn−1, CSLn, and CSLn+1, which correspond to the (n−1)th, nth, and (n+1)th rows respectively, are taken as an example.

The shift register circuit SRn−1 in the (n−1)th row receives the gate clock signals GCK1 and GCK2 via its clock terminals CK and CKB, respectively, from the control circuit 50 (see FIG. 1), and receives a shift register output SRBOn−2 from the previous row (the (n−2)th row) via its set terminal S as a set signal for the shift register circuit SRn−1. The shift register circuit SRn−1 has its output terminal OUTB connected to the set terminal S of the shift register circuit SRn of the next row (the nth row). This allows the shift register circuit SRn−1 to output a shift register output SRBOn−1 via its output terminal OUT as a set signal to the shift register circuit SRn. The shift register circuit SRn−1 has its output terminal OUT connected to the clock terminal CK of the latch circuit CSLn−1 of the current row (the (n−1)th row). This allows the shift register circuit SRn−1 to input a signal SRBOn−1 to the latch circuit CSLn−1.

Further, the shift register output SRBOn−2 from the previous row (the (n−2)th row) is both inputted to the shift register circuit SRn−1 and inputted to one input terminal of a NAND circuit of the current row (the (n−1)th row). GCK2 is inputted to the other input terminal of the NAND circuit, and the output from the NAND circuit is outputted as a gate signal Gn−1 to the gate line 12 of the current row (the (n−1)th row) via a buffer.

The latch circuit CSLn−1 in the (n−1)th row receives the polarity signal CMI from the control circuit 50 (see FIG. 1) and the output signal SRBOn−1 from the shift register circuit SRn−1. The latch circuit CSLn−1 has its output terminal OUT connected to the CS bus line 15 of the current row (the (n−1)th row). This allows the latch circuit CSLn−1 to output a CS signal CSOUTn−1 via its output terminal OUT to the CS bus line 15 of the current row.

The shift register circuit SRn in the nth row receives the gate clock signals GCK2 and GCK1 via its clock terminals CK and CKB, respectively, from the control circuit 50 (see FIG. 1), and receives a shift register output SRBOn−1 from the previous row (the (n−1)th row) via its set terminal S as a set signal for the shift register circuit SRn. The shift register circuit SRn has its output terminal OUT connected to the set terminal S of the shift register circuit SRn+1 of the next row (the (n+1)th row). This allows the shift register circuit SRn to output a shift register output SRBOn via its output terminal OUT as a set signal to the shift register circuit SRn+1. The shift register circuit SRn has its output terminal OUT connected to the clock terminal CK of the latch circuit CSLn of the current row (the nth row). This allows the shift register circuit SRn to input an output signal SRBOn to the latch circuit CSLn.

Further, the shift register output SRBOn−1 from the previous row (the (n−1)th row) is both inputted to the shift register circuit SRn and inputted to one input terminal of a NAND circuit of the current row (the nth row). GCK1 is inputted to the other input terminal of the NAND circuit, and the output from the NAND circuit is outputted as a gate signal Gn to the gate line 12 of the current row (the nth row) via a buffer.

The latch circuit CSLn in the nth row receives the polarity signal CMI from the control circuit 50 (see FIG. 1) and the output signal SRBOn from the shift register circuit SRn. The latch circuit CSLn has its output terminal OUT connected to the CS bus line 15 of the current row (the nth row). This allows the latch circuit CSLn to output a CS signal CSOUTn via its output terminal OUT to the CS bus line 15 of the current row.

The shift register circuit SRn+1 in the (n+1)th row receives the gate clock signals GCK1 and GCK2 via its clock terminals CK and CKB, respectively, from the control circuit 50 (see FIG. 1), and receives a shift register output SRBOn from the previous row (the nth row) via its set terminal S as a set signal for the shift register circuit SRn+1. The shift register circuit SRn+1 has its output terminal out connected to the set terminal S of the shift register circuit SRn+2 of the next row (the (n+2)th row). This allows the shift register circuit SRn+1 to output a shift register output SRBOn+1 via its output terminal out as a set signal to the shift register circuit SRn+2. The shift register circuit SRn+1 has its output terminal out connected to the clock terminal CK of the latch circuit CSLn+1 of the current row (the (n+1)th row). This allows the shift register circuit SRn+1 to input a signal SRBOn+1 to the latch circuit CSLn+1.

Further, the shift register output SRBOn from the previous row (the nth row) is both inputted to the shift register circuit SRn+1 and inputted to one input terminal of a NAND circuit of the current row (the (n+1)th row). GCK2 is inputted to the other input terminal of the NAND circuit, and the output from the NAND circuit is outputted as a gate signal Gn+1 to the gate line 12 of the current row (the (n+1)th row) via a buffer.

The latch circuit CSLn+1 in the (n+1)th row receives the polarity signal CMI from the control circuit 50 (see FIG. 1) and the output signal SRBOn+1 from the shift register circuit SRn+1. The latch circuit CSLn+1 has its output terminal OUT connected to the CS bus line 15 of the current row (the (n+1)th row). This allows the latch circuit CSLn+1 to output a CS signal CSOUTn+1 via its output terminal OUT to the CS bus line 15 of the current row.

Figure 16:
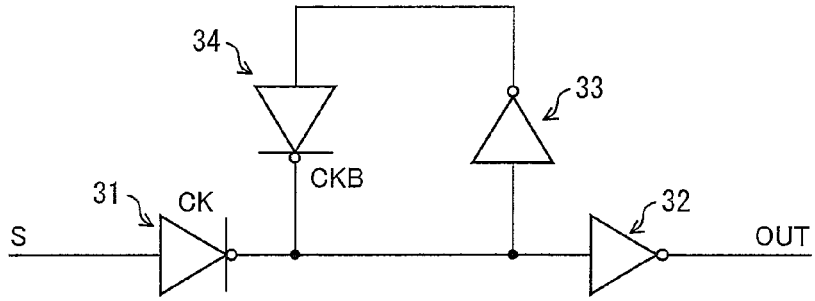
FIG. 16 shows a configuration of a shift register circuit in Embodiment 3.

The following explains operation of each shift register circuit SR. FIG. 16 shows the shift register circuits SRn in the nth row in detail. It should be noted that the shift register circuit SR in each row is identical in configuration to the shift register circuits SRn.

As shown in FIG. 16, the shift register circuit SRn, constituted by two inverters 32 and 33 and two clocked inverters 31 and 34, functions as a D latch circuit. As described above, the shift register circuit SRn receives the shift register output SRBOn−1 via its set terminal S from the previous row (the (n−1)th row) as a set signal, receives a clock signal CK (GCK2) via its clocked inverter 31, and receives a clock signal CKB (GCK1) via its clocked inverter 34. The shift register circuit SRn has its output terminal OUT connected to the clock terminal CK (see FIG. 15) of the latch circuit CSLn of the current row (the nth row) and to the set terminal S of the shift register circuit SRn+1 of the next row (the (n+1)th row).

Figure 17:
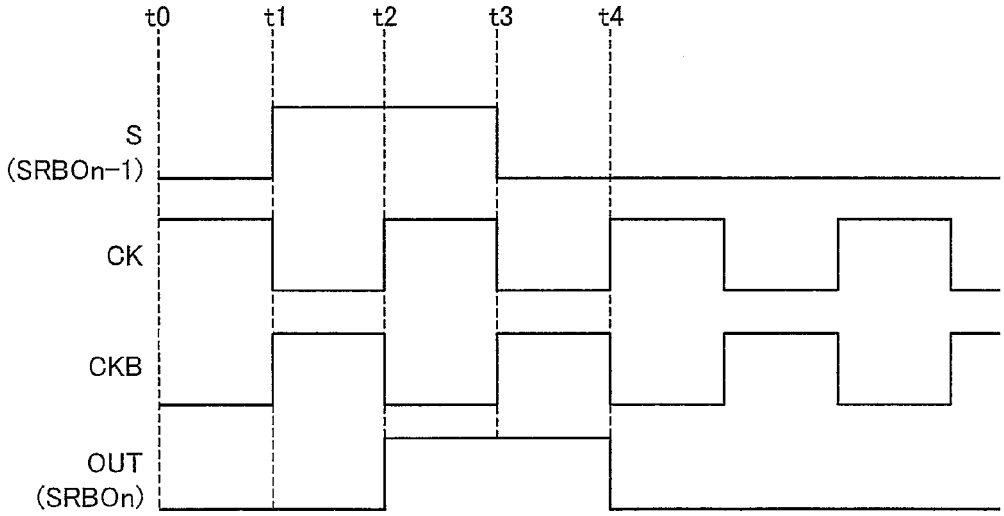
FIG. 17 is a timing chart showing waveforms of various signals that are inputted to and outputted from the shift register circuit shown in FIG. 16.

Operation of the shift register circuit SRn is described below. FIG. 17 is a timing chart showing waveforms of various signals that are inputted to and outputted from the shift register circuit SRn. First, the set signal S (output signal SRBOn−1) is inputted to the shift register circuit SRn. It should be noted here that while the clock signal CK is at a high level (t0 to t1), the clocked inverter 31 is in an on state, whereby the input signal S at a low level is outputted as an output signal OUT (output signal SRBOn). After the input signal S has changed from a low level to a high level (active) (t1 to t2), the clock signal CK is dropped to a low level and the clock signal CKB is raised to a high level; therefore, the clocked inverter 31 is brought into an off state and the clocked inverter 34 is brought into an on state. This allows the shift register circuit SRn to retain a low level and the output signal OUT to be maintained at a low level.

After half a clock has elapsed since t1 (t2), the clock signal CK changes from a low level to a high level and the clock signal CKB changes from a high level to a low level. Then, the clocked inverter 34 comes into an off state and the clocked inverter 31 comes into an on state. This allows the input signal S to be outputted and the output signal OUT to change from a low level to a high level. Then, when the clock signal CK changes from a high level to a low level and the clock signal CKB changes from a low level to a high level (t3), the clocked inverter 31 comes into an off state and the clocked inverter 34 comes into an on state. This allows the shift register circuit SRn to retain a high level and the output signal OUT to maintain at a high level. In a period (t3 to t4) during which the clock signal CKB is at a high level, the output signal OUT maintains a high level. Next, when the clock signal CKB changes from a high level to a low level and the clock signal CK changes from a low level to a high level (t4), the clocked inverter 31 comes into an on state and the clocked inverter 34 comes into an off state. This allows the input signal S to be outputted and the output signal OUT to change from a high level to a low level.

The output signal OUT (output signal SRBOn) thus generated lags the input signal S (output signal SRBOn−1) by half a clock (1H). This output signal OUT (output signal SRBOn) is a 2H-width signal obtained by combining the clock signals CK and CKB together. Moreover, the output signal OUT (control signal) is both inputted to the latch circuit CSLn of the current row (the nth row) and inputted as the input signal S to the shift register circuit SRn+1 of the next row (the (n+1)th row). Each shift register circuit SR carries out a shift operation in sequence on the basis of a signal OUT (output signal SRBO) outputted in each row.

Figure 18:
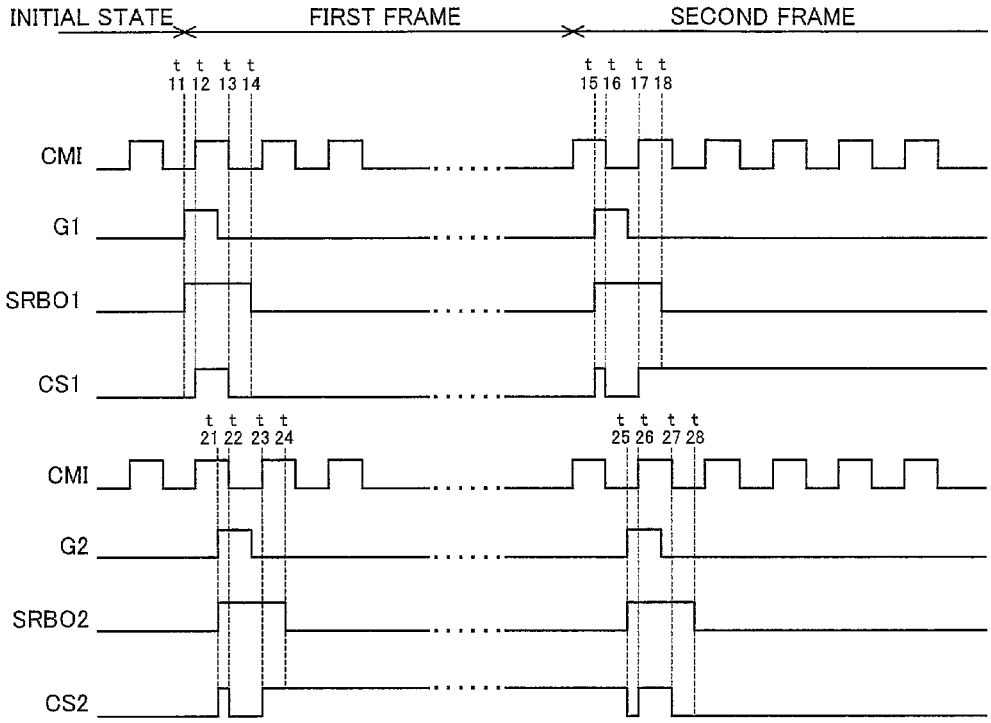
FIG. 18 is a timing chart showing waveforms of various signals that are inputted to and outputted from D latch circuits in Embodiment 3.

The following explains operation of each latch circuit CSL. The latch circuit CSL in each row is identical in configuration to that shown in FIG. 7. The following explanation refers to the latch circuit CSL as the D latch circuit CSL. FIG. 18 is a timing chart showing waveforms of various signals that are inputted to and outputted from the latch circuit CSLn. FIG. 18 shows, as an example, a timing chart in the D latch circuit CSL1 in the first row and the D latch circuit CSL2 in the second row.

First, changes in waveform of various signals in the first row are described.

In the initial state, the D latch circuit CSL1 receives a reset signal RESET via its terminal CL (see FIG. 7). By this reset signal RESET, the potential of the CS signal CS1 that the latch circuit CSL1 outputs via its output terminal OUT is retained at a low level.

When, in the first frame, the gate line driving circuit 30 supplies a gate signal G1 to the gate line 12 in the first row, the D latch circuit CSL1 receives via its clock terminal CK (see FIG. 7) an output signal SRBO1 outputted from the shift register circuit SR1. Upon receiving a change in potential of the output signal SRBO1 (from low to high; t11), the D latch circuit CSL1 transfers an input state of the polarity signal CMI that it received via its input terminal D (see FIG. 7) at the point in time, i.e., transfers a low level, and outputs the change in potential of the polarity signal CMI until the next time when there is a change in potential of the output signal SRBO1 (from high to low; t14) that the D latch circuit CSL1 receives via its clock terminal CK (i.e., during a period of time in which the output signal SRBO1 is at a high level). When the polarity signal CMI changes from a low level to a high level during the period of time in which the output signal SRBO1 is at a high level (t12), the D latch circuit CSL1 switches its output CS1 from a low level to a high level. After that, when the polarity signal CMI change from a high level to a low level (t13), the D latch circuit CSL1 switches its output CS1 from a high level to a low level. Next, upon receiving a change in potential of the output signal SRBO1 (from high to low) via its clock terminal CK (t14), the D latch circuit CSL1 latches an input state of the polarity signal CMI that it received at the point in time, i.e., latches a low level. After that, the D latch circuit CSL1 retains its output CS1 at a low level until there is a change in potential of the output signal SRBO1 in the second frame.

When, in the second frame, the gate line driving circuit 30 similarly supplies a gate signal G1 to the gate line 12 in the first row, the D latch circuit CSL1 receives via its clock terminal CK an output signal SRBO1 outputted from the shift register circuit SR1. When the output signal SRBO1 changes from a low level to a high level (t15), the D latch circuit CSL1 transfers an input state of the polarity signal CMI that it received via its input terminal D at the point in time, i.e., transfers a high level. The D latch circuit CSL1 outputs the change in potential of the polarity signal CMI during a period of time in which the output signal SRBO1 is at a high level (t15 to t18). Therefore, when the polarity signal CMI changes from a high level to a low level (t16), the D latch circuit CSL1 switches its output CS1 from a high level to a low level. After that, when the polarity signal CMI changes from a low level to a high level (t17), the D latch circuit CSL1 switches its output CS1 from a low level to a high level. Next, upon receiving a change in potential of the output signal SRBO1 (from high to low; t18) via its clock terminal CK, the D latch circuit CSL1 latches an input state of the polarity signal CMI that it received at the point in time, i.e., latches a high level. After that, the D latch circuit CSL1 retains its output CS1 at a high level until there is a change in potential of the output signal SRBO1 in the third frame.

The CS signal CS1 thus generated is supplied to the CS bus line 15 of the first row. It should be noted that the output in the third frame takes a waveform obtained by reversing the potential level of the output waveform in the second frame, and in the fourth frame and later, signals identical in output waveform to those in the second and third frames are alternately outputted.

Next, changes in waveform of various signals in the second row are described.

In the initial state, the D latch circuit CSL2 receives the reset signal RESET via its terminal CL. By this reset signal RESET, the potential of the CS signal CS2 that the latch circuit CSL2 outputs via its output terminal OUT is retained at a low level.

When, in the first frame, the gate line driving circuit 30 supplies a gate signal G2 to the gate line 12 in the second row, the D latch circuit CSL2 receives via its clock terminal CK an output signal SRBO2 outputted from the shift register circuit SR2. Upon receiving a change in potential of the output signal SRBO2 (from low to high; t21), the D latch circuit CSL2 transfers an input state of the polarity signal CMI that it received via its input terminal D at the point in time, i.e., transfers a high level, and outputs the change in potential of the polarity signal CMI until the next time when there is a change in potential of the output signal SRBO2 (from low to high; t24) that the D latch circuit CSL2 receives via its clock terminal CK (i.e., during a period of time in which the output signal SRBO2 is at a high level; t21 to t24). When the polarity signal CMI changes from a high level to a low level during the period of time in which the output signal SRBO2 is at a high level (t22), the D latch circuit CSL2 switches its output CS2 from a high level to a low level. After that, when the polarity signal CMI changes from a low level to a high level (t23), the D latch circuit CSL2 switches its output CS2 from a low level to a high level. Next, upon receiving a change in potential of the output signal SRBO2 (from high to low; t24) via its clock terminal CK, the D latch circuit CSL2 latches an input state of the polarity signal CMI that it received at the point in time, i.e., latches a high level. After that, the D latch circuit CSL2 retains its output CS2 at a high level until there is a change in potential of the output signal SRBO2 in the second frame.

When, in the second frame, the gate line driving circuit 30 similarly supplies a gate signal G2 to the gate line 12 in the second row, the D latch circuit CSL2 receives via its clock terminal CK an output signal SRBO2 outputted from the shift register circuit SR2. When the output signal SRBO2 changes from a low level to a high level (t25), the D latch circuit CSL2 transfers an input state of the polarity signal CMI that it received via its input terminal D at the point in time, i.e., transfers a low level. The D latch circuit CSL2 outputs the change in potential of the polarity signal CMI during a period of time in which the output signal SRBO2 is at a high level (t25 to t28). Therefore, when the polarity signal CMI changes from a low level to a high level (t26), the D latch circuit CSL2 switches its output CS2 from a low level to a high level. After that, when the polarity signal CMI changes from a high level to a low level (t27), the D latch circuit CSL2 switches its output CS2 from a high level to a low level. Next, upon receiving a change in potential of the output signal SRBO2 (from high to low; t28) via its clock terminal CK, the D latch circuit CSL2 latches an input state of the polarity signal CMI that it received at the point in time, i.e., latches a low level. After that, the D latch circuit CSL2 retains its output CS2 at a low level until there is a change in potential of the output signal SRBO2 in the third frame.

The CS signal CS2 thus generated is supplied to the CS bus line 15 of the second row. It should be noted that in the third frame and later, signals identical in output waveform to those in the first and second frames are alternately outputted.

Moreover, the operations in the first and second rows correspond to operations in each odd-numbered row and each even-numbered row.

Thus, the D latch circuits CSL1, CSL2, CSL3, . . . , which correspond to their respective rows, output CS signals so that in all the frames that include the first frame, the potentials of the CS signals at points in time where the gate signals in their corresponding rows fall (at points in time where the TFTs 13 are switched from on to off) differ from one row to an adjacent row. This brings about the same effects as those brought about by Embodiment 1.

Further, the configuration of Embodiment 3 causes an output signal SRBO from the shift register circuit SRn to be inputted directly to the D latch circuit CSLn of the same row (the nth row), whereby a proper CS signal CSn is generated which allows eliminating the appearance of such transverse stripes. As in Embodiment 1, this allows a reduction in circuit area as compared with the conventional configuration, thus allowing achieving a small-sized liquid crystal display device and a liquid crystal display panel with a narrow frame, both with high display quality.

Embodiment 4

Another embodiment of the present invention is described below with reference to FIGS. 29 and 30. It should be noted that those members which have the same functions as those described above in Embodiment 1 are given the same reference numerals and are not described below. Further, those terms defined in Embodiment 1 are defined in the same way in the present embodiment unless otherwise noted.

Figure 29:
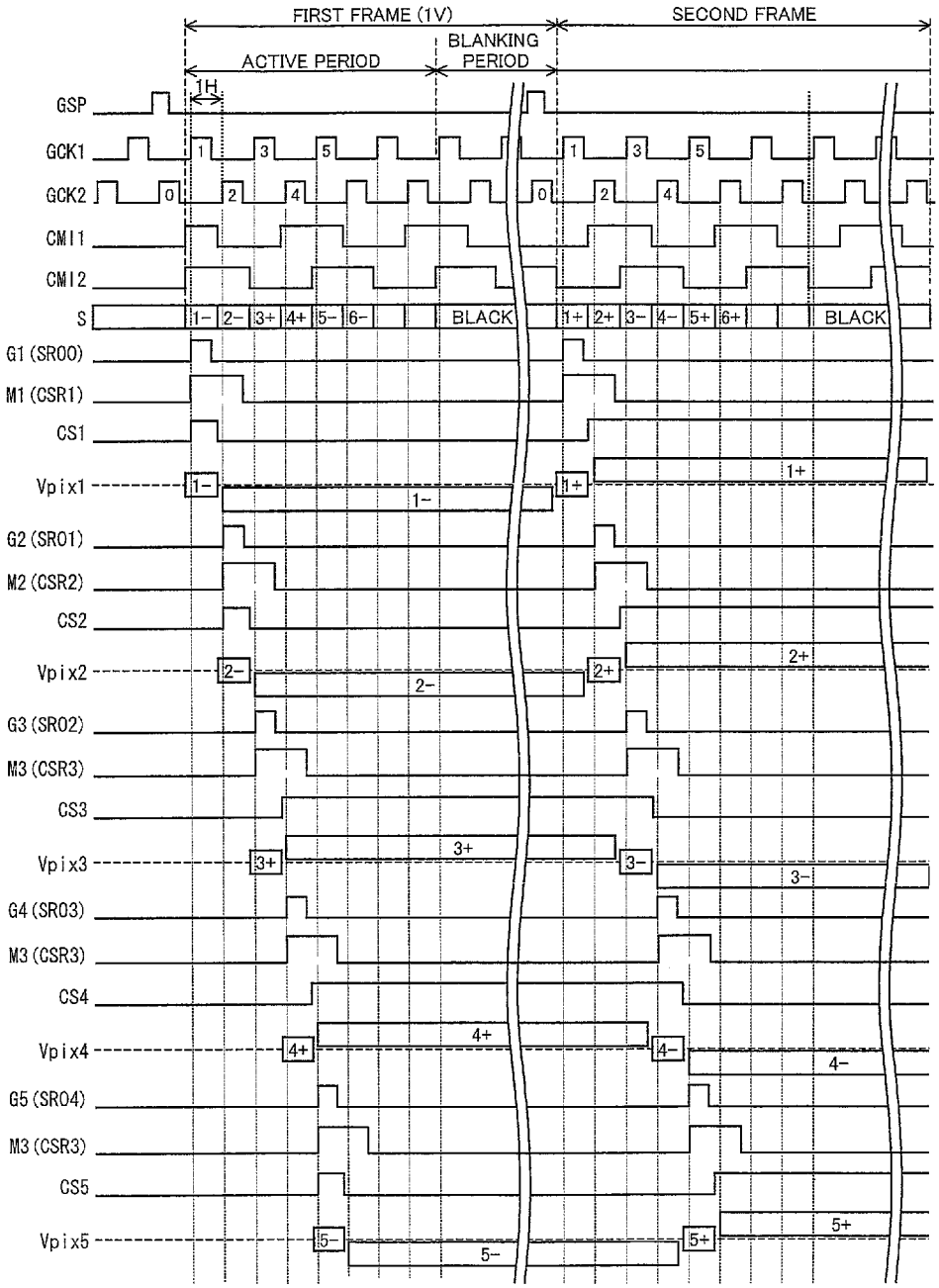
FIG. 29 is a timing chart showing waveforms of various signals of the liquid crystal display device in Embodiment 4.

FIG. 29 is a timing chart showing waveforms of various signals in a liquid crystal display device 1 of Embodiment 4. In Embodiment 4, 2-line (2H) inversion driving is carried out, and the source signal S reverses its polarity every single frame (one frame inversion). In FIG. 29, as in FIG. 22, GSP is a gate start pulse signal that defines a timing of vertical scanning, and GCK1 (CK) and GCK2 (CKB) are gate clock signals that are outputted from the control circuit 50 to define a timing of operation of the shift register. A period from a falling edge to the next falling edge in GSP corresponds to a single vertical scanning period (1V period). A period from a rising edge in GCK1 to a rising edge in GCK2 and a period from a rising edge GCK2 to a rising edge in GCK1 each correspond to a single horizontal scanning period (1H period). CMI1 and CMI2 are each a polarity signal that reverses its polarity every two horizontal scanning periods, and are out of phase with each other by a single horizontal scanning period.

Further, FIG. 29 shows the following signals in the order named: a source signal S (video signal), which is supplied from the source bus line driving circuit 20 to a source bus line 11 (source bus line 11 provided in the xth column); a gate signal G1, which is supplied from the gate line driving circuit 30 to a gate line 12 provided in the first row; a CS signal CS1, which is supplied from the CS bus line driving circuit 40 to a CS bus line 15 provided in the first row; and a potential waveform Vpix1 of a pixel electrode 14 provided in the first row and the xth column. FIG. 29 shows the following signals in the order named: a gate signal G2, which is supplied to a gate line 12 provided in the second row; a CS signal CS2, which is supplied to a CS bus line 15 provided in the second row; and a potential waveform Vpix2 of a pixel electrode 14 provided in the second row and the xth column. FIG. 29 shows the following signals in the order named: a gate signal G3, which is supplied to a gate line 12 provided in the third row; a CS signal CS3, which is supplied to a CS bus line 15 provided in the third row; and a potential waveform Vpix3 of a pixel electrode 14 provided in the third row and the xth column. As to the fourth and fifth rows, FIG. 29 similarly shows a gate signal G4, a CS signal CS4, and a potential waveform Vpix4 in the order named and a gate signal G5, a CS signal CS5, and a potential waveform Vpix5 in the order named.

It should be noted that the dotted lines in the potentials Vpix1, Vpix2, Vpix3, Vpix4, and Vpix5 indicate the potential of the counter electrode 19.

In the following, it is assumed that the start frame of a display picture is a first frame and that the first frame is preceded by an initial state. As shown in FIG. 29, during an initial state, the CS signals CS1 to CS5 are all fixed at one potential (in FIG. 29, at a low level). In the first frame, the CS signal CS1 in the first row is at a high level at a point in time where the corresponding gate signals G1 (which corresponds to the output SRBO0 from the corresponding shift register circuit SR0) falls. The CS signal CS2 in the second row is at a high level at a point in time where the corresponding gate signals G2 falls. The CS signal CS3 in the third row is at a low level at a point in time where the corresponding gate signals G3 falls. The CS signal CS4 in the fourth row is at a low level at a point in time where the corresponding gate signals G4 falls. The CS signal CS5 in the fifth row is at a high level at a point in time where the corresponding gate signals G5 falls.

It should be noted that the source signal S is a signal which has amplitude corresponding to a gray scale represented by a video signal and which reverses its polarity every two horizontal scanning period (2H). Further, since it is assumed in FIG. 29 that a uniform picture is displayed, the amplitude of the source signal S is constant. Meanwhile, the gate signals G1 to G5 serve as gate-on potentials during the first to fifth 1H periods, respectively, in an active period (effective scanning period) of each frame, and serve as gate-off potentials during the other periods.

Then, the CS signals CS1 to CS5 switch between high and low potential levels after their corresponding gate signals G1 to G5 fall. Specifically, in the first frame, the CS signals CS1 and CS2 fall after their corresponding gate signals G1 and G2 fall, respectively, and the CS signals CS3 and CS4 rises after its corresponding signals G3 and G4 falls, respectively. It should be noted that in the second frame, this relationship is reversed, i.e., the CS signals CS1 and CS2 rise after their corresponding gate signals G1 and G2 fall, respectively, and the CS signals CS3 and CS4 falls after its corresponding gate signals G3 and G4 fall, respectively.

Thus, in the 2H inversion driven liquid crystal display device 1, the potential of each CS signal at a point in time where the gate signal falls varies every two rows in correspondence with the polarity of the source signal S; therefore, in the first frame, the potentials Vpix1 to Vpix5 of the pixel electrodes 14 are all properly shifted by the CS signals CS1 to CS5, respectively. Therefore, inputting of source signals S of the same gray scale causes the positive and negative potential differences between the potential of the counter electrode and the shifted potential of each of the pixel electrodes 14 to be equal to each other. That is, in the first frame, in which a source signal of a negative polarity is written into pixels corresponding to two adjacent rows in the same column of pixels and a source signal of a positive polarity is written into pixels corresponding to two adjacent pixels next to the two rows in the same column of pixels, the potentials of the CS signals corresponding to the first two rows are not polarity-reversed during the writing into the pixels corresponding to the first two rows, are polarity-reversed in a negative direction after the writing, and are not polarity-reversed until the next writing, and the potentials of the CS signals corresponding to the next two rows are not polarity-reversed during the writing into the pixels corresponding to the next two rows, are polarity-reversed in a positive direction after the writing, and are not polarity-reversed until the next writing. This results in elimination of appearance of transverse stripes every two rows in the first frame, thus allowing an improvement in display quality.

A specific configuration of the gate line driving circuit 30 and the CS bus line driving circuit 40 for achieving the aforementioned control is described here. FIG. 30 shows a configuration of the gate line driving circuit 30 and the CS bus line driving circuit 40. In the following, for convenience of explanation, the row (line) (next row) following the nth row in a scanning direction (indicated by an arrow in FIG. 30) is represented as the (n+1)th row, and the row (previous row) immediately preceding the nth row in the scanning direction is represented as the (n−1)th row.

Figure 30:
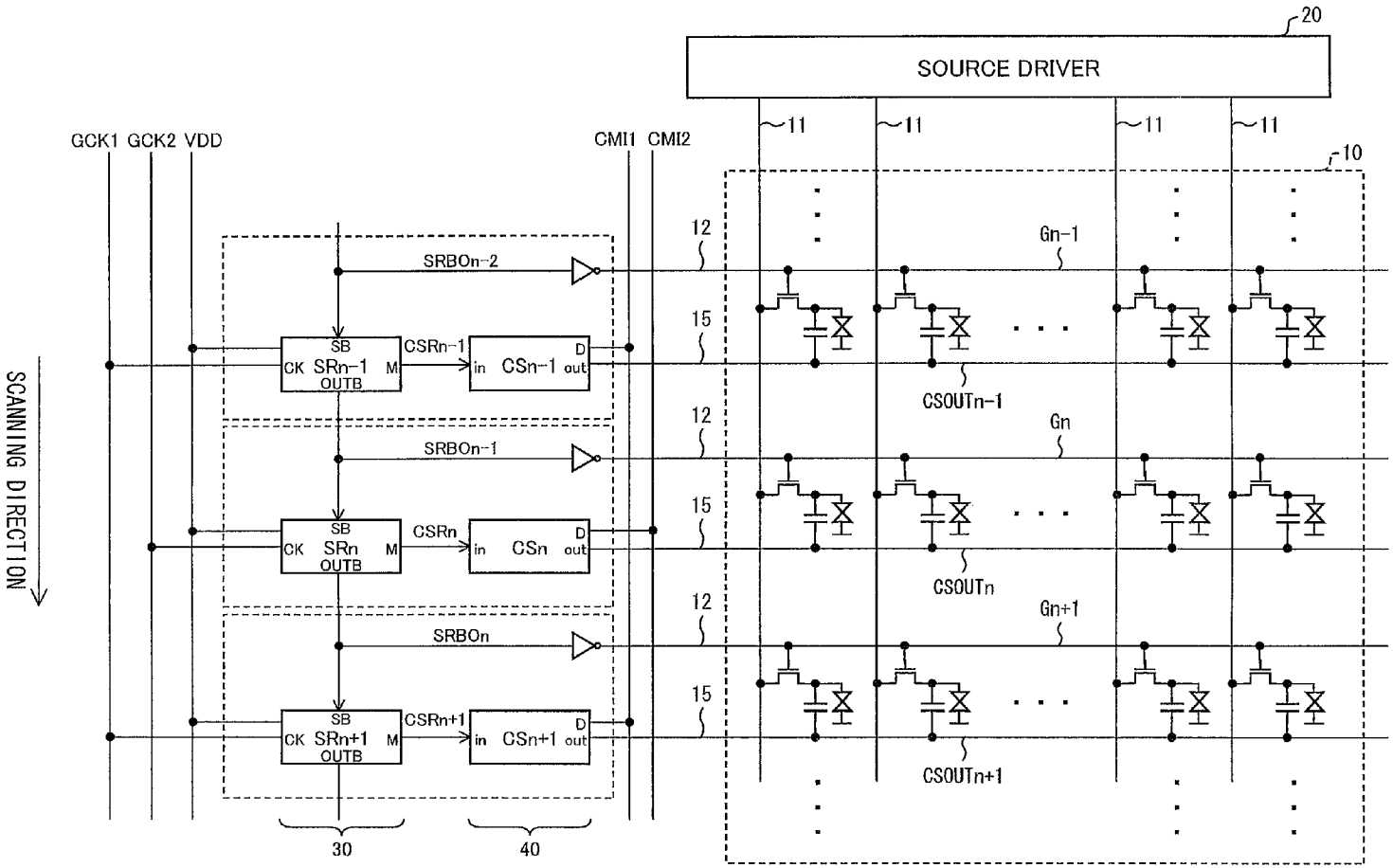
FIG. 30 shows a configuration of a gate line driving circuit 30 and a CS bus line driving circuit 40 in Embodiment 4.

As shown in FIG. 30, the gate line driving circuit 30 has a plurality of shift register circuits SR (stages of a shift register) corresponding to their respective rows, and the CS bus line driving circuit 40 has a plurality of latch circuits CSL corresponding to their respective rows. For convenience of explanation, the shift register circuits SRn−1, SRn, and SRn+1 and the latch circuits CSLn−1, CSLn, and CSLn+1, which correspond to the (n−1)th, nth, and (n+1)th rows respectively, are taken as an example here.

The shift register circuit SRn−1 in the (n−1)th row receives the gate clock signal GCK1 via its clock terminal CK from the control circuit 50 (see FIG. 1), and receives a shift register output SRBOn−2 from the previous row (the (n−2)th row) via its set terminal SB as a set signal for the shift register circuit SRn−1. The shift register circuit SRn−1 has its output terminal OUTB connected to the set terminal SB of the shift register circuit SRn of the next row (the nth row). This allows the shift register circuit SRn−1 to output a shift register output SRBOn−1 via its output terminal OUTB to the shift register circuit SRn. The shift register circuit SRn−1 has its output terminal M, connected to the clock terminal CK of the latch circuit CSLn−1 of the current row (the (n−1)th row), via which a signal M generated inside of the shift register circuit SRn−1 is outputted. This allows the shift register circuit SRn−1 to input its internal signal Mn−1 (signal CSRn−1) to the latch circuit CSLn−1.

Further, the shift register output SRBOn−2 from the previous row (the (n−2)th row) is both inputted to the shift register circuit SRn−1 and outputted as a gate signal Gn−1 to the gate line 12 of the current row (the (n−1)th row) via a buffer. Further, the shift register circuit SRn−1 is supplied with a power supply (VDD).

The latch circuit CSLn−1 in the (n−1)th row, constituted as a D latch circuit, receives the polarity signal CMI1 from the control circuit 50 (see FIG. 1) and the internal signal Mn−1 (signal CSRn−1) from the shift register circuit SRn−1. The latch circuit CSLn−1 has its output terminal OUT connected to the CS bus line 15 of the current row (the (n−1)th row). This allows the latch circuit CSLn−1 to output a CS signal CSOUTn−1 via its output terminal OUT to the CS bus line 15 of the current row (the (n−1)th row).

The shift register circuit SRn in the nth receives the gate clock signal GCK2 row via its clock terminal CK from the control circuit 50 (see FIG. 1), and receives a shift register output SRBOn−1 from the previous row (the (n−1)th row) via its set terminal SB as a set signal for the shift register circuit SRn. The shift register circuit SRn has its output terminal OUTB connected to the set terminal SB of the shift register circuit SRn+1 of the next row (the (n+1)th row). This allows the shift register circuit SRn to output a shift register output SRBOn via its output terminal OUTB to the shift register circuit SRn+1. The shift register circuit SRn has its output terminal M connected to the clock terminal CK of the latch circuit CSLn of the current row (the nth row). This allows the shift register circuit SRn to input its internal signal Mn (signal CSRn) to the latch circuit CSLn.

Further, the shift register output SRBOn−1 from the previous row (the (n−1)th row) is both inputted to the shift register circuit SRn and outputted as a gate signal Gn to the gate line 12 of the current row (the nth row) via a buffer. Further, the shift register circuit SRn is supplied with the power supply (VDD).

The latch circuit CSLn in the nth row, constituted as a D latch circuit, receives the polarity signal CMI2 from the control circuit 50 (see FIG. 1) and the internal signal Mn (signal CSRn) generated inside of the shift register circuit SRn. The latch circuit CSLn has its output terminal OUT connected to the CS bus line 15 of the current row (the nth row). This allows the latch circuit CSLn to output a CS signal CSOUTn via its output terminal OUT to the CS bus line 15 of the current row.

The shift register circuit SRn+1 in the (n+1)th row receives the gate clock signal GCK1 via its clock terminal CK from the control circuit 50 (see FIG. 1), and receives a shift register output SRBOn from the previous row (the nth row) via its set terminal SB as a set signal for the shift register circuit SRn+1. The shift register circuit SRn+1 has its output terminal OUTB connected to the set terminal SB of the shift register circuit SRn+2 of the next row (the (n+2)th row). This allows the shift register circuit SRn+1 to output a shift register output SRBOn+1 via its output terminal OUTB to the shift register circuit SRn+2. The shift register circuit SRn+1 has its output terminal M connected to the clock terminal CK of the latch circuit CSLn+1 of the current row (the (n+1)th row). This allows the shift register circuit SRn+1 to input its internal signal Mn+1 (signal CSRn+1) to the latch circuit CSLn+1.

Further, the shift register output SRBOn from the previous row (the nth row) is both inputted to the shift register circuit SRn+1 and outputted as a gate signal Gn+1 to the gate line 12 of the current row (the (n+1)th row) via a buffer. Further, the shift register circuit SRn+1 is supplied with the power supply (VDD).

The latch circuit CSLn+1 in the (n+1)th row, constituted as a D latch circuit, receives the polarity signal CMI1 from the control circuit 50 (see FIG. 1) and the internal signal Mn+1 (signal CSRn+1) generated inside of the shift register circuit SRn+1. The latch circuit CSLn+1 has its output terminal OUT connected to the CS bus line 15 of the current row (the (n+1)th row). This allows the latch circuit CSLn+1 to output a CS signal CSOUTn+1 via its output terminal OUT to the CS bus line 15 of the current row.

Operation of each shift register circuit SR is identical to the operation shown in FIGS. 5 and 6 and, as such, is not described here.

The following explains operation of each latch circuit CSL with reference to FIG. 29. FIG. 29 shows, as an example, waveforms that are inputted to and outputted from the D latch circuits CL1 to CL5 in the first to fifth rows. First, changes in waveform of various signals in the first row are described. The D latch circuit CSL shown below is identical in configuration to that shown in FIG. 7.

In the initial state, the D latch circuit CSL1 receives a reset signal RESET via its terminal CL. By this reset signal RESET, the potential of the CS signal CS1 that the latch circuit CSL1 outputs via its output terminal OUT is retained at a low level.

When, in the first frame, the gate line driving circuit 30 supplies a gate signal G1 (which corresponds to an output SRO0 from the shift register circuit SR0) to the gate line 12 in the first row, the D latch circuit CSL1 receives via its clock terminal CK an internal signal M1 (signal CSR1) generated by the shift register circuit SR1. Upon receiving a change in potential of the internal signal M1 (from low to high), the D latch circuit CSL1 transfers an input state of the polarity signal CMI1 that it received via its input terminal D at the point in time, i.e., transfers a high level, and outputs the change in potential of the polarity signal CMI1 until the next time when there is a change in potential of the internal signal M1 (from high to low) that the D latch circuit CSL1 receives via its clock terminal CK (i.e., during a period of time in which the internal signal M1 is at a high level). When the polarity signal CMI1 changes from a high level to a low level during the period of time in which the internal signal M1 is at a high level, the D latch circuit CSL1 switches its output CS1 from a high level to a low level. Next, upon receiving a change in potential of the internal signal M1 (from high to low) via its clock terminal CK, the D latch circuit CSL1 latches an input state of the polarity signal CMI1 that it received at the point in time, i.e., latches a low level. After that, the D latch circuit CSL1 retains its output CS1 at a low level until there is a change in potential of the internal signal M1 in the second frame (from low to high).

When, in the second frame, the gate line driving circuit 30 similarly supplies a gate signal G1 to the gate line 12 in the first row, the D latch circuit CSL1 receives via its clock terminal CK an internal signal M1 (signal CSR1) generated by the shift register circuit SR1. When the internal signal M1 changes from a low level to a high level, the D latch circuit CSL1 transfers an input state of the polarity signal CMI1 that it received via its input terminal D at the point in time, i.e., transfers a low level. The D latch circuit CSL1 outputs the change in potential of the polarity signal CMI1 during a period of time in which the internal signal M1 is at a high level. Therefore, when the polarity signal CMI1 changes from a low level to a high level, the D latch circuit CSL1 switches its output CS1 from a low level to a high level. Next, upon receiving a change in potential of the internal signal M1 (from high to low) via its clock terminal CK, the D latch circuit CSL1 latches an input state of the polarity signal CMI1 that it received at the point in time, i.e., latches a high level. After that, the D latch circuit CSL1 retains its output CS1 at a high level until there is a change in potential of the internal signal M1 in the third frame.

The CS signal CS1 thus generated is supplied to the CS bus line 15 of the first row. It should be noted that the output in the third frame takes a waveform obtained by reversing the potential level of the output waveform in the second frame, and in the fourth frame and later, signals identical in output waveform to those in the second and third frames are alternately outputted.

Next, changes in waveform of various signals in the second row are described.

In the initial state, the D latch circuit CSL2 receives the reset signal RESET via its terminal CL. By this reset signal RESET, the potential of the CS signal CS2 that the D latch circuit CSL2 outputs via its output terminal OUT is retained at a low level.

When, in the first frame, the gate line driving circuit 30 supplies a gate signal G2 (which corresponds to an output SRO1 from the shift register circuit SR1) to the gate line 12 in the first row, the D latch circuit CSL2 receives via its clock terminal CK an internal signal M2 (signal CSR2) generated by the shift register circuit SR2. Upon receiving a change in potential of the internal signal M2 (from low to high), the D latch circuit CSL2 transfers an input state of the polarity signal CMI2 that it received via its input terminal D at the point in time, i.e., transfers a high level, and outputs the change in potential of the polarity signal CMI2 until the next time when there is a change in potential of the internal signal M2 (from high to low) that the D latch circuit CSL2 receives via its clock terminal CK (i.e., during a period of time in which the internal signal M2 is at a high level). When the polarity signal CMI2 changes from a high level to a low level during the period of time in which the internal signal M2 is at a high level, the D latch circuit CSL2 switches its output CS2 from a high level to a low level. Next, upon receiving a change in potential of the internal signal M2 (from high to low) via its clock terminal CK, the D latch circuit CSL2 latches an input state of the polarity signal CMI2 that it received at the point in time, i.e., latches a low level. After that, the D latch circuit CSL2 retains its output CS2 at a low level until there is a change in potential of the internal signal M2 in the second frame (from low to high).

When, in the second frame, the gate line driving circuit 30 similarly supplies a gate signal G2 to the gate line 12 in the second row, the D latch circuit CSL2 receives via its clock terminal CK an internal signal M2 (signal CSR2) generated by the shift register circuit SR2. When the internal signal M2 changes from a low level to a high level, the D latch circuit CSL2 transfers an input state of the polarity signal CMI2 that it received via its input terminal D at the point in time, i.e., transfers a low level. The D latch circuit CSL2 outputs the change in potential of the polarity signal CMI2 during a period of time in which the internal signal M2 is at a high level. Therefore, when the polarity signal CMI2 changes from a low level to a high level, the D latch circuit CSL2 switches its output CS2 from a low level to a high level. Next, upon receiving a change in potential of the internal signal M2 (from high to low) via its clock terminal CK, the D latch circuit CSL2 latches an input state of the polarity signal CMI2 that it received at the point in time, i.e., latches a high level. After that, the D latch circuit CSL2 retains a high level until there is a change in potential of the internal signal M2 in the third frame.

The CS signal CS2 thus generated is supplied to the CS bus line 15 of the second row. It should be noted that the output in the third frame takes a waveform obtained by reversing the potential level of the output waveform in the second frame, and in the fourth frame and later, signals identical in output waveform to those in the second and third frames are alternately outputted.

Next, changes in waveform of various signals in the third row are described.

In the initial state, the D latch circuit CSL3 receives a reset signal RESET via its terminal CL. By this reset signal RESET, the potential of the CS signal CS3 that the D latch circuit CSL3 outputs via its output terminal OUT is retained at a low level.

When, in the first frame, the gate line driving circuit 30 supplies a gate signal G3 (which corresponds to an output SRO2 from the shift register circuit SR2) to the gate line 12 in the third row, the D latch circuit CSL3 receives via its clock terminal CK an internal signal M3 (signal CSR3) generated by the shift register circuit SR3. Upon receiving a change in potential of the internal signal M3 (from low to high), the D latch circuit CSL3 transfers an input state of the polarity signal CMI1 that it received via its input terminal D at the point in time, i.e., transfers a low level, and outputs the change in potential of the polarity signal CMI1 until the next time when there is a change in potential of the internal signal M3 (from high to low) that the D latch circuit CSL3 receives via its clock terminal CK (i.e., during a period of time in which the internal signal M3 is at a high level). When the polarity signal CMI1 changes from a low level to a high level during the period of time in which the internal signal M3 is at a high level, the D latch circuit CSL3 switches its output CS3 from a low level to a high level. Next, upon receiving a change in potential of the internal signal M3 (from high to low) via its clock terminal CK, the D latch circuit CSL3 latches an input state of the polarity signal CMI1 that it received at the point in time, i.e., latches a high level. After that, the D latch circuit CSL3 retains its output CS3 at a high level until there is a change in potential of the internal signal M3 in the second frame (from low to high).

When, in the second frame, the gate line driving circuit 30 similarly supplies a gate signal G3 to the gate line 12 in the third row, the D latch circuit CSL3 receives via its clock terminal CK an internal signal M3 (signal CSR3) generated by the shift register circuit SR3. When the internal signal M3 changes from a low level to a high level, the D latch circuit CSL3 transfers an input state of the polarity signal CMI1 that it received via its input terminal D at the point in time, i.e., transfers a high level. The D latch circuit CSL3 outputs the change in potential of the polarity signal CMI1 during a period of time in which the internal signal M3 is at a high level. Therefore, when the polarity signal CMI1 changes from a high level to a low level, the D latch circuit CSL3 switches its output CS3 from a high level to a low level. Next, upon receiving a change in potential of the internal signal M3 via its clock terminal CK, the D latch circuit CSL3 latches an input state of the polarity signal CMI1 that it received at the point in time, i.e., latches a low level. After that, the D latch circuit CSL3 retains its output CS3 at a low level until there is a change in potential of the internal signal M3 in the third frame.

The CS signal CS3 thus generated is supplied to the CS bus line 15 of the third row. It should be noted that in the third frame and later, signals identical in output waveform to those in the first and second frames are alternately outputted.

Thus, in Embodiment 4, the latch circuits 41, 42, 43, . . . , 4*n*, which correspond to their respective rows, receive the polarity signals CMI1 and CMI2, which each reverses its polarity every two horizontal scanning periods and which are different in phase from each other. This brings about an effect of improving display quality in 2H inversion driving by preventing the generation of transverse stripes in the first frame. Further, as in the case of the 1H inversion driven liquid crystal display device, the effect is brought about without causing an increase in circuit area as compared with a conventional liquid crystal display device.

The liquid crystal display device according to the present embodiment is not limited to 1H inversion driving or 2H inversion driving, and may also be applied to nH inversion driving.

It should be noted here that although Embodiments 1 to 4 is each configured such that the gate line driving circuit 30 and the CS bus line driving circuit 40 are integrally formed and provided on one side of the liquid crystal display panel 10, this does not imply any limitation. The gate line driving circuit 30 and the CS bus line driving circuit 40 may be provided separately. For example, such a configuration is possible that the gate line driving circuit 30 is provided on one side of the liquid crystal display panel 10 and the CS bus line driving circuit 40 on the other side.

Further, although the gate line driving circuit 30 and the CS bus line driving circuit 40 shown in each of Embodiments 1 to 4 are configured to have one scanning direction (e.g., the direction of the arrow in FIG. 4), this does not imply any limitation. The gate line driving circuit 30 and the CS bus line driving circuit 40 may be configured to have an opposite scanning direction or to have a function of switching from one scanning direction to another.

Figure 19:
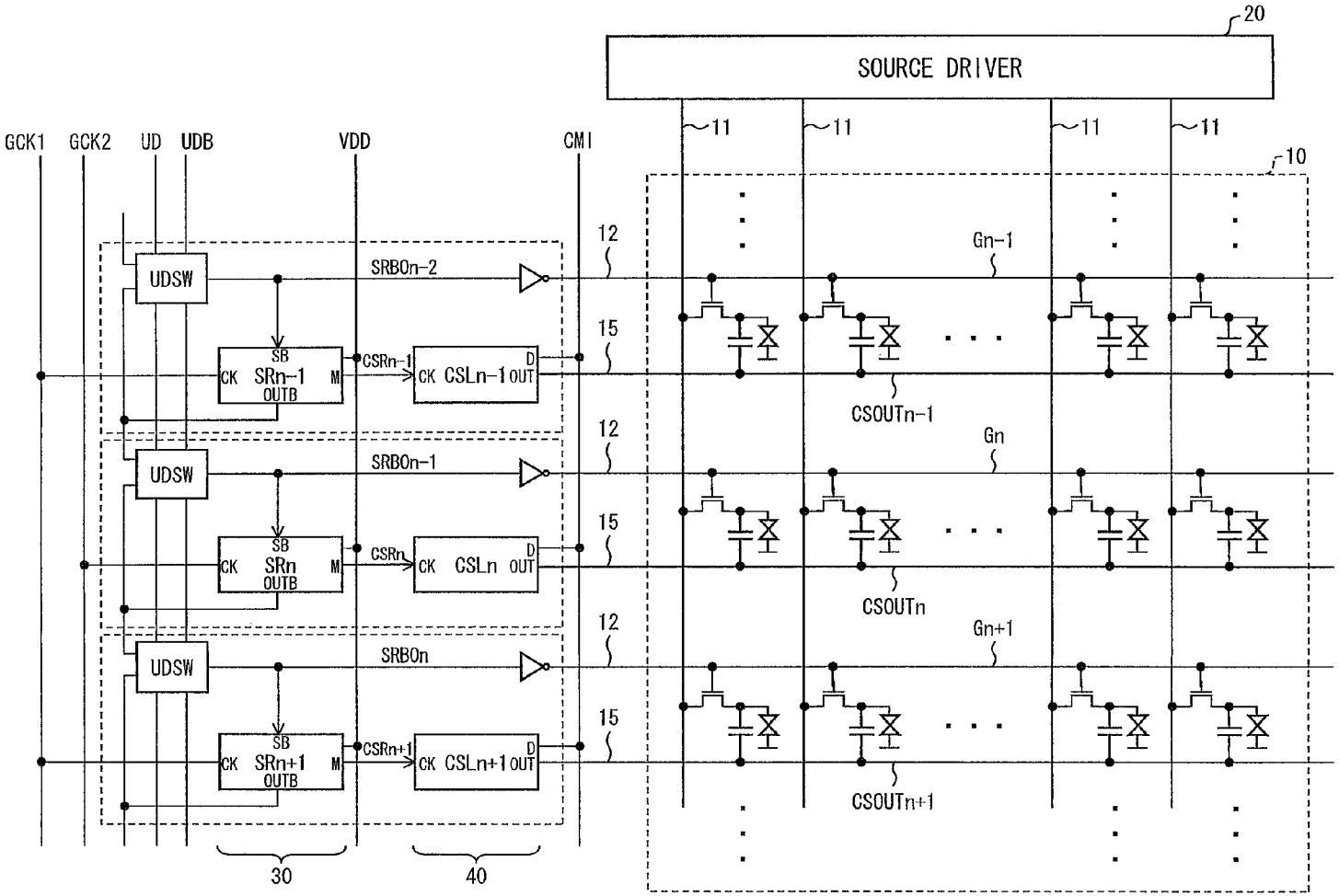
FIG. 19 is a block diagram showing another configuration of a gate line driving circuit and a CS bus line driving circuit in Embodiment 1.
Figure 20:
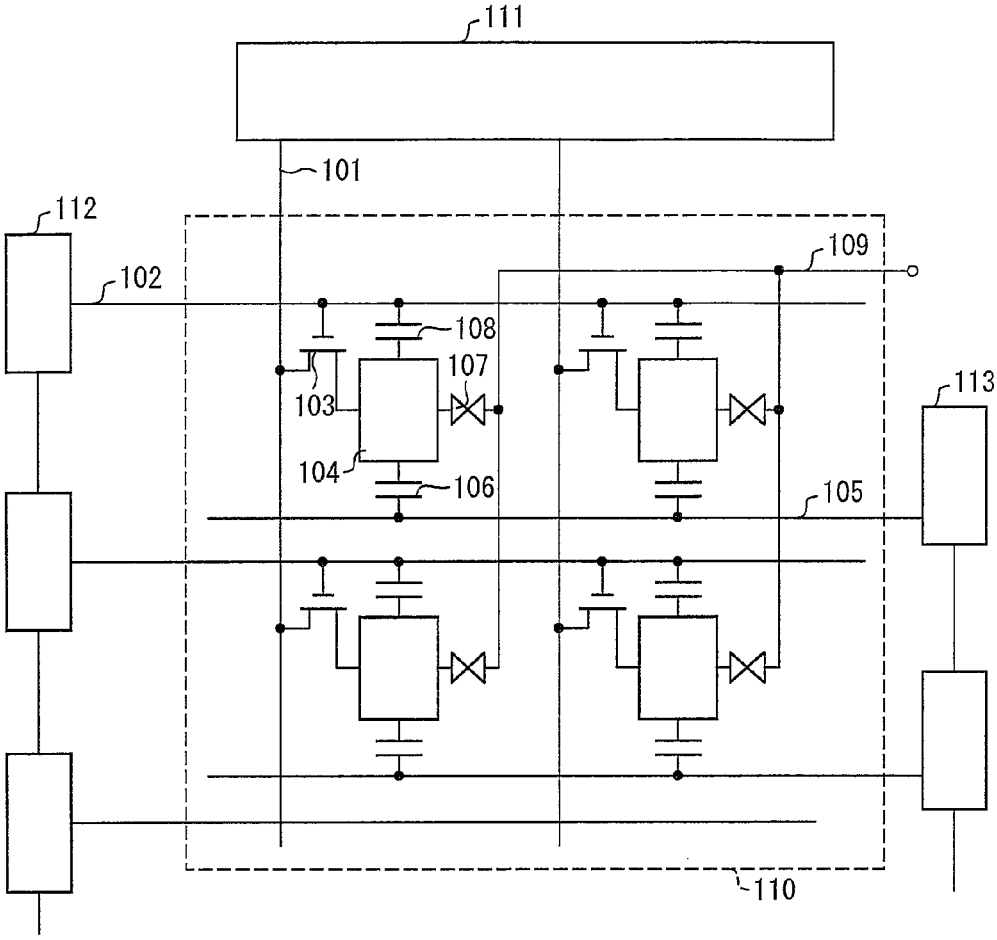
FIG. 20 is a block diagram showing a configuration of a conventional liquid crystal display device that carries out CC driving.
Figure 21:
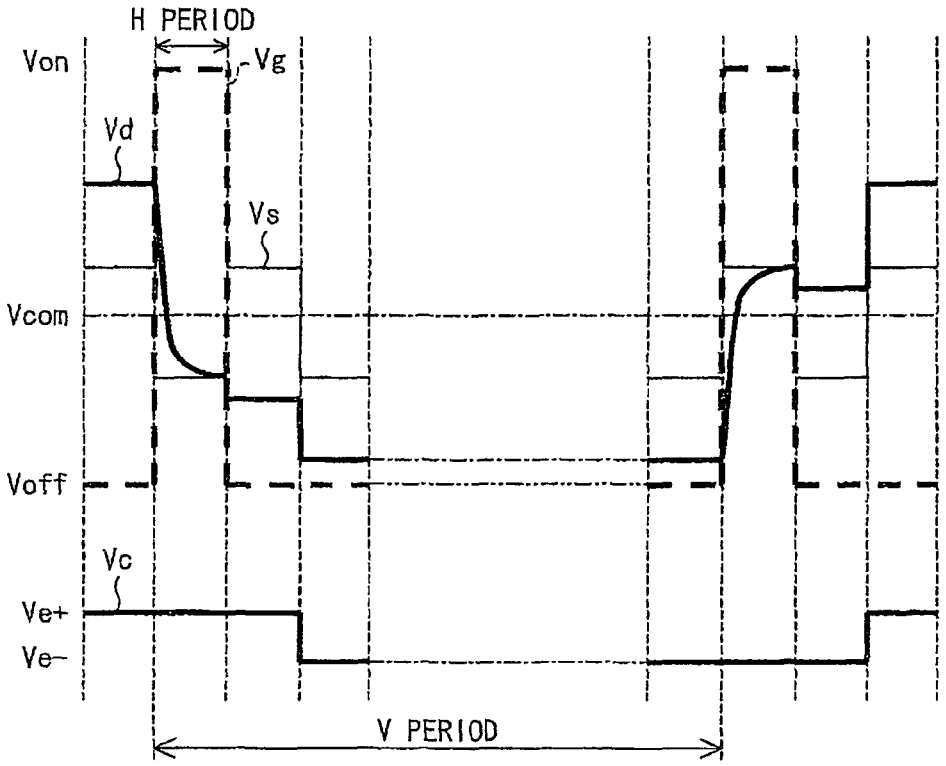
FIG. 21 is a timing chart showing waveforms of various signals in the conventional liquid crystal display device.

FIG. 19 shows a configuration in the liquid crystal display device shown in FIG. 4 that has a function of switching from one scanning direction to another. The liquid crystal display device shown in FIG. 19 has up-and-down switching circuits UDSW corresponding to their respective rows, and each of the up-and-down switching circuits UDSW receives a UD signal and a UDB signal (reversed logic of the UD signal) from the control circuit 50 (see FIG. 1). Specifically, the up-and-down switching circuit UDSW in the nth row receives a shift register output SRBOn−1 from the (n−1)th row and a shift register output SRBOn+1 from the (n+1)th row and selects either of them in accordance with the UD and UDB signals outputted from the control circuit 50. For example, when the UD signal is at a high level (the UDB signal is at a low level), the up-and-down switching circuit UDSW in the nth row selects the shift register output SRBOn−1 that it received from the (n−1)th, thereby choosing a downward scanning direction (i.e., from the (n−1)th row through the nth row to the (n+1)th row); when the UD signal is at a low level (the UDB signal is at a high level), the up-and-down switching circuit UDSW in the nth row selects the shift register output SRBOn+1 that it received from the (n+1)th, thereby choosing an upward scanning direction (i.e., from the (n+1)th row through the nth row to the (n−1)th row). This allows achieving a two-scanning-direction display driving circuit.

Figure 31:
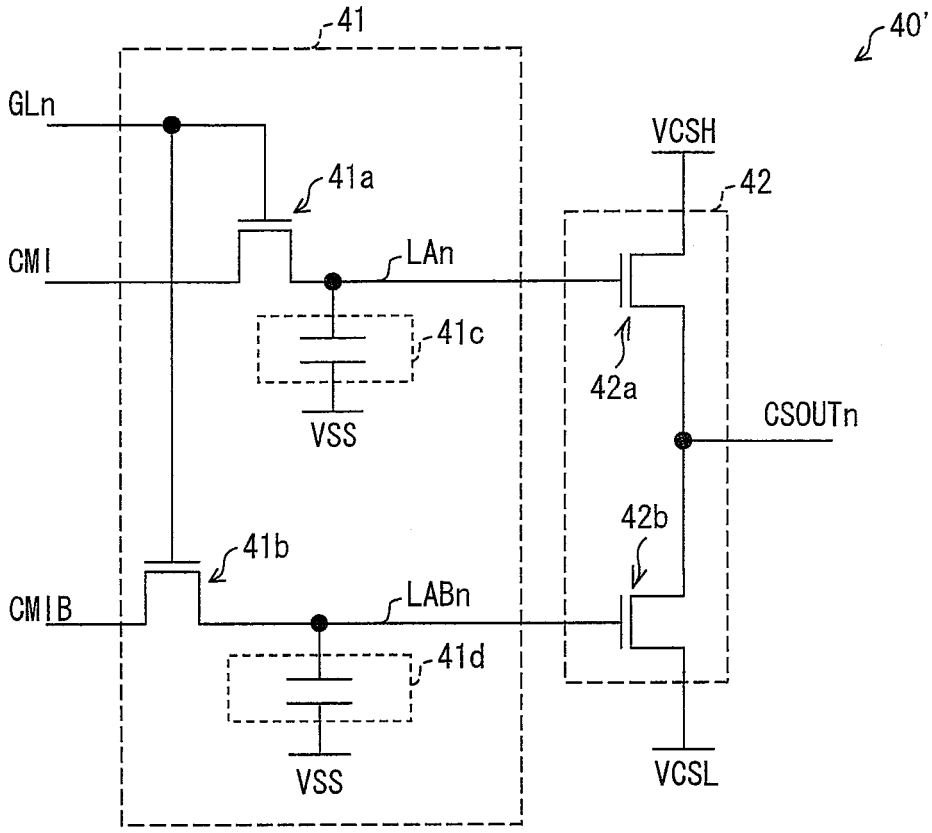
FIG. 31 is a circuit diagram showing another configuration of a retaining circuit at each stage of a CS bus line driving circuit according to the present embodiment.

The retaining circuit CSL at each stage of the CS bus line driving circuit 40 according to the present embodiment may be configured as shown in FIG. 31. As shown in FIG. 31, the retaining circuit CSL includes a memory circuit 41 and an analog switching circuit 42. The memory circuit 41 includes transistors 41*a* and 41*b* as switching elements and capacitors 41*c* and 41*d*, and the analog switching circuit 42 includes transistors 42*a* and 42*b*. Each of the transistors are constituted by an N-channel MOS transistor, and the retaining circuit CSL is constituted as a single-channel (N-channel) driving circuit. It should be noted that each of the transistors may be constituted by a P-channel MOS transistor, and the retaining circuit CSL may be constituted as a P-channel driving circuit.

As shown in FIG. 31, the retaining circuit CSL receives the internal signal Mn from the shift register circuit SRn in the nth row and the polarity signals CMI and CMIB, and outputs the CS signal CSOUTn via the memory circuit 41 and the analog switching circuit 42.

Figure 32:
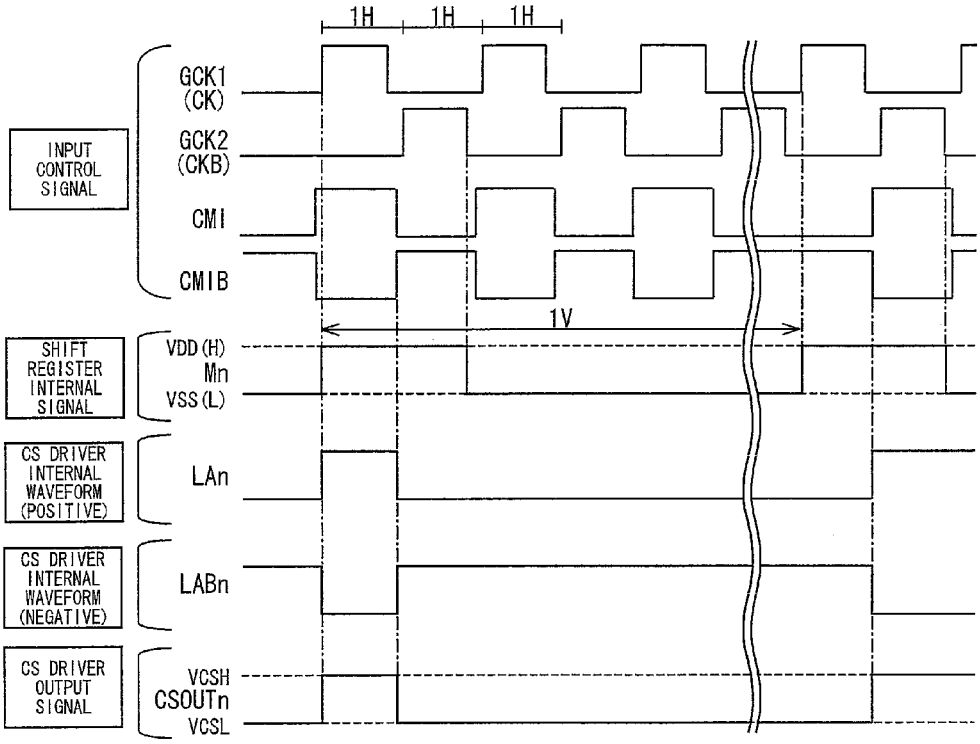
FIG. 32 is a timing chart showing operation of the retaining circuit shown in FIG. 31.

Operation of the retaining circuit CSL up to the point of output of the CS signal CSOUTn is described here with reference to FIGS. 31 and 32. It should be noted that the following describes an operation that the retaining circuit CSL carries out in outputting a CS signal that is positive in polarity, i.e., on receiving CMI that is positive in polarity.

First, when the memory circuit 41 receives the internal signal Mn, the memory circuit 41 loads the polarity signal CMI in accordance with a change in polarity of the internal signal Mn. Specifically, when the internal signal Mn changes in potential from a low level to a high level, the memory circuit 41 transfers the polarity signal CMI and outputs it as a signal LAn, and the capacitor 41*c* collects (stores) charge. That is, as shown in FIG. 32, the signal LAn switches from a H level to a L level since the polarity signal CMI is outputted during a period of time in which the internal signal Mn is at a H level (in which the transistor 41*a* is on). Next, when the internal signal Mn changes in potential level from a H level to a L level, the transistor 41*a* is shut off, so that the polarity signal CMI is no longer outputted. Then, the capacitor 41*c*, which has collected charge, allows the signal LAn to retain a potential level (L level) reached at the point in time where the transistor 41*a* was turned off. The signal LAn retains this state (L level) until the next time when the internal signal Mn changes in potential level from a L level to a H level, i.e., during a single vertical scanning period (1V).

Next, after 1V has elapsed, the internal signal Mn changes in potential level from a L level to a H level. Then, the polarity signal CMI is transferred and outputted; therefore, the signal LAn switches from a L level to a H level and retains this state (high level) during a single vertical scanning period (1V). After that, the aforementioned process is repeated.

The signal LAn outputted from the memory circuit 41 as a result of the aforementioned operation is inputted to the transistor 42*a* of the analog switching circuit 42. The analog switching circuit 42 receives a common voltage VCSH that is positive in polarity and a common voltage VCSL that is negative in polarity, and the turning on and off of the transistor 42*a* is controlled by the signal LAn. This allows the transistor 42*a* to be turned on at the timing (H level) of a rising edge in the signal LAn so that VCSH is outputted as the CS signal CSOUTn while the signal LAn is at a H level.

It should be noted here that because the polarity signals CMI and CMIB is opposite in polarity to each other at the timing when the transistors 41*a* and 41*b* are turned on, the signals LAn and LABn that are outputted from the memory circuit 41 are different in potential level (H/L level) from each other. Therefore, as shown in FIG. 32, when one of the signals is at a H level, the other signal is outputted at a L level. This allows outputting a CS signal that reverses its potential level every frame.

It should be noted that a display driving circuit of the present invention may be configured as follows:

The display driving circuit is used in a display device in which pixels are arranged in rows and columns, in which for each single row of pixels, there are provided a scanning signal line and a retention capacitor wire that forms a capacitor with each pixel electrodes in the row of pixels, and in which a potential reverses its polarity every single row of pixels. The display driving circuit includes a plurality of shift register circuits provided in such a way as to correspond to their respective rows. As for a scanning signal and a retention capacitor wire signal that switches in potential between high and low levels, which signals are respectively supplied to a scanning signal line and a retention capacitor wire that correspond to one of two adjacent rows of pixels, when the scanning signal changes from active to non-active in the first vertical scanning period of a display picture, the potential of the retention capacitor wire signal is at a low level, and the retention capacitor wire signal switches in potential to a high level by the next time when the scanning signal becomes active. As for a scanning signal and a retention capacitor wire signal that switches in potential between high and low levels, which signals are respectively supplied to a scanning signal line and a retention capacitor wire that correspond to the other one of the two adjacent rows of pixels, when the scanning signal changes from active to non-active in the first vertical scanning period of the display picture, the potential of the retention capacitor wire signal is at a high level, and the retention capacitor wire signal switches in potential to a low level by the next time when the scanning signal becomes active. The retention capacitor wire signals are generated by a retention capacitor wire driving circuit, and the retention capacitor wire driving circuit includes a plurality of shift register circuits provided in such a way as to correspond to their respective rows. An internal signal from the shift register circuit in each row or an output signal from the shift register circuit in each row is inputted to the latch circuit in that row.

Further, in the display driving circuit, each one stage of the shift register corresponds to a scanning signal line and a retention capacitor wire that are provided in a single row of pixel, and a scanning signal and a retention capacitor wire signal that are respectively supplied to the scanning signal line and the retention capacitor wire are generated using an internal signal or an output signal of that stage.

It should be noted that the gate line driving circuit, the source line driving circuit, or the gate line-CS bus line driving circuit and the pixel circuit of the display section may be formed monolithically (on an identical substrate).

The display driving circuit may also be configured such that: a signal potential that is supplied to a data signal line reverses its polarity every n horizontal scanning periods (where n is an integer); and a direction of change of signal potentials written into pixel electrodes from the data signal line varies every n adjacent rows.

This allows elimination of the appearance of transverse stripes every n rows in n-line inversion driving.

The display driving circuit may also be configured such that when a scanning signal that is supplied to a scanning signal line connected pixels corresponding to a current stage has changed from active to non-active, a potential of a retention capacitor wire signal that is supplied to a retention capacitor wire forming capacitors with pixel electrodes of the pixels varies every n adjacent rows.

The display driving circuit may also be configured such that immediately after a scanning signal that is supplied to a scanning signal line connected pixels corresponding to a current stage has changed from active to non-active and while the control signal generated by a next stage of the shift register is active, the retention target signal that is inputted to a retaining circuit corresponding to the next stage changes in potential.

The display driving circuit may also be configured such that: the retaining circuit corresponding to the current stage includes a first input section via which the retaining circuit receives the control signal generated by the current stage of the shift register, a second input section via which the retaining circuit receives the retention target signal, and an output section via which the retaining circuit outputs the retention capacitor wire signal to a retention capacitor wire corresponding to the previous stage; the retaining circuit outputs, as a first potential of the retention capacitor wire signal, a first potential of the retention target signal that the retaining circuit received via the second input section when the control signal that the retaining circuit received via the first input section became active; during a period of time in which the control signal that the retaining circuit received via the first input section is active, the retention capacitor wire signal changes in potential in accordance with a change in potential of the retention target signal that the retaining circuit received via the second input section; and the retaining circuit outputs, as a second potential of the retention capacitor wire signal, a second potential of the retention target signal that the retaining circuit received via the second input section when the control signal that the retaining circuit received via the first input section became non-active.

This brings about an effect of improving display quality with simple circuitry by preventing the appearance of transverse stripes in the first vertical scanning period.

The display driving circuit may also be configured such that a control signal that is generated by a current stage of the shift register is generated in accordance with an output signal from a previous stage of the shift register by which output signal the current stage of the shift register is set and an output signal from the current stage of the shift register by which output signal the current stage of the shift register is reset.

This allows achieving a self-resetting shift register, thus further allowing a further simplification of circuitry.

The display driving circuit may also be configured such that a control signal that is generated by a current stage of the shift register is generated in accordance with an output signal from a previous stage of the shift register by which output signal the current stage of the shift register is set and an output signal from a subsequent stage of the shift register by which output signal the current stage of the shift register is reset.

The foregoing configuration brings about an effect of improving display quality with a conventional common shift register by preventing the appearance of such transverse stripes.

The display driving circuit may also be configured such that: an output signal from the current stage of the shift register is inputted to the subsequent stage of the shift register and the previous stage of the shift register; and the control signal generated by the current stage of the shift register is inputted to the retaining circuit corresponding to the current stage.

The display driving circuit may also be configured such that a control signal generated by a current stage of the shift register is active during a period from a point in time where an output signal from a previous stage of the shift register by which output signal operation of the current stage of the shift register is started is inputted to the current stage of the shift register to a point in time where a reset signal by which the operation of the current stage of the shift register is terminated is inputted to the current stage of the shift register.

The display driving circuit may also be configured such that an output signal from the current stage of the shift register is generated in accordance with an output signal from the previous stage of the shift register by which output signal the current stage of the shift register is set and a clock signal inputted from an outside source.

The display driving circuit may also be configured such that the control signal generated by the current stage of the shift register is an output signal from the current stage of the shift register; and the output signal from the current stage of the shift register is inputted to a subsequent stage of the shift register and the retaining circuit of the current stage.

The display driving circuit may also be configured such that the output signal from the current stage of the shift register lags, by half a clock, an output signal from a previous stage of the shift register by which output signal operation of the current stage of the shift register is started.

The foregoing configuration allows the scanning signal driving circuit to be constituted by latch circuits. This brings about an effect of improving display quality with simple circuitry by preventing the appearance of transverse stripes in the first vertical scanning period.

The display driving circuit may also be configured such that a retention target signal that is inputted to a plurality of retaining circuits and a retention target signal that is inputted to another plurality of retaining circuits are different in phase from each other.

The display driving circuit may also be configured such that one of two retaining circuits that carry out a retention operation in an identical horizontal scanning period is supplied with a first retention target signal, and the other retaining circuit is supplied with a second retention target signal that is different in phase from the first retention target signal.

The foregoing configuration allows retention capacitor wire signals to vary in potential every n rows, thus allowing elimination of transverse stripes every n rows.

The display driving circuit may also be configured such that each of the retaining circuits is constituted as a D latch circuit or a memory circuit.

A display device according to the present invention includes: any one of the display driving circuits; and a display panel.

With the foregoing configuration, the effect of the display driving circuit preventing the appearance of transverse stripes makes it possible to provide a display device with satisfactory display quality.

It should be noted that it is preferable that the display device according to the present invention be a liquid crystal display device.

The present invention is not limited to the embodiments above, but a modification of any one of the embodiments on the basis of technical common sense or a combination of such modification, such as a COM driving circuit, is encompassed in the embodiments of the present invention.

INDUSTRIAL APPLICABILITY

The present invention can be suitably applied, in particular, to driving of an active-matrix liquid crystal display device.

REFERENCE SIGNS LIST

1 Liquid crystal display device (display device)
10 Liquid crystal display panel (display panel)
11 Source bus line (data signal line)
12 Gate line (scanning signal line)
13 TFT (switching element)
14 Pixel electrode
15 CS bus line (retention capacitor wire)
20 Source bus line driving circuit (data signal line driving circuit)
30 Gate line driving circuit (scanning signal line driving circuit)
40 CS bus line driving circuit (retention capacitor wire driving circuit)
50 Control circuit
CSL Latch circuit (logic circuit, D latch circuit, retention capacitor wire driving circuit)
SR Shift register circuit
CMI Polarity signal (retention target signal)
M Internal signal (control signal)
Q Internal signal (control signal)

The invention claimed is:

1. A display driving circuit for use in a display device in which by supplying retention capacitor wire signals to retention capacitor wires forming capacitors with pixel electrodes included in pixels, signal potentials written into the pixel electrodes are changed in a direction corresponding to polarities of the signal potentials, the display driving circuit comprising:

a shift register including a plurality of stages provided in such a way as to correspond to a plurality of scanning signal lines, respectively, the display driving circuit having retaining circuits provided in such a way as to correspond one-by-one to the stages of the shift register, a first clock signal being inputted to a current stage of the shift register, a second clock signal different in phase from the first clock signal being inputted to a subsequent stage of the shift register which subsequent stage follows the current stage of the shift register, the current stage of the shift register generating a first control signal and supplying the first control signal to a retaining circuit corresponding to the current stage, the subsequent stage of the shift register generating a second control signal and supplying the second control signal to a retaining circuit corresponding to the subsequent stage, a retention target signal being inputted to each of the retaining circuits, when the first control signal generated by the current stage of the shift register becomes active, the retaining circuit corresponding to the current stage loading and retaining the retention target signal, an output signal from the current stage of the shift register being supplied as a scanning signal to a scanning signal line connected to pixels corresponding to the current stage, the output signal being also supplied to the subsequent stage of the shift register, the subsequent stage of the shift register generating the second control signal in response to the output signal and the second clock signal and supplying the second control signal to the retaining circuit corresponding to the subsequent stage, an output from the retaining circuit corresponding to the current stage being supplied as the retention capacitor wire signal to a retention capacitor wire forming capacitors with pixel electrodes of pixels corresponding to a previous stage preceding the current stage, whereby, during a first vertical scanning period during which a data signal corresponding to a video image to be displayed starts to be outputted, a direction of change of signal potentials written into pixel electrodes of the pixels corresponding to the current stage of the shift register being differentiated from that of change of signal potentials written into pixel electrodes of pixels corresponding to the subsequent stage of the shift register.

2. The display driving circuit as set forth in claim 1, wherein:

a signal potential that is supplied to a data signal line reverses its polarity every n horizontal scanning periods (where n is an integer); and a direction of change of signal potentials written into pixel electrodes from the data signal line varies every n adjacent rows.

3. The display driving circuit as set forth in claim 2, wherein when a scanning signal that is supplied to a scanning signal line connected pixels corresponding to a current stage has changed from active to non-active, a potential of a retention capacitor wire signal that is supplied to a retention capacitor wire forming capacitors with pixel electrodes of the pixels varies every n adjacent rows.

4. The display driving circuit as set forth in claim 1, wherein immediately after a scanning signal that is supplied to a scanning signal line connected pixels corresponding to a current stage has changed from active to non- active and while the control signal generated by a next stage of the shift register is active, the retention target signal that is inputted to a retaining circuit corresponding to the next stage changes in potential.

5. The display driving circuit as set forth in claim 1, wherein:

the retaining circuit corresponding to the current stage includes a first input section via which the retaining circuit receives the control signal generated by the current stage of the shift register, a second input section via which the retaining circuit receives the retention target signal, and an output section via which the retaining circuit outputs the retention capacitor wire signal to a retention capacitor wire corresponding to the previous stage;

the retaining circuit outputs, as a first potential of the retention capacitor wire signal, a first potential of the retention target signal that the retaining circuit received via the second input section when the control signal that the retaining circuit received via the first input section became active;

during a period of time in which the control signal that the retaining circuit received via the first input section is active, the retention capacitor wire signal changes in potential in accordance with a change in potential of the retention target signal that the retaining circuit received via the second input section; and the retaining circuit outputs, as a second potential of the retention capacitor wire signal, a second potential of the retention target signal that the retaining circuit received via the second input section when the control signal that the retaining circuit received via the first input section became non-active.

6. The display driving circuit as set forth in claim 2, wherein a control signal that is generated by a current stage of the shift register is generated in accordance with an output signal from a previous stage of the shift register by which output signal the current stage of the shift register is set and an output signal from the current stage of the shift register by which output signal the current stage of the shift register is reset.

7. The display driving circuit as set forth in claim 2, wherein a control signal that is generated by a current stage of the shift register is generated in accordance with an output signal from a previous stage of the shift register by which output signal the current stage of the shift register is set and an output signal from a subsequent stage of the shift register by which output signal the current stage of the shift register is reset.

8. The display driving circuit as set forth in claim 7, wherein an output signal from the current stage of the shift register is inputted to the subsequent stage of the shift register and the previous stage of the shift register; and the control signal generated by the current stage of the shift register is inputted to the retaining circuit corresponding to the current stage.

9. The display driving circuit as set forth in claim 6, wherein a control signal generated by a current stage of the shift register is active during a period from a point in time where an output signal from a previous stage of the shift register by which output signal operation of the current stage of the shift register is started is inputted to the current stage of the shift register to a point in time where a reset signal by which the operation of the current stage of the shift register is terminated is inputted to the current stage of the shift register.

10. The display driving circuit as set forth in claim 1, wherein an output signal from the current stage of the shift register is generated in accordance with an output signal from the previous stage of the shift register by which output signal the current stage of the shift register is set and a clock signal inputted from an outside source.

11. The display driving circuit as set forth in claim 10, wherein:

the control signal generated by the current stage of the shift register is an output signal from the current stage of the shift register; and the output signal from the current stage of the shift register is inputted to a subsequent stage of the shift register and the retaining circuit of the current stage.

12. The display driving circuit as set forth in claim 11, wherein the output signal from the current stage of the shift register lags, by half a clock, an output signal from a previous stage of the shift register by which output signal operation of the current stage of the shift register is started.

13. The display driving circuit as set forth in claim 1, wherein a retention target signal that is inputted to a plurality of retaining circuits and a retention target signal that is inputted to another plurality of retaining circuits are different in phase from each other.

14. The display driving circuit as set forth in claim 1, wherein one of two retaining circuits that carry out a retention operation in an identical horizontal scanning period is supplied with a first retention target signal, and the other retaining circuit is supplied with a second retention target signal that is different in phase from the first retention target signal.

15. The display driving circuit as set forth in claim 1, wherein each of the retaining circuits is constituted as a D latch circuit or a memory circuit.

16. A display device comprising:

a display driving circuit as set forth in claim 1; and a display panel.

* * * * *